United States Patent [19]

Morigaki et al.

[11] Patent Number: 4,939,072

[45] Date of Patent: Jul. 3, 1990

[54] COLOR PHOTOGRAPHS AND PROCESS FOR MAKING THE SAME

[75] Inventors: Masakazu Morigaki; Nobuo Seto; Osamu Takahashi; Hideaki Naruse, all of Kanagawa, Japan

[73] Assignee: Fuji Photo Film Co., Ltd., Kanagawa, Japan

[21] Appl. No.: 256,263

[22] Filed: Oct. 12, 1988

Related U.S. Application Data

[63] Continuation-in-part of Ser. No. 81,517, Aug. 5, 1987, abandoned.

[30] Foreign Application Priority Data

Aug. 5, 1986 [JP] Japan ..... 61-183920
Jun. 25, 1987 [JP] Japan ..... 62-158642

[51] Int. Cl.[5] ..... G03C 7/32; G03C 7/26
[52] U.S. Cl. ..... 430/372; 430/551
[58] Field of Search ..... 430/551, 372, 214

[56] References Cited

U.S. PATENT DOCUMENTS

| | | | |
|---|---|---|---|
| 3,384,484 | 5/1968 | Schranz et al. | 430/551 |
| 3,772,014 | 11/1973 | Scullard | 430/372 |
| 4,179,293 | 12/1979 | Hirano et al. | 430/551 |
| 4,256,830 | 3/1981 | Jager | 430/372 |
| 4,352,873 | 10/1982 | Toda et al. | 430/551 |
| 4,358,534 | 11/1982 | Sasaki et al. | 430/372 |
| 4,410,619 | 10/1983 | Kubbota et al. | 430/234 |
| 4,483,918 | 11/1984 | Sakai et al. | 430/372 |
| 4,547,452 | 10/1985 | Toya | 430/372 |
| 4,704,350 | 11/1987 | Morigaki et al. | 430/546 |
| 4,770,987 | 9/1988 | Takahashi et al. | 430/372 |

FOREIGN PATENT DOCUMENTS

| | | |
|---|---|---|
| 0228655 | 7/1987 | European Pat. Off. . |
| 2834310 | 2/1979 | Fed. Rep. of Germany . |
| 49-33787 | 9/1974 | Japan . |
| 56-67842 | 6/1981 | Japan . |
| 56-151937 | 11/1981 | Japan . |
| 57-169749 | 10/1982 | Japan . |
| 1203832 | 9/1970 | United Kingdom . |

OTHER PUBLICATIONS

Patent Abstracts of Japan, vol. 10, No. 210, (P-479), [2266], published Jul. 23, 1986.

*Primary Examiner*—Richard L. Schilling
*Attorney, Agent, or Firm*—Sughrue, Mion, Zinn, Macpeak & Seas

[57] ABSTRACT

A color photograph comprising a support having provided thereon at least one photographic layer, wherein said at least one photographic layer contains a storage stability improving compound which forms a chemically inert and substantially colorless compound by combining chemically with the oxidation product of an aromatic amine color developing agent remaining in said color photograph after color development processing.

5 Claims, No Drawings

COLOR PHOTOGRAPHS AND PROCESS FOR MAKING THE SAME

This is a continuation-in-part of application Ser. No. 081,517, filed Aug. 5, 1987, now abandoned.

FIELD OF THE INVENTION

This invention relates to color photographs and a process for making them. More particularly, the invention relates to color photographs having improved storage stability and a process for making such color photographs.

BACKGROUND OF THE INVENTION

When a silver halide color photographic material is imagewise exposed and developed by an aromatic amine color developing agent, dye images are formed by the reaction of dye image-forming coupler(s) (hereinafter simply referred to as coupler(s)) and the oxidation product of the color developing agent formed as the result of development. For a multicolor photographic material, a combination of a yellow coupler, a cyan coupler, and a magenta coupler is usually used.

Since Fischer et al's discovery of how to conduct a color development process in 1912, the system has been strikingly improved. In particular, recently the improvements in shortening of photographic processing time, simplification of processing steps, reutilization of waste processing liquids, reduction of amounts of replenishers for processing liquids, photographic processing without using a wash step, removal of benzyl alcohol from the color developer to prevent environmental pollution, etc., has been actively investigated.

However, even with such efforts, there remain various problems. For example, there are in fact problems due to using replenishers for processing liquids in accordance with the processing amount of color photographic materials in place of preparing fresh processing liquids.

That is, for color photographic processing, a color developer, a stop liquid, a bleach liquid, a fix liquid (or a bleach-fix liquid or a blix liquid), etc., are usually used but the compositions for these processing liquids change due to decomposition of the processing components, such as a developing agent, etc., during processing for a long period of time, since the processing temperature is generally maintained at 31° C. to 43° C. to speed up processing, oxidation of the processing components by contact with air, accumulation of dissolved matters of the components in color photographic materials by processing with the processing liquids, and also addition of processing liquid carried by color photographic materials from the previous stop to form so-called running liquids.

Accordingly, replenishment for supplementing chemicals consumed by processing to each processing liquid and regeneration of each processing liquid by removing therefrom useless materials have been performed, but the aforesaid problems have not yet been satisfactorily solved by the application of these counterplans.

Furthermore, in the process of reducing the amount of wash water or omitting the wash step due to a shortage of water resources or an increase of water charges, as well as due to prevention of environmental pollution, inorganic components such as thiosulfates, sulfites, metabisulfites, etc., in processing liquids and organic components such as a color developing agent, etc., are contained in or attached to color photographic materials processed.

In view of the deterioration of the compositions used in porocessing liquids and the aforesaid problems in reducing the amount of wash water in the wash step or in omitting the wash step, it can be seen that there is a tendency to increase the amounts of components used for processing liquids which results in an increase in the amounts carried in the color photographic materials after development.

On the other hand, with regard to couplers, the development of couplers giving clear cyan, magenta, and yellow dyes having less side absorptions for obtaining good color reproducibility and also the development of high-active couplers for completing color development in a short period of time have been developed. Furthermore, the development of various additives for obtaining good performance of these couplers has been also found. However, such coupler performance causes the color photograph to have reduced storage stability, because these couplers react with the processing liquid components remaining in the color photographic materials after processing.

It is known that when processing liquid components remain in color photographic material after processing, an aromatic primary amine compounds, which is a color developing agent, and the compounds induced from the amine compound reduce the fastness of color images under the influence of light, moisture, oxygen, etc., or are converted into colored substance by self-coupling thereof or reaction with coexisting materials to cause a so-called "stain" during storage of the color photographic materials thus processed for a long period of time. This is a fatal defect for color photographs.

On the other hand and apart from this, various investigations into preventing the deterioration of color images formed and preventing the formation of stain have also been made. For example, it has been proposed to selectively use couplers showing less fading property, use fading preventing agents for preventing fading of color photographs by light, and use ultraviolet absorbents for preventing the deterioration of color images by ultraviolet rays.

In these proposals, the effect of preventing the deterioration of color images by the use of fading preventing agents is large and as such fading preventing atgents, there are, for example, hydroquinones, hindered phenols, tocopherols, chromans, coumarans, and the compounds formed by etherifying the phenolic hydroxy groups of these compounds as described in U.S. Pat. Nos. 3,935,016, 3,930,866, 3,700,455, 3,764,337, 3,432,300, 3,573,050, 4,254,216, British Patents Nos. 2,066,975, 1,326,889, Japanese Patent Publication No. 30462/76, etc.

These compounds may have an effect of preventing fading and discoloration of dye images, but since the effect is yet insufficient for meeting the customers' requirement for high image quality and the use of these compounds changes the hue, forms fogs, causes poor dispersibility, and cause fine crystals after coating silver halide emulsions, overall excellent effects for color photographs have not yet been obtained by the use of these compounds.

Furthermore and recently, for preventing the occurrence of stain, the effectiveness of certain amine compounds are proposed in U.S. Pat. Nos. 4,463,085, 4,483,918, Japanese Patent Application (OPI) Nos.

218445/84, 229557/84, etc. (the term "OPI" as used herein refers to a "published unexamined Japanese patent application"). However, by the use of these proposed compounds, a satisfactory effect for preventing the occurrence of stain has not yet been obtained.

SUMMARY OF THE INVENTION

An object of this invention is, therefore, to provide a process for making color photographs in which occurrence of discoloring of the white background is prevented even when the color photographs are stored or exhibited for a long period of time after imagewise exposing, color developing, bleaching, and fixing (or blixing) silver halide color photographic material.

Another object of this invention is to provide color photographs in which the deterioration of the dye images thereof by the remaining color developing agent carried over therein during color development, bleaching, and fixing (or blixing) is prevented.

A still other object of this invention is to provide a color image-forming process wherein the occurrence of color image deterioration and stain caused by the oxidation product of an aromatic amine color developing agent remaining in the color photographic material even when due to processing with processing liquid providing a large amount of processing liquid component(s) to the color photographic material, such as processing liquids in a running state, a processing liquid of reduced amount of wash water or processing liquid without employing wash step, a color developer containing substantially no benzyl alcohol, etc., or other processing liquids imposing a burden on color development, and also the occurrence of side reactions caused by the occurrence of them are prevented.

As the result of various investigations, the inventors have discovered that the above-described objects can be effectively attained by incorporating a storage stability improving compond forming a chemically inert and substantially colorless compound by combining with the aforesaid oxidation product of an aromatic amine color developing agent in a color photographic light-sensitive material comprising a support having coated thereon silver halide emulsion layer(s) coantaining color image-forming coupler(s) forming dye(s) by the oxidative coupling reaction with the aromatic amine color developing agent, the color photographic light-sensitive material being, after imagewise exposure, color developed, bleached, or fixed (or blixed), such incorporation to the light-sensitive material being carried out upon producing the light-sensitive material or at any stage of before, during, or after the color development.

This invention has been accomplished based on this discovery.

That is, according to this invention, there is provided a color photograph comprising a support having provided thereon at least one photographic layer containing a storage stability improving compound which forms a chemically inert and substantially colorless compound by combining chemically (preferably under pH of 8 or less) with the oxidation product of an aromatic amine color developing agent remaining in the color photograph after processing. CL DETAILED DESCRIPTION OF THE INVENTION The aromatic amine color developing agent in this invention includes aromatic primary, secondary, and tertiary amine compounds and more specifically phenylenediamine compounds and aminophenol compounds. Specific examples are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 4-methyl-2-amino-N,N-diethylaniline, 4-methyl-2-amino-N-ethyl-N-β-methanesulfonamidoethylaniline, 2-amino-N-ethyl-N-β-hydroxyethylaniline, 3-methyl-4-methylamino-N-ethyl-N-β-hydroxyethylaniline, 3-methyl-4-dimethylamino-N-ethyl-N-β-methanesulfonamidoethylaniline, 3-methyl-4-butylamino-N,N-diethylaniline, 3-methyl-4-acetylamino-N-ethyl-N-β-hydroxyethylaniline, 3-methyl-4-methanesulfonamido-N-ethyl-N-β-methanesulfonamidoethylaniline, 3-methyl-4-benzylamino-N-β-methanesulfonamidoethylaniline, 3-methyl-4-cyclohexylamino-N-ethyl-N-methylaniline, and sulfates, hydrochlorides, phosphates, or p-toluenesulfonates of these compounds, tetraphenylborates, p-(t-octyl)benzenesulfonates, o-aminophenol, p-aminophenol, 4-amino-2-methylphenol, 2-amino-3-methylphenol, 2-hydroxy-3-amino-1,4-dimethylbenzene, etc.

Other aromatic amine color developing agents which can be used in this invention are described in L. F. A. Mason, *Photographic Processing Chemistry,* Focal Press, pp. 226–229, U.S. Pat. Nos. 2,193,015, 2,592,364, Japanese Patent Application (OPI) No. 64933/73, etc.

On the other hand, the oxidation product of an aromatic amine color developing agent is an oxidation product chemically induced by one electron or two electrons of the afore-mentioned aromatic amine developing agent.

The storage stability improving compound forming a chemically inert and substantially colorless compound by causing chemical bonding with the oxidation product of the aromatic amine color developing agent after color development process is preferably represented by formula (I);

$$R_1—Z \qquad (I)$$

wherein, $R_1$ represents an aliphatic group, an aromatic group or a heterocyclic group and Z represents a nucleophilic group or a group capable of being decomposed in the light-sensitive material to release a nucleophilic group.

Each group of compounds represented by formula (I) is explained in detail.

The aliphatic group represented by $R_1$ is a straight chain, branched chain or cyclic alkyl group, alkenyl group or alkynyl group and these groups may be substituted by a substituent. The aromatic group shown by $R_1$ may be a carbocyclic series aromatic group (e.g., a phenyl goup, a naphthyl group, etc.) or a heterocyclic series aromatic group (e.g., a furyl group, a thienyl group, a pyrazoyl group, a pyridyl group, an indolyl group, etc.) and the group may be a monocyclic series or condensed ring series (e.g., a benzofuryl group, a phenanthridinyl group, etc.). Furthermore, these aromatic rings may have a substituent.

The heterocyclic group shown by $R_1$ is preferably a group having a 3-membered to 10-membered ring composed of carbon atoms, oxygen atom(s), nitrogen atom(s), or sulfur atom(s), the heterocyclic ring itself may be a saturated ring or an unsaturated ring, and further the ring may be substituted by a substituent (e.g., a coumaryl group, a pyrrolidyl group, a pyrrolinyl group, a morpholinyl group, etc.).

In formula (I) Z represents a nucleophilic group or a group capable of being decomposed in the light-sensitive material to release a nucleophilic group. Examples of the nucleophilic group include a nulceophilic group in which the atom directly connecting to the oxidized form of the aromatic amine developing agent is an oxygen atom, a sulfur atom, or a nitrogen atom (e.g., a benzenesulfinyl group, a mercapto group, an amino group, an N-hetero atom substituted amino group in which the hetero atom substituted group includes a hydroxyl group, an alkoxy group, an amino group, etc.).

The compound shown by formula (I) described above causes a nucleophilic reaction (typically a coupling reaction) with the oxidation product of an aromatic amine developing agent.

Of the compounds shown by formula (I), it is preferred that Z is a group induced from a nucleophilic functional group having a Pearson's nucleophilic $n_{CH_3I}$ value of at least 5 (R. G. Pearson et al., *Journal of American Chemical Society,* 90, 319 (1968).

If the value is less than 5, the reaction with the oxidation product of an aromatic amine developing agent is delayed, which results in making it difficult to prevent the side reaction by the oxidation product of an aromatic amine developing agent remaining in the color photograph, which is the object of this invention.

In the compounds shown by formula (I) described above, a compound represented by following formula (II) is most preferred;

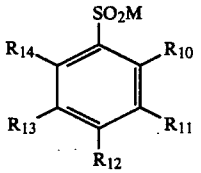

(II)

wherein, M represents an atom or an atomic group forming an inorganic salt (e.g., a salt of Li, Na, K, Ca, Mg, etc.) or an organic salt (e.g., a salt of triethylamine, methylamine ammonia, etc.), or

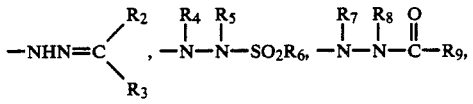

wherein $R_2$ and $R_3$ may be the same or different, and each represents a hydrogen atom, an aliphatic group, an aromatic group, or a heterocyclic group as defined for $R_1$, provided that $R_2$ and $R_3$ may be linked to form a 5- to 7-membered ring; $R_4$, $R_5$, $R_7$, and $R_8$ may be the same or different, and each represents a hydrogen atom, an aliphatic group, an aromatic group, or a heterocyclic group defined for $R_1$, or an acyl group, an alkoxycarbonyl group, a sulfonyl group, a ureido group, or urethane group, provided that at least one of $R_4$ and $R_5$ and at least one of $R_7$ and $R_8$ each represents a hydrogen atom; $R_6$ and $R_9$ each represents a hydrogen atom, an aliphatic group, an aromatic group, or a heterocyclic group; or $R_9$ may represent an alkylamino group, an alkoxy group, an aryloxy group, an acyl group, an alkoxycarbonyl group, and an aryloxycarbonyl group, provided that at least two of $R_4$, $R_5$, and $R_6$ may be linked to form a 5- to 7-membered ring, and at least two of $R_7$, $R_8$, and $R_9$ may be linked to form a 5- to 7-membered ring; and $R_{10}$, $R_{11}$, $R_{12}$, $R_{13}$, and $R_{14}$, which may be the same or different, each represents a hydrogen atom, an aliphatic group (e.g., a methyl group, an isopropyl group, a t-butyl group, a vinyl group, a benzyl group, an octadecyl group, a cyclohexyl group, etc.), an aromatic group (e.g., a phenyl group, a pyridyl group, a naphthyl, group, etc.), a heterocyclic group (e.g., a piperidyl group, a pyranyl group, a furanyl group, a chromanyl group, etc.), a halogen atom (e.g., a chlorine atom, a bromine atom, etc.), $—SR_{15}—$, $—OR_{15}—$,

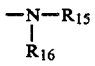

(wherein, $R_{15}$ and $R_{16}$, which may be the same or different in the case of $—NR_{15}R_{16}$, each represents a hydrogen atom, an aliphatic group, an alkoxy group, or an aromatic group), an acyl group (e.g., an acetyl group, a benzoyl group, etc.), an alkoxy-carbonyl group (e.g., a methoxycarbonyl group, a butoxycarbonyl group, a cyclohexyloxycarbonyl group, an octyloxycarbonyl group, etc.), an aryloxycarbonyl group (e.g., a phenyloxycarbonyl group, a naphthyloxycarbonyl group, etc.), a sulfonyl group (e.g., a methanesulfonyl group, a benzenesulfonyl group, etc.), a sulfonamido group (e.g., a methanesulfonamido group, a benzenesulfonamido group, etc.), a sulfamoyl group, a ureido group, a urethane group, a carbamoyl group, a sulfo group, a carboxy group, a nitro group, a cyano group, an alkoxyallyl group (e.g., a methoxyallyl group, an isobutoxyallyl group, an octyloxyallyl group, a benzyloxyallyl group, etc.), an aryloxyallyl group (e.g., a phenoxyallyl group, a naphthoxyallyl group, etc.), a sulfonyloxy group (e.g., a methanesulfonyloxy group, a benzenesulfonyloxy group, $—P(R_{15})_3$,

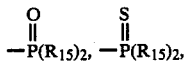

$—P(OR_{15})_3$, (wherein, $R_{15}$ has the same significance as defined above), or a formyl group.

In these groups, the group in which the sum of Hammet's $\sigma$ values to the $—SO_2M$ group is at least 0.5 is preferred to achieve the objects of this invention.

Specific examples of the compounds represented by formula (I) are illustrated below.

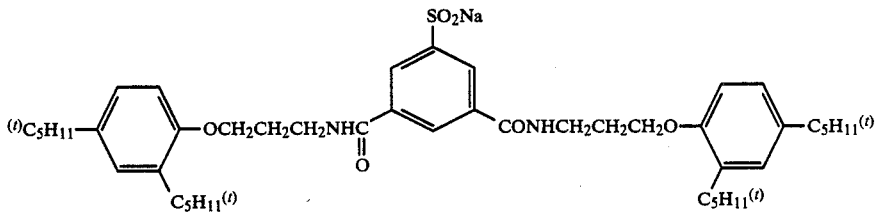

(I-1)

-continued
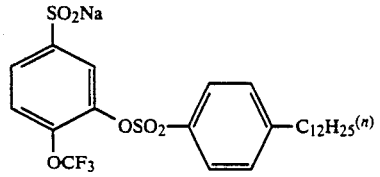
(I-2)
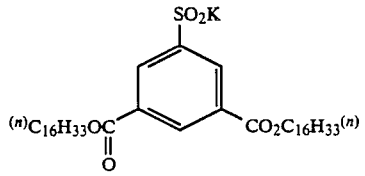
(I-3)
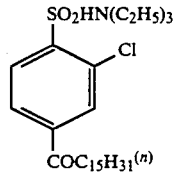
(I-4)
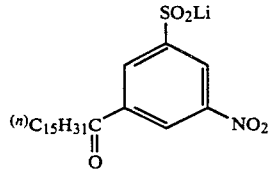
(I-5)
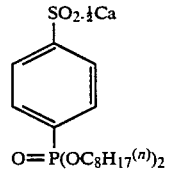
(I-6)
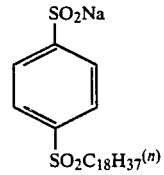
(I-7)
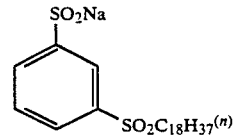
(I-8)
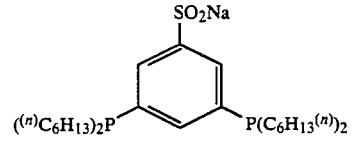
(I-9)
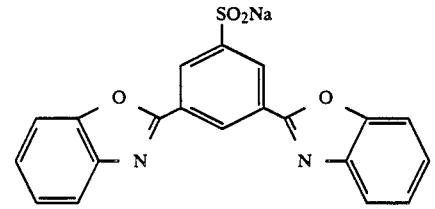
(I-10)

-continued
(I-11)
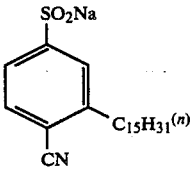
(I-12)
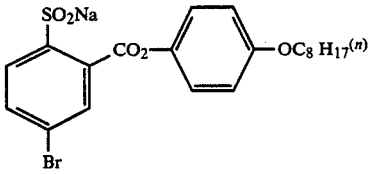
(I-13)
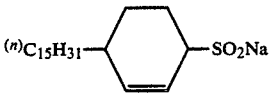
(I-14)
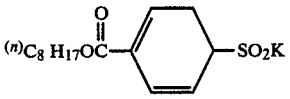
(I-15)
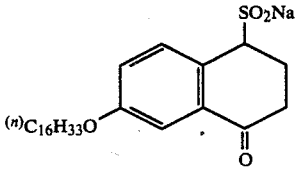
(I-16)
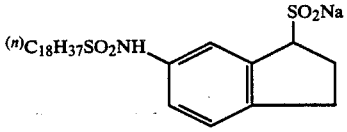
(I-17)
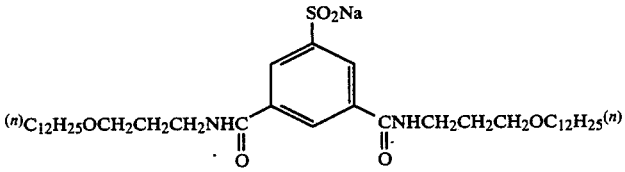
(I-18)
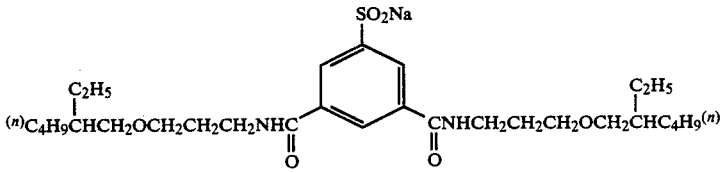
(I-19)
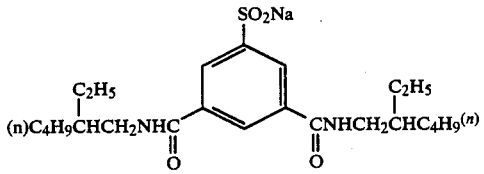
(I-20)
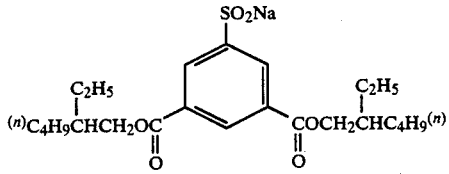

-continued
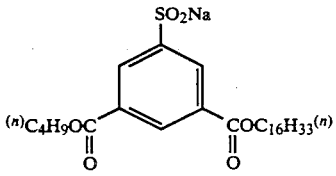
(I-21)
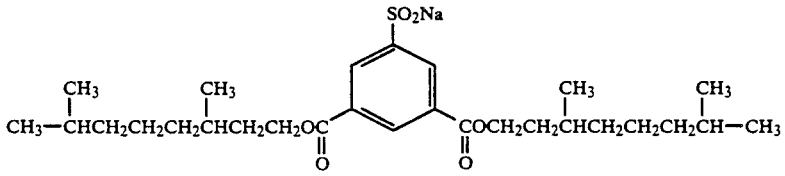
(I-22)
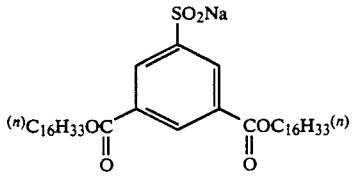
(I-23)
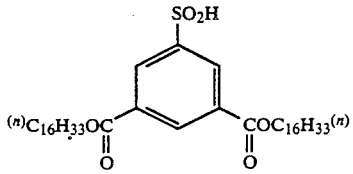
(I-24)
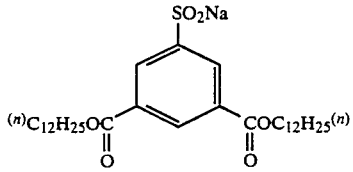
(I-25)
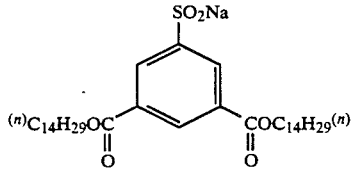
(I-26)
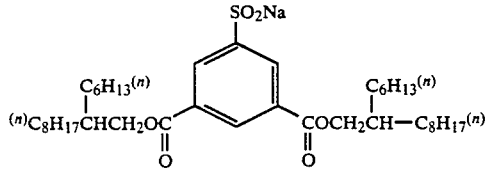
(I-27)
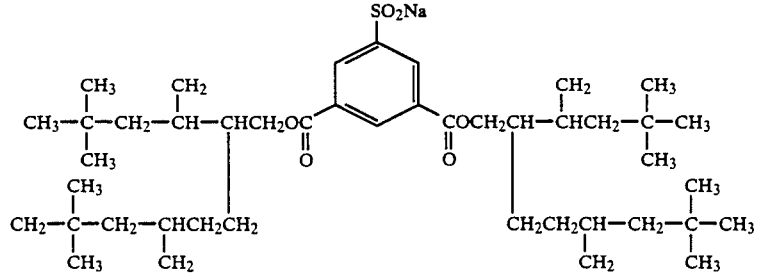
(I-28)

-continued
(I-29)
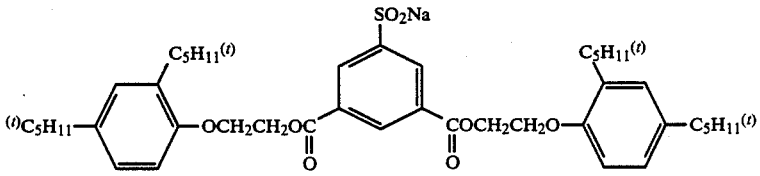
(I-30)
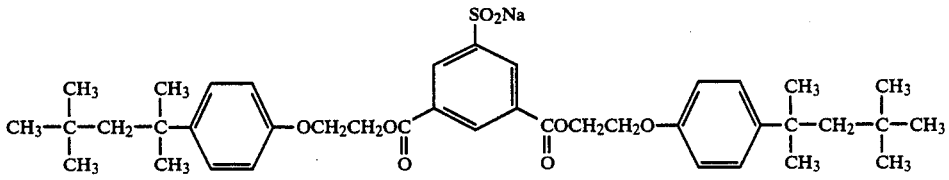
(I-31)
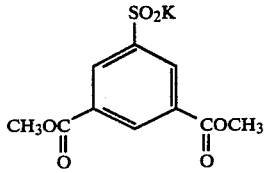
(I-32)
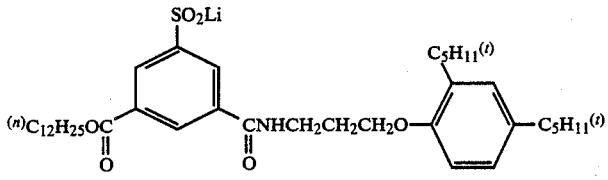
(I-33)
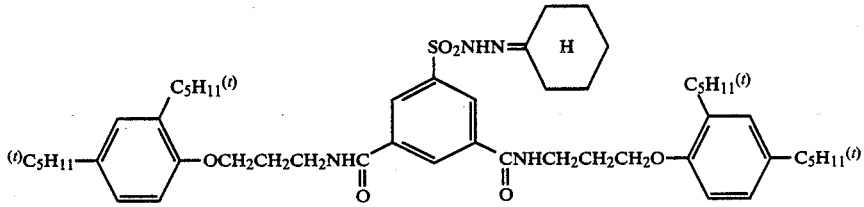
(I-34)
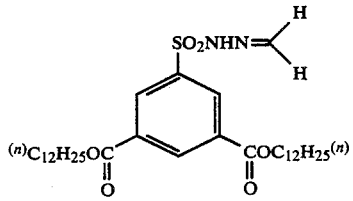
(I-35)
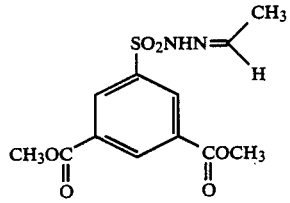
(I-36)
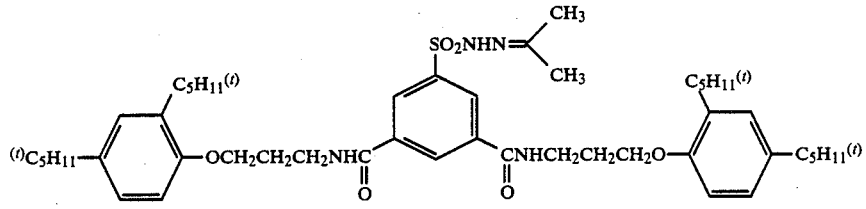

-continued
(I-37)
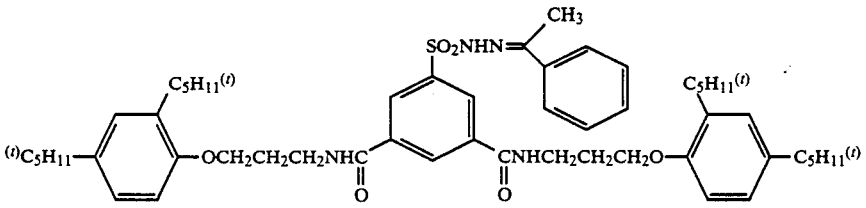
(I-38)
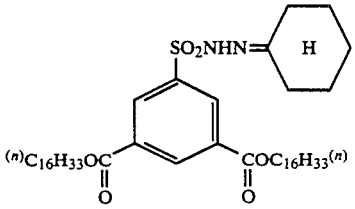
(I-39)
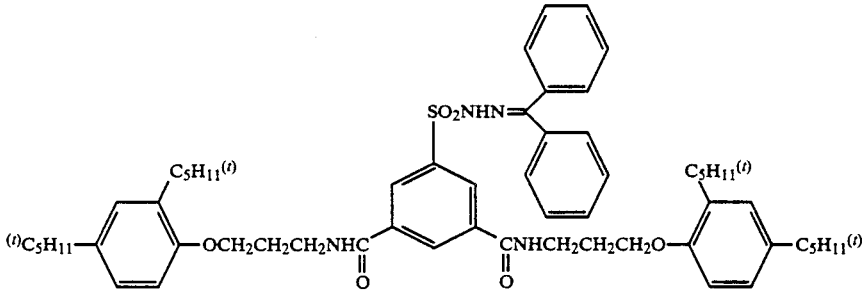
(I-40)
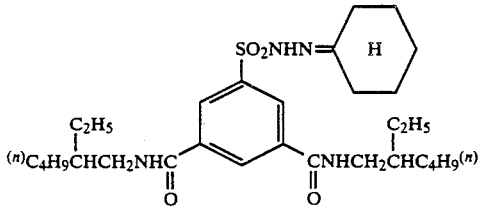
(I-41)
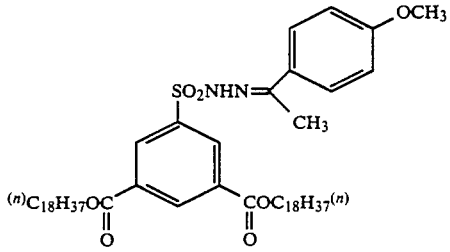
(I-42)
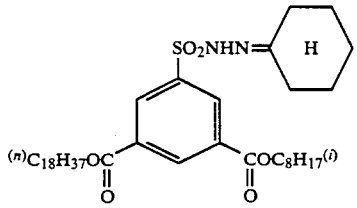
(I-43)
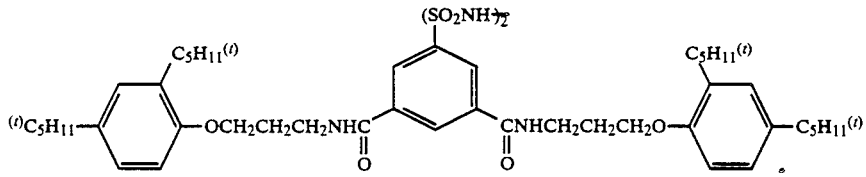

-continued
(I-44)
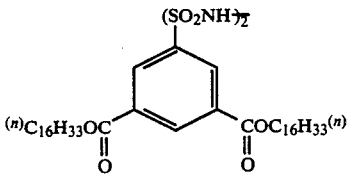
(I-45)
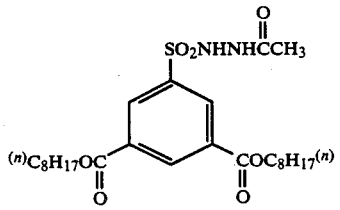
(I-46)
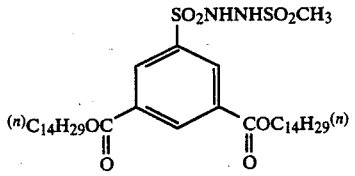
(I-47)
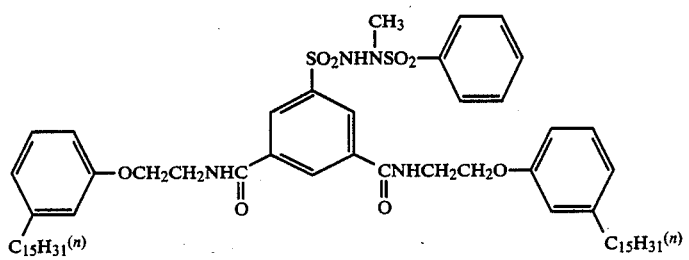
(I-48)
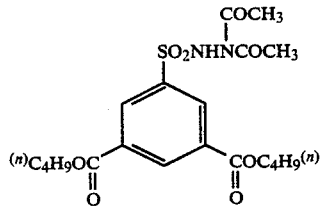
(I-49)
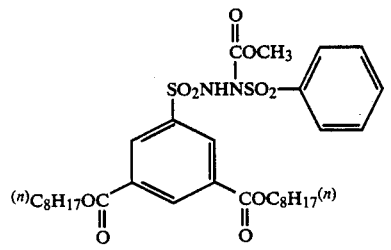
(I-50)
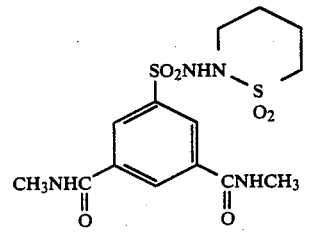

-continued

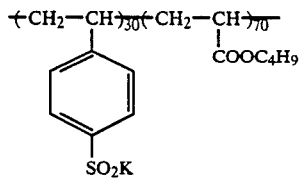

(I-51)

SYNTHESIS EXAMPLE 1

Synthesis of Compound (I-1):

(i) Synthesis of 3,5-di-(2,4-di-tert-acylphenoxypropylcarbamoyl)benzenesulfonyl chloride:

To 10 g (0.034 mol) of 5-sulfoisophthalic acid dimethyl ester sodium salt were added 100 ml of toluene, 16 ml (0.080 mol) of a methanol solution containing 28% sodium methylate, and 24.7 g (0.085 mol) of 2,4-di-tert-amylphenoxypropylamine and the mixture was heated to 100° C. The mixture was heated for 3 hours while distilling off methanol therefrom and, after cooling the reaction mixture, cold water was added thereto. The toluene layer formed was recovered, washed twice with cold water, and then dried using Glauber's salt. Then the Glauber's salt was filtrated away, the filtrate was concentrated to dryness, dissolved in 100 ml of N,N-dimethylacetamide and 50 ml of acetonitrile and the solution was stirred at room temperature. To the solution was added 30 ml (0.326 mol) of phosphorus oxychloride and the mixture was heated to 50° C. to 60° C. for one hour. The reaction mixture was added to ice water, extracted with 300 ml of ethyl acetate, and the ethyl acetate layer formed was recovered, washed thrice with ice water, and dried over Glauber's salt. After filtrating away the Glauber's salt, ethyl acetate was distilled off from the filtrate, and the residue was purified by column chlromatography to provide 11.5 g (yield of 41.9%) of the desired product.

(ii) Synthesis of sodium 3,5-di-(2,4-di-tert-amylphenoxypropylcarbamoyl)benzenesulfinate (Compound I-1):

To 2 g (0.016 mol) of sodium sulfite and 2.4 g (0.029 mol) of sodium hydrogen carbonate were added 100 ml of water and 20 ml of acetonitrile and the mixture was stirred at 30° C. To the mixture was added dropwise a solution of 10.5 g (0.013 mol) of 3,5-di-(2,4-di-tert-amylphenoxypropylcarbamoyl)benzenesulfonyl chloride obtained in the aforesaid step dissolved in 100 ml of acetonitrile. After stirring the resultant mixture for one hour, the reaction mixture was poured onto ice water and extracted with 150 ml of ethyl acetate. The ethyl acetate layer was washed thrice with cold water and dried over Glauber's salt. After filtrating away the Glauber's salt, the residue was concentrated to dryness to provide 8.6 g (yield of 82.8%) of a solid product.

Elemental Analysis for $C_{46}H_{67}N_2O_6SNa$:

| | C | H | N | S |
|---|---|---|---|---|
| Found: | 68.75% | 8.39% | 3.32% | 3.92% |
| Calculated: | 69.14% | 8.45% | 3.51% | 4.01% |

SYNTHESIS EXAMPLE 2

Synthesis of Compound (I-24)

(i) Synthesis of sodium 3,5-dihexadecyloxycarbonylbenzenesulfonate 210 ml of toluene, 4.57 ml (0.0705 mol) of methanesulfonic acid, and 68.3 g (0.282 mol) of hexadecanol were added to 20.8 g (0.0705 mol) of sodium 3,5-dimethyloxycarbonylbenzenesulfonate, and the mixture was heated for 19 hours while heating, refluxing, and distilling away the vaporizable component. After 500 ml of ethyl acetate was added thereto, the mixture was poured into 500 ml of water, and the precipitate was filtered off. The precipitate was then washed with acetonitrile and isopropanol to obtain a white solid containing sodium 3,5-di-hexadecyloxycarbonylbenzenesulfonate. (Yield: 53 g, m.p.: 85°-95° C.)

(ii) Synthesis of 3,5-dihexadecyloxycarbonylbenzenesulfonyl chloride 220 ml of ethyl acetate and 22 ml of DMAC were added to 36.6 g of the white solid containing sodium 3,5-dihexadecyloxycarbonylbenzenesulfonate. 28.1 ml (0.306 mol) of phosphorus oxychloride was added dropwise thereto over 14 minutes while heated to 40° C. and stirring, and the mixture was further stirred for 3 hours and 30 minutes at 40° C. and for 2 hours at 55° C. The reaction mixture was poured into 300 ml of ice water with stirring, and was twice extructed with 1 l of chloroform, followed by drying with Galuber's salt. After filtering off Glauber's salt, the solution was concentrated under reduced pressure. The residue thus-obtained was recrystalized from chloroform/acetonitrile to obtain a white solid containing 3,5-dihexadecyloxycarbonylbenzenesulfonyl chloride. (Yield: 31.0 g, m.p.: 48°-50° C.)

(iii) Synthesis of 3,5-dihexadecyloxycarbonylbenzenesulfinic acid (Compound I-24))

87 ml of water and 18.2 ml (0.218 mol) of 12N-HCl were added to the solution of 87 ml of chloroform and 8.65 g (0.0121 mol) of the white solid containing 3,5-dihexadecyloxycarbonylbenzenesulfonyl chloride, and then 7.93 g of zinc was added thereto at 5° C. followed by stirring for 4 hours and 30 minutes. After the insoluble component was removed therefrom, the sodlution was extracted with 100 ml of chloroform, washed with saturated brine, and dried with Glauber's salt. After removing Glauber's salt, the solution was concentrated under reduced pressure, and the residue was recrystalized from hot hexane to obtain a colorless crystal of 3,5-dihexadecyloxycarbonylbenzenesulfinic acid. (Yield: 4.43 g, 48% (based on sodium 3,5-dimethyloxycarbonylbenzenesulfonate), m.p.: 63°-65° C.)

SYNTHESIS EXAMPLE 3

Synthesis of Compound (I-23)

The same procedures of Synthesis Example 2 were repeated, and 500 ml of a saturated aqueous solution of sodium carbonate was added to thus obtained 300 ml of a chloroform solution of Compound (I-24). The precipitate was collected and washed with water to obtain a colorless crystal of sodium 3,5-dihexadecyloxycarbonylbenzenesulfinate. (Yield: 32% (based on sodium 3,5-dihexadecyloxycarbonylbenzenesulfonate), m.p.: 229°-231° C.)

SYNTHESIS EXAMPLE 4

Synthesis of Compound (I-38)

(i) Synthesis of 3,5-dihexadecyloxycarbonylbenzenesulfonyl hydrazide

A solution of 26 ml of chloroform and 5.20 g of a white solid containing 3,5-dihexadecyloxycarbonylbenzenesulfonyl chloride was added dropwise to 2.28 g (0.0364 mol) of 80% hydrazine hydrate, followed by stirring for 2 hours. Then, 200 ml of ethyl acetate was added thereto, and the mixture was washed with saturated brine and dried with Glauber's salt. After removing Glauber's salt, the solution was concentrated under reduced pressure, and the residue was recrystalized from hot ethyl acetate to obtain a white solid containing 3,5-dihexadecyloxycarbonylbenzenesulfonyl hydrazide. (Yield: 3.66 g, m.p.: 83°-88° C.)

(ii) Synthesis of cyclohexane 2-(3,5-bis(hexadecycloxycarbonyl)benzenesulfonyl)hydrazone 100 ml of methanol and 0.81 mol (0.00780 mol) of cyclohexanone were added to 5.03 g (0.00709 mol) of 3,5-dihexadecyloxycarbonylbenzenesulfonyl hydrazide, and the mixture was stirred for 1 hour and 30 minutes while heating and refluxing, followed by cooled to room temperature. The precipitate was collected and recrystalized from a mixed solvent (hexane/ethyl acetate: 50/1) to obtain a white solid containing Compound (I-38). (Yield: 3.22 g, m.p.: 87°-88° C.)

SYNTHESIS EXAMPLE 5

Synthesis of Compound (I-44)

5 ml of dimethylacetamide and 15 ml of ethyl acetate were added to 1.0 g of 3,5-dihexadecyloxycarbonylbenzenesulfonyl hydrazide, and 1.01 g of crystals of 3,5-dihexadecyloxycarbonylbenzenesulfonyl chloride was further added thereto while stirring. After stirring for 30 minutes at room temperature, 0.2 ml of pyridine was added dropwise thereto, and stirred for further 5 hours. After the completion of reaction, the reaction mixture was poured into 100 ml of water, and crystals thus-precipitated was collected and dried. The crystals was purified with a silica gel column chromatography to obtain crystals of Compound (I-44). (Yield: 0.4 g (20.5%), m.p.: 148°-150° C.)

All the compounds according to the present invention can be prepared in accordance with the above-mentioned Synthesis Examples.

Since the aforesaid compound for use in this invention has low molecular weight or is easily soluble in water, the compound may be added to a processing liquid and carried over in a color photographic material during processing the color pshotographic material. However it is preferred to incorporate the compound in a color photographic material into the process of producing the color photographic material. In the latter case, the compound is usually dissolved in a high-boiling solvent, such as an oil, having a boiling point of at least 170° C. at atmospheric pressure or a low-boiling solvent, or a mixture of the aforesaid oil and a low-boiling solvent, and the solution is dispersed by emulsification in an aqueous solution of a hydrophilic colloid such as gelatin, etc. The compound for use in this invention described above is preferably soluble in a high-boiling organic solvent. There is no particular restriction on the particle size of the emulsified dispersion particles of the compound but the particle size is preferably from 0.05 μm to 0.5 μm, particularly preferably from 0.1 μm to 0.3 μm. Also, it is particularly preferred that the compound for use in this invention is co-emulsified with coupler(s) to achieve the effects of this invention. In this case, the ratio of oil/coupler is preferably from 0.00 to 2.0 by weight ratio.

Also, the content of the aforesaid compound for use in this invention is from $1\times10^{-2}$ mol to 10 mols, preferably from $3\times10^{-2}$ to 5 mols per mol of the coupler in the same photographic emulsion layer.

In this case, specific examples of the aforesaid oil which is used in the case of incorporating the compound of this invention in the color photographic material are alkyl phthalates (e.g., dibutyl phthalate, dioctyl phthalate, diisodecyl phthalate, dimethoxyethyl phthalate, etc.), phosphoric acid eaters (e.g., diphenyl phosphate, triphenyl phosphate, tricresyl phosphate, dioctylbutyl phosphate, monophenyl-p-t-butylphenyl phosphate, etc.), citric acid esters (e.g., tributyl acetylcitrate, etc.), benzoic acid esters (e.g., octyl benzoate, etc.), alkylamides (e.g., diethyllaurylamide, dibutyllaurylamide, etc.), aliphatic acid esters (e.g., dibutoxyethyl succinate, diethyl azelate, etc.), trimesic acid esters (e.g., tributyl trimesate, etc.), compound having an epoxy ring (e.g., those described in U.S. Pat. No. 4,540,657), phenols (e.g.,

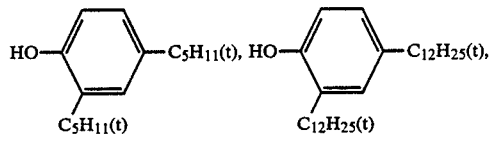

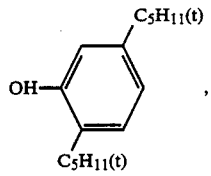

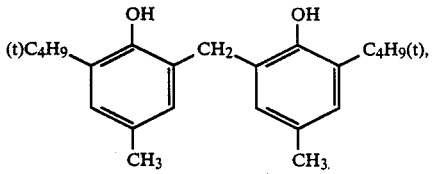

-continued

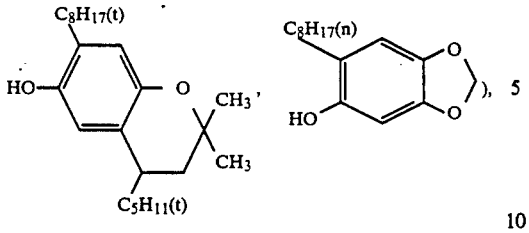

ethers (e.g., phenoxyethanol, diethylene glycol monophenyl ether, etc.), etc.

Also, a low-boiling solvent which is used as an auxiliary solvent in the case of incorporating the aforesaid compound of this isnvention into the color photographic material is an organic solvent having a boiling point of from about 30° C. to about 150° C. at atmospheric pressure and examples thereof are lower alkyl acetates (e.g., ethyl acetate, isopropyl acetate, butyl acetate, etc.), ethyl propionate, methanol, ethanol, secondary butyl alcohol, cyclohexanol, fluorinated alcohol, ethyl isobutyl ketone, β-ethoxyethyl acetate, methylcellusolve acetate acetone, methylacetone, acetonitrile, dioxane, dimethylformamide, dimethylsulfoxide, chloroform, cyclohexane, etc.

Furthermore, in palce of the high-boiling organic solvent, an oily solvent for additives such as coupler(s), etc. (including a solvent which is solvent which is solid at room temperature, such as wax, etc.) as well as a latex polymer can be used and further, the high-boiling organic solvent may be the additive itself. Additives such as a coupler, a color mixing preventing agent, an ultraviolet absorbent, etc., may be used as an oily solvent for dissolving the compound for use in this invention.

As the latex polymer as described above, there are latex polymers produced by using such monomers as acrylic acid, methacrylic acid, esters of these acids (e.g., methyl acrylate, ethyl acrylate, butyl methacrylate, etc.), acrylamide, methacrylamide, vinyl esters (e.g., vinyl acetate, vinyl propionate, etc.), acrylonitrile, styrene, divinylbenzene, vinyl alkyl ethers (e.g., vinyl ethyl ether, etc.), maleic acid esters (e.g., maleic acid methyl ester, etc.), N-vinyl-2-pyrrolidone, N-vinylpyridine, 2-vinylpyridine, and 4-vinylpyridine, singly or as a mixture of two or more.

In the case of dispersing the solution of the compound for use in this invention alone or together with coupler(s) in an aqueous solution of a hydrophilic protective colloid, a surface active agent is usually used and examples of the surface active agent are sodium alkylsulfosuccinate, sodium alkylbenzenesulfonate, etc.

The compound for use in this invention shown by formula (I) described above can be used in combination with a yellow coupler, a magenta coupler, or a cyan coupler. In these cases, it is particularly preferred, to achieve the effects of this invention, to use the compound in combination with a magenta coupler.

The coupler which is used in combination with the aforesaid compound may be 4-equivalent or 2-equivalent for silver ion, and also may be in the form of a polymer or an oligomer. Furthermore, the couplers which are used in combination with the aforesaid compounds of this invention may be used singly or as a mixture of two or more kinds thereof.

Couplers which can be preferably used in this invention are those represented by the following formulae (III) to (VII);

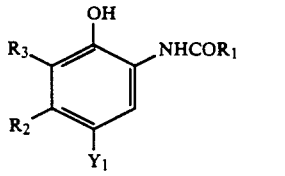

(III)

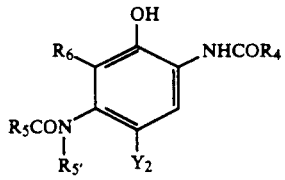

(IV)

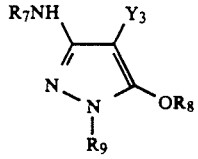

(V)

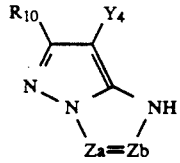

(VI)

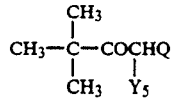

(VII)

wherein, $R_1$, $R_4$, and $R_5$ each represents an aliphatic group, an aromatic group, a heterocyclic group, an aromatic amino group or a heterocyclic amino group; $R_2$ represents an aliphatic group; $R_3$ and $R_6$ each represents a hydrogen atom, a halogen atom, an aliphatic group, an aliphatic oxy group, or an acylamino group; $R_5'$ represents a hydrogen group, or a group represented by $R_5$ shown above; $R_7$ and $R_9$ each represents a substituted or unsubstituted phenyl group; $R_8$ represents a hydrogen atom, an aliphatic acyl group, an aromatic acyl group, an aliphatic sulfonyl group, or an aromatic sulfonyl group; $R_{10}$ represents a hydrogen atom or a substituent, wherein examples of the substituent include an alkyl group (such as a methyl group, an ethyl group, a butyl group, etc.), a branched alkyl group (such as an isopropyl group, an isobutyl group, a t-butyl group, etc.), a substituted alkyl group (including a branched one), an alkoxy group (such as a methoxy group, an ethoxy group, a butoxy group, etc.), a substituted alkoxy group (such as an ethoxyethoxy group, a phenoxyethoxy group, etc.), an aryloxy group (such as a phenoxy group, etc.), and a ureido group, provided that a substituted or unsubstituted alkyl or aryloxy group are more preferred; Q represents a substituted or unsubstituted phenylcarbamoyl group such as an N-phenylcarbamoyl group; Za and Zb each represents a methine, a substitued methine, or =N—, wherein the substituents on the substituted methine may, for example, be a substituted or unsubstituted N-phenylalkyl, N-alkyl, N-phenoxyalkylthio, or N-phenylalkylthio group, etc., in which the further substitution may, for example, be with a substituted or unsubstituted phenylsulfonyl, etc.; and $Y_1$, $Y_2$, $Y_3$, $Y_4$, and $Y_5$ each represents a hydrogen atom, a halogen atom, or a group releasable upon a coupling reaction with the oxidation product of a color developing agent (hereinafter, the aforesaid group is referred to as a coupling off group).

In formulae (III) and (IV) described above, said $R_2$ and $R_3$ or said $R_5$ and $R_6$ may combine to form a 5-membered, 6-membered, or 7-membered ring. The aforesaid 5-membered, 6-membered, or 7-membered ring may be comprised of carbon atoms and/or hetero atoms and may be either substituted or unsubstituted. Such hetero atoms may, for example, be one or more nitrogen atoms.

Furthermore, the coupler shown by the aforesaid formula may form a dimer or higher polyner through said $R_1$, $R_2$, $R_3$ or $Y_1$; said $R_4$, $R_5$, $R_6$ or $Y_2$; said $R_7$, $R_8$, $R_9$ or $Y_3$; said $R_{10}$, Za, Zb or $Y_4$; or said Q or $Y_5$.

The aliphatic group described above is a straight chain, branched chain or cyclic alkyl, alkenyl, or alkynyl group.

Examples of the substituents for $R_{10}$, Za, and Zb, and examples of the case where the compound of formula (VII) forms a polymer are specifically described in U.S. Pat. No. 4,540,654 (column 2, line 41 to column 8, line 27).

Preferred examples of the cyan couplers represented by formulae (III) and (IV) are illustrated below.

(C-1)

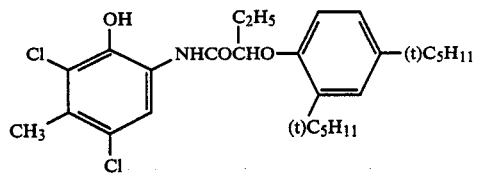

(C-2)

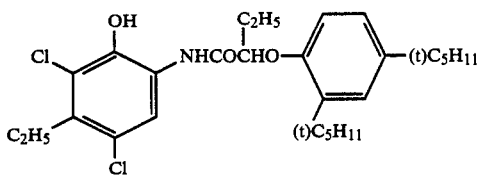

(C-3)

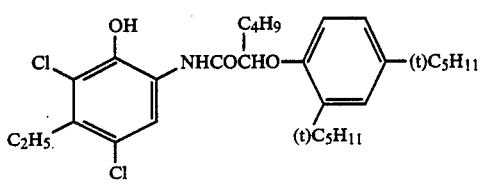

(C-4)

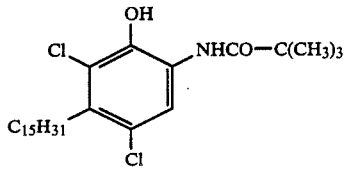

(C-5)

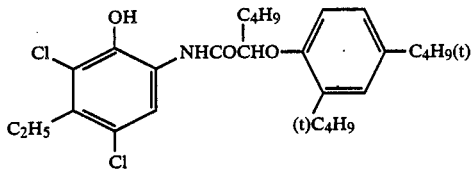

(C-6)

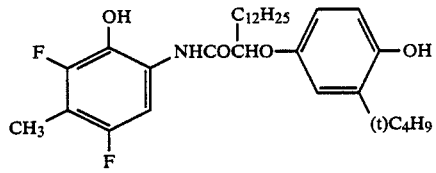

(C-7)

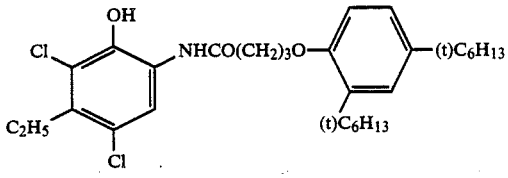

-continued
(C-8)
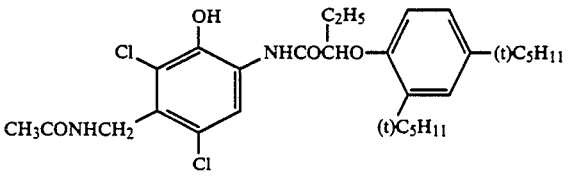
(C-9)
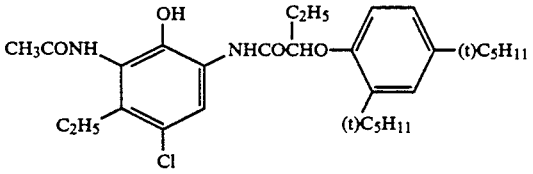
(C-10)
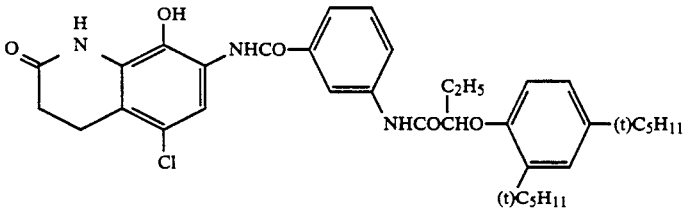
(C-11)
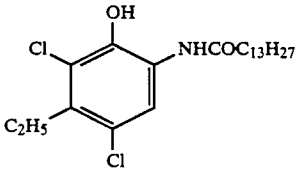
(C-12)
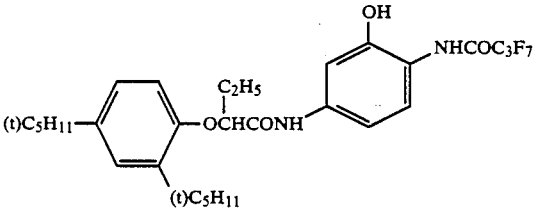
(C-13)
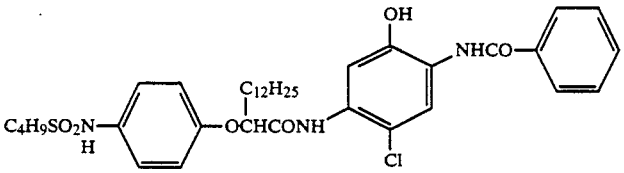
(C-14)
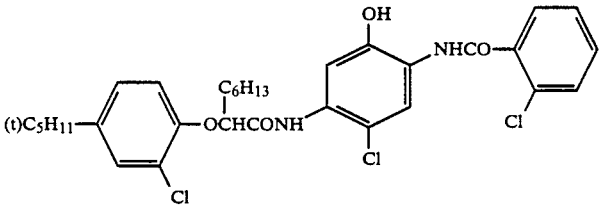
(C-15)
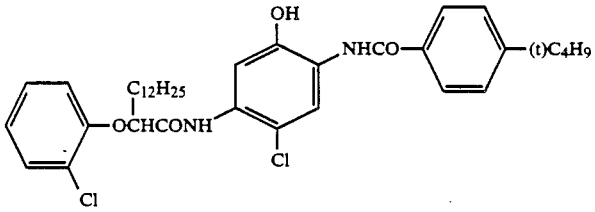

-continued
(C-16)
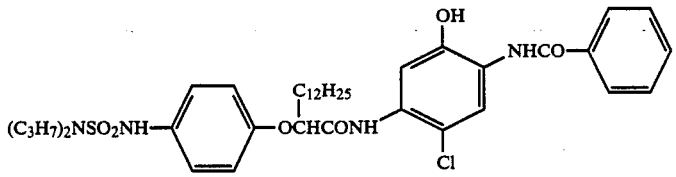
(C-17)
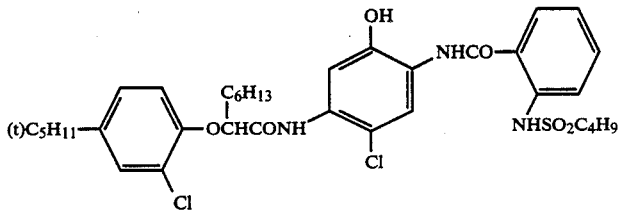
(C-18)
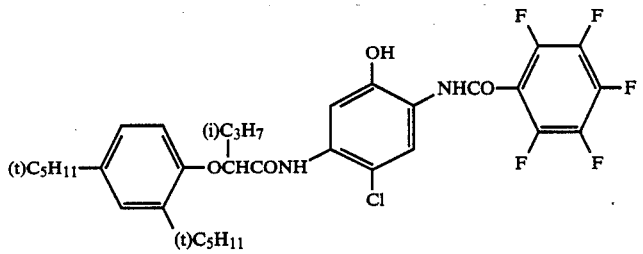
(C-19)
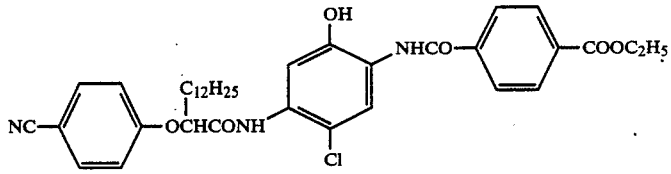
(C-20)
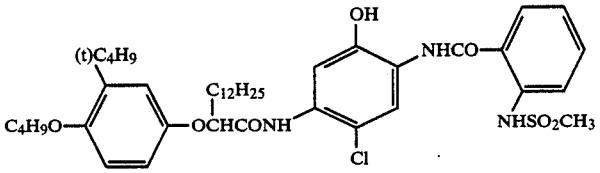
(C-21)
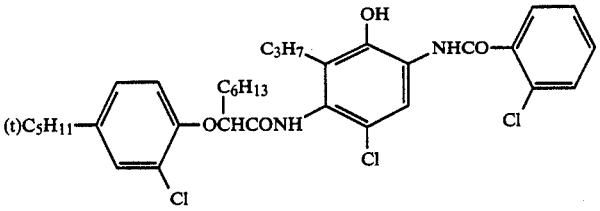
(C-22)
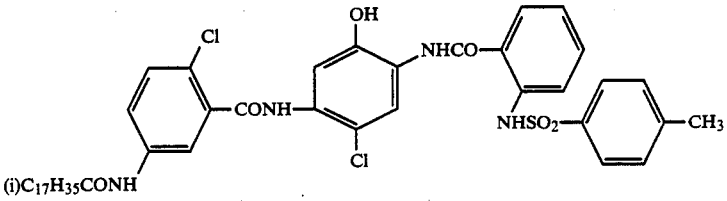

-continued (C-23)

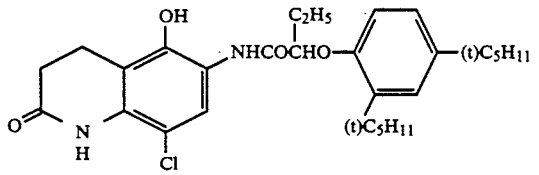

(C-24)

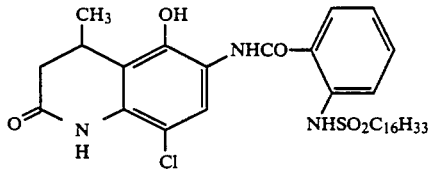

(C-25)

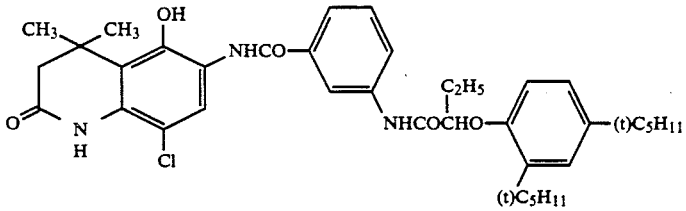

(C-26a)

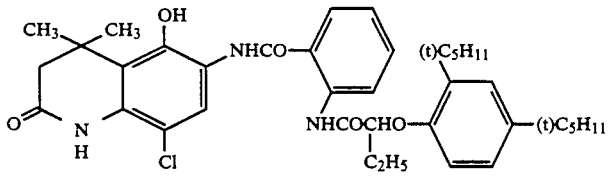

(C-26b)

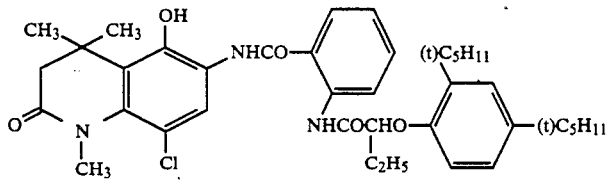

(C-27)

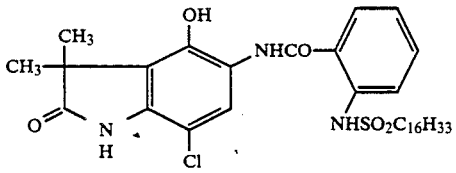

(C-28)

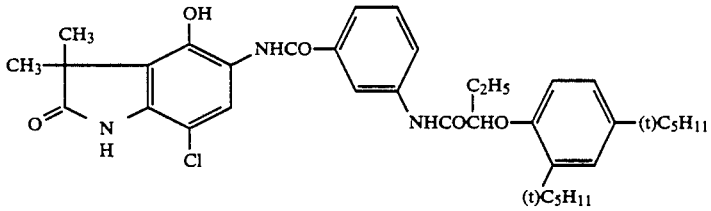

The above structural formulae with "x", "y", and "z" subscripts which represent the weight ratio of monomers are polymeric cyan couplers ((C-38) to (C-45)) in which the structural formulae do not necessarily represent the order in which the monomer units may be present. Those polymeric cyan couplers may be random or block copolymers.

Preferred examples of the magenta couplers represented by formulae (V), and (VI), described above are illustrated below.

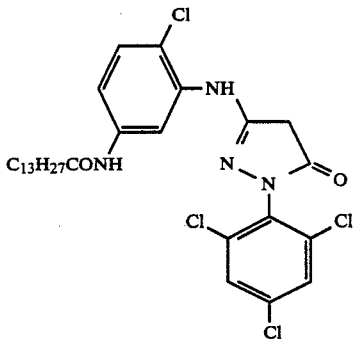
(M-1)
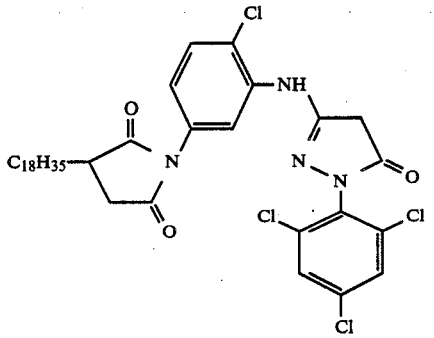
(M-2)
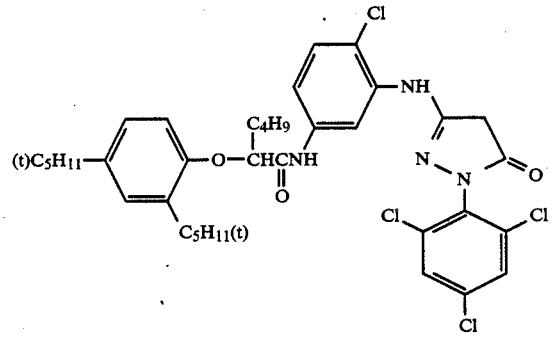
(M-3)
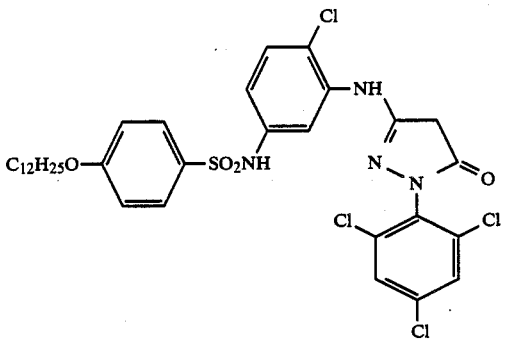
(M-4)

-continued
(M-5)
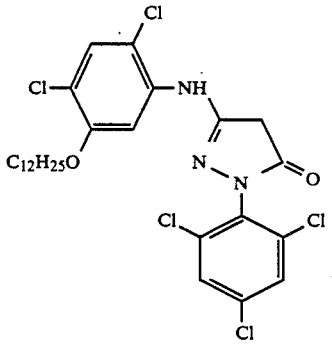
(M-6)
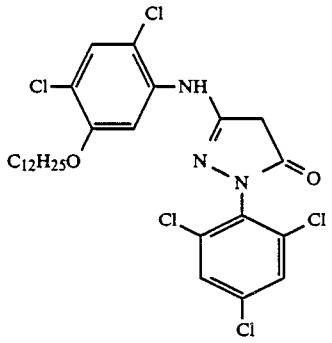
(M-7)
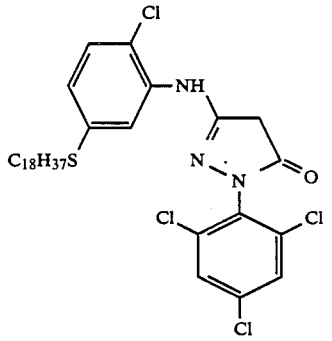
(M-8)
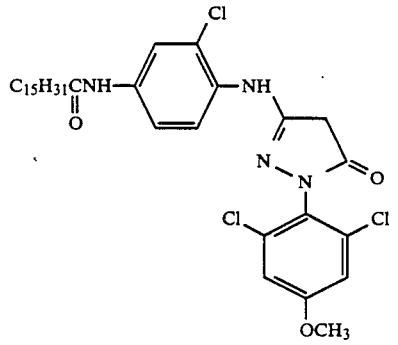
(M-9)
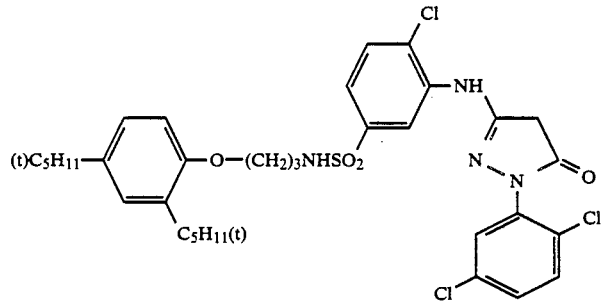

-continued
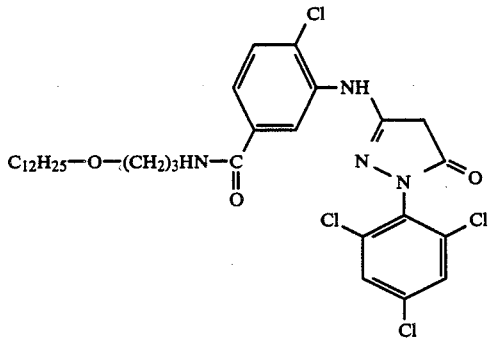
(M-10)
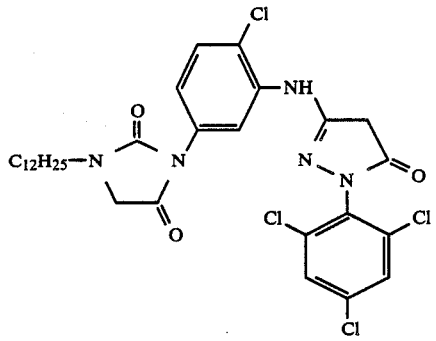
(M-11)
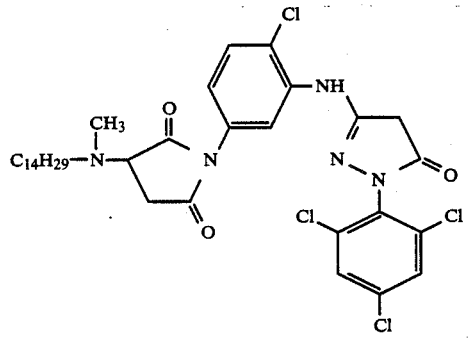
(M-12)
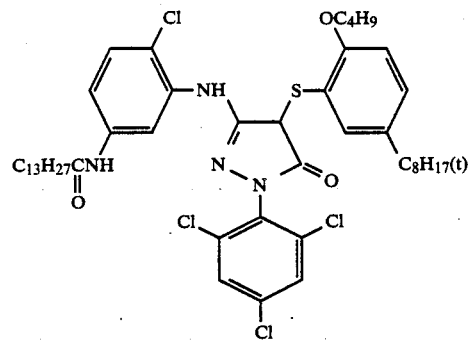
(M-13)

-continued
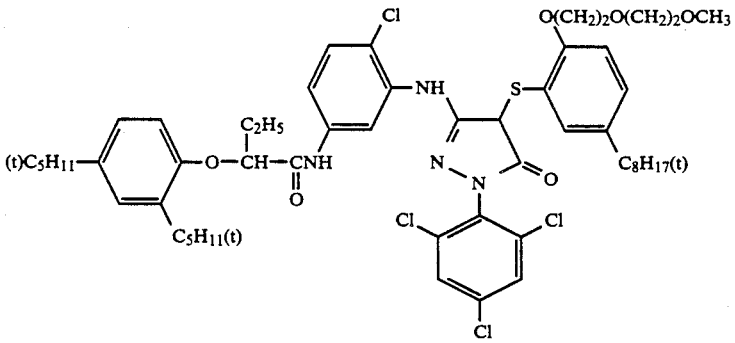
(M-14)
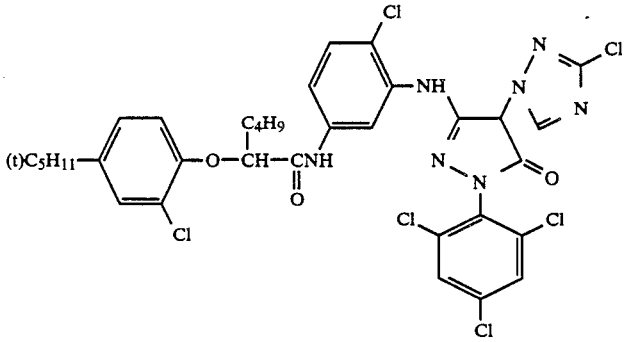
(M-15)
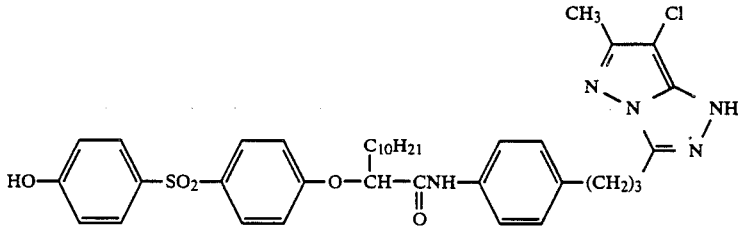
(M-16)
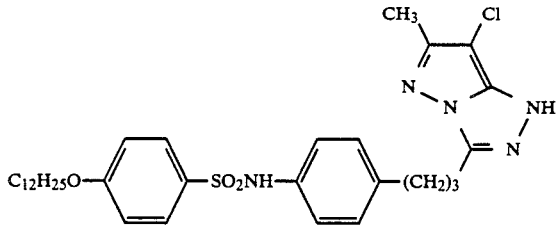
(M-17)
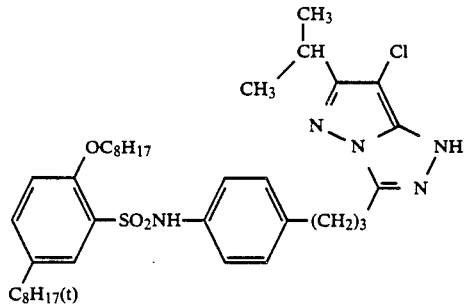
(M-18)

-continued
(M-19)
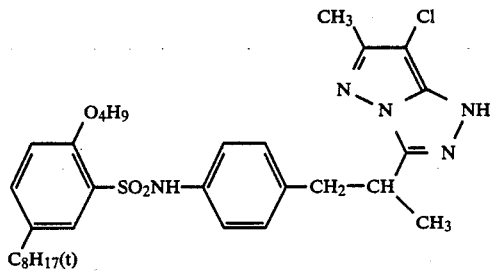
(M-20)
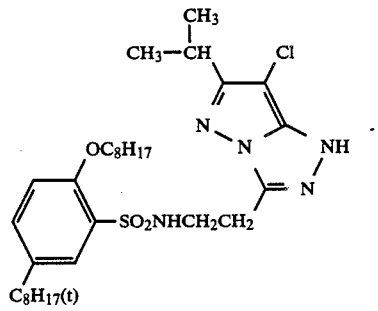
(M-21)
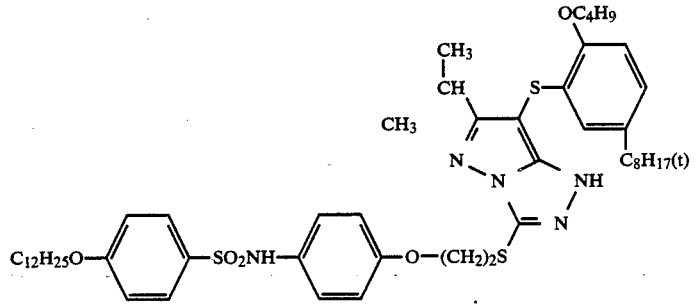
(M-22)
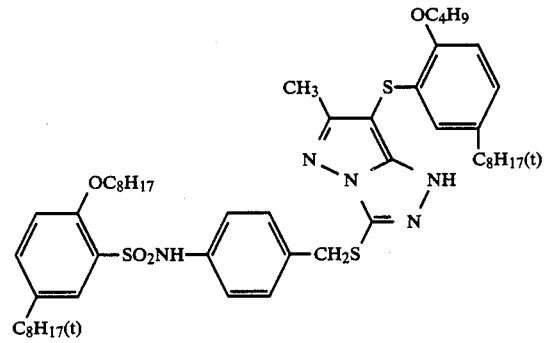
(M-23)
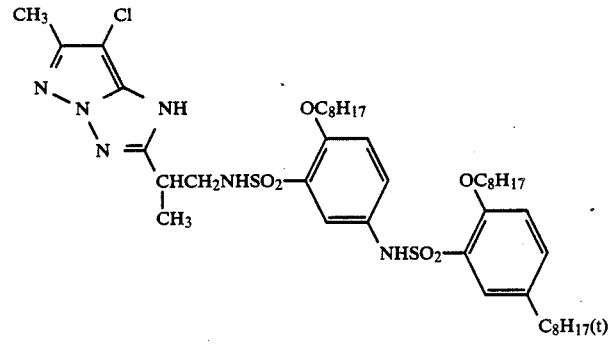

-continued
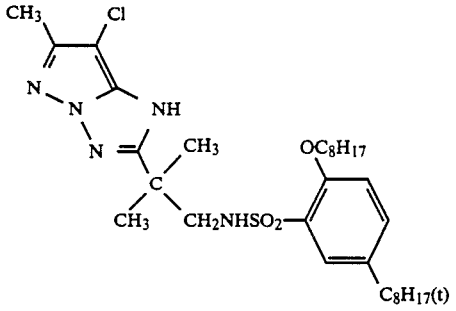
(M-24)
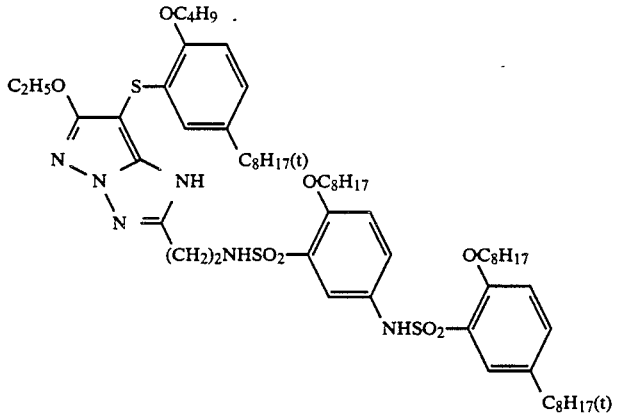
(M-25)
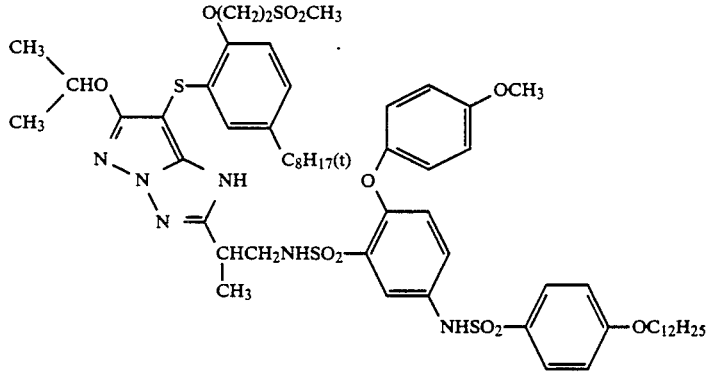
(M-26)
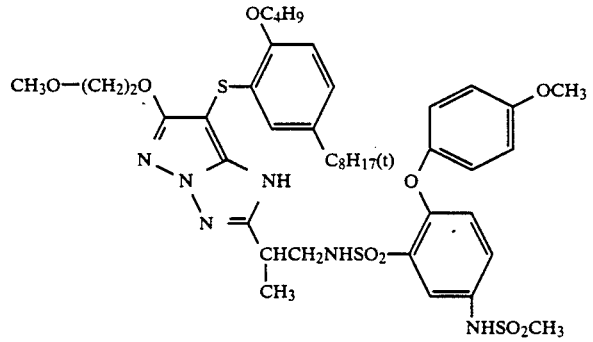
(M-27)

-continued
(M-28)
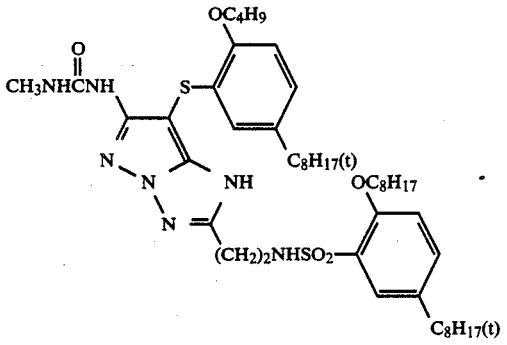
(M-29)
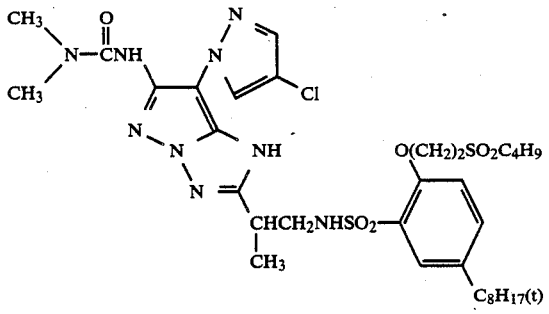
(M-30)
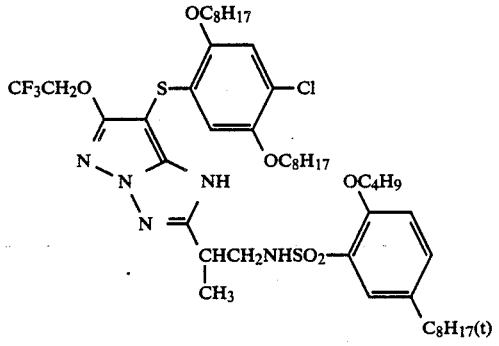
(M-31)
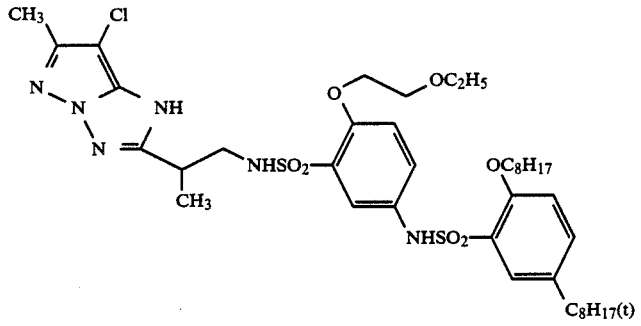
(M-32)
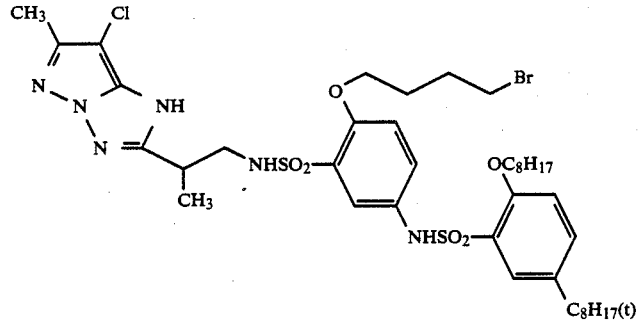

-continued
(M-33)
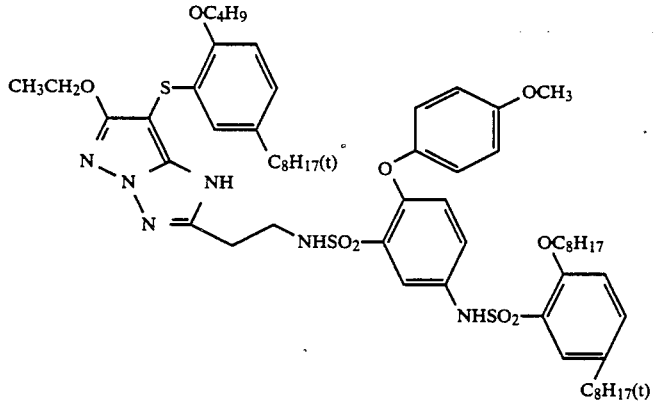
(M-34)
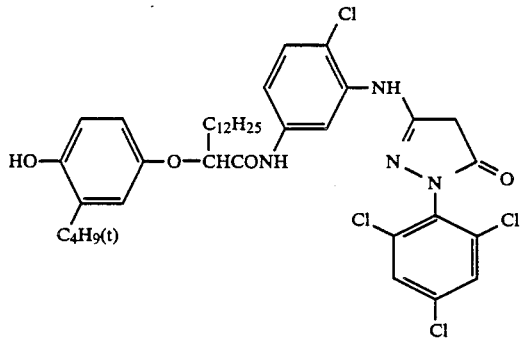
(M-35)
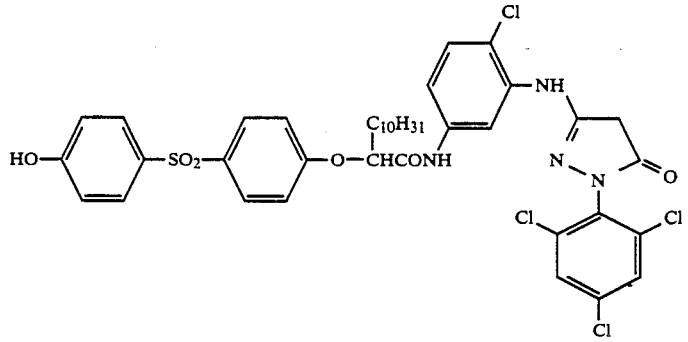
(M-36)
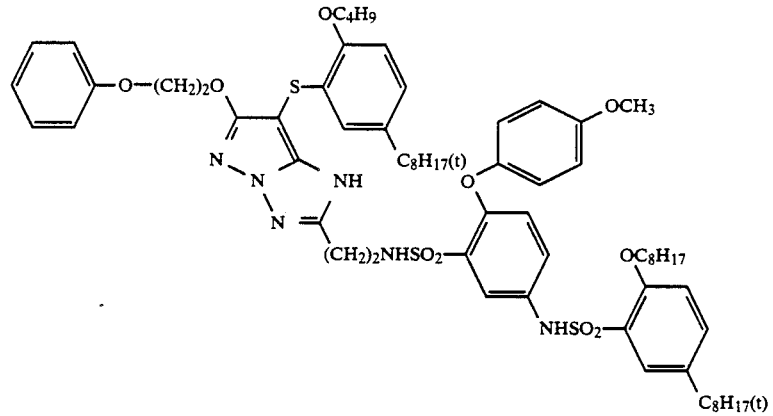

-continued
(M-37)
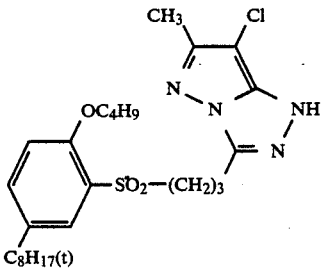
(M-38)
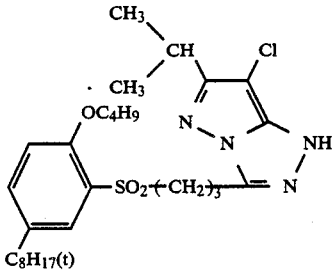
(M-39)
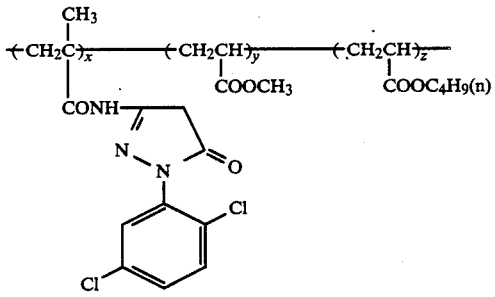
x/y/z = 50/25/25 (weight ratio)
(M-40)
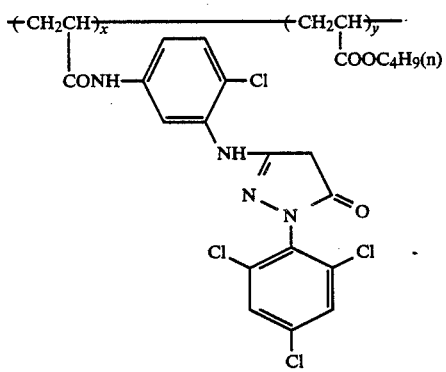
x/y = 50/50 (weight ratio)
(M-41)
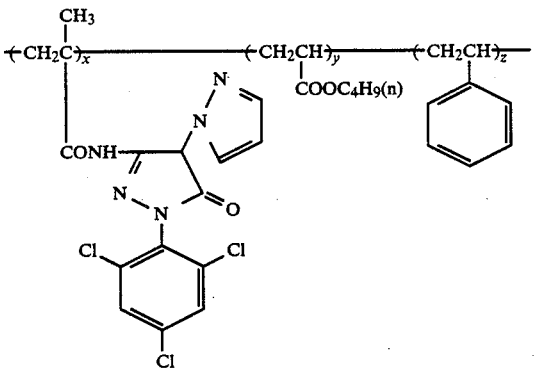
x/y/z = 50/25/25 (weight ratio)

-continued
(M-42)
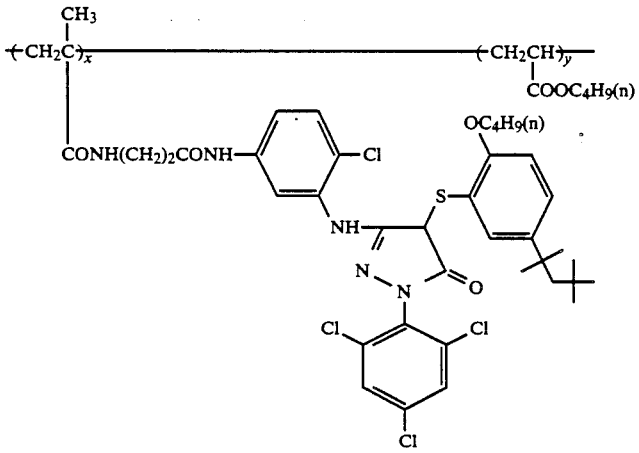
x/y = 50/50 (weight ratio)
(M-43)
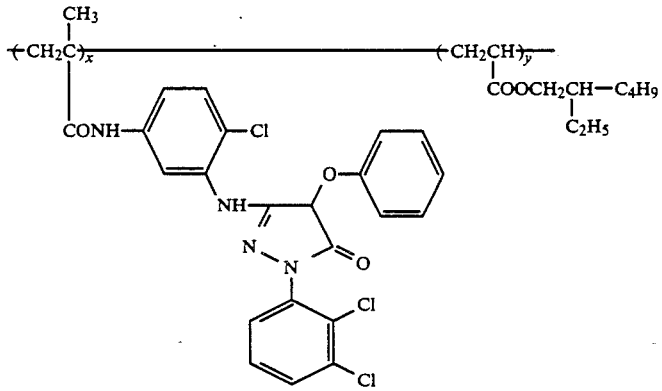
x/y = 40/60 (weight ratio)
(M-44)
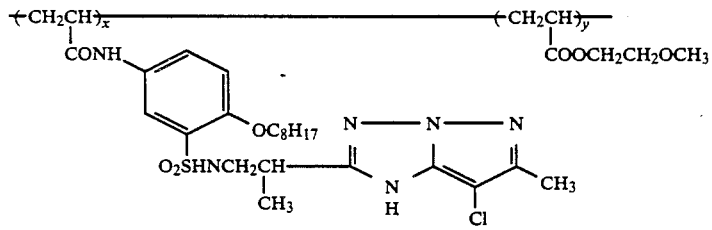
x/y = 45/55 (weight ratio)
(M-45)
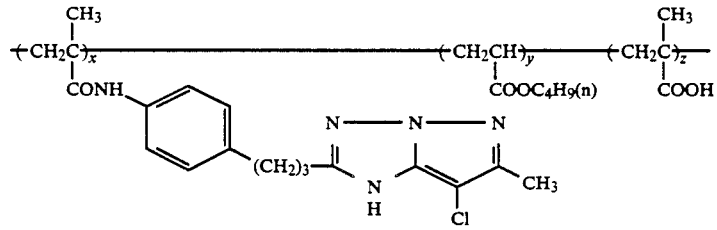
x/y/z = 50/45/5 (weight ratio)

-continued (M-46)

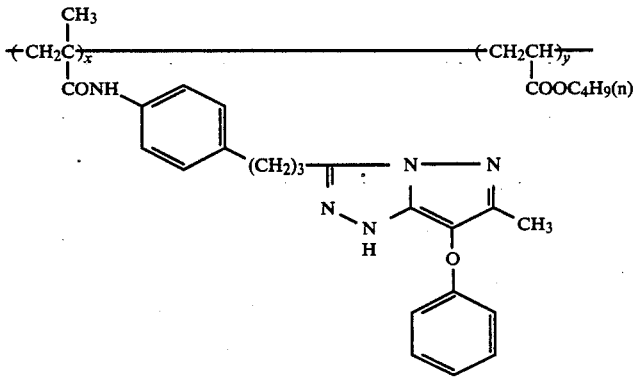

x/y = 50/50 (weight ratio)

(M-47)

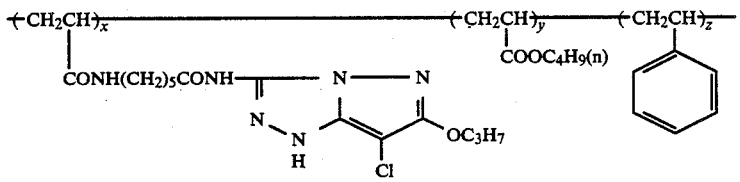

x/y/z =0 45/50/5 (weight ratio)

(M-48)

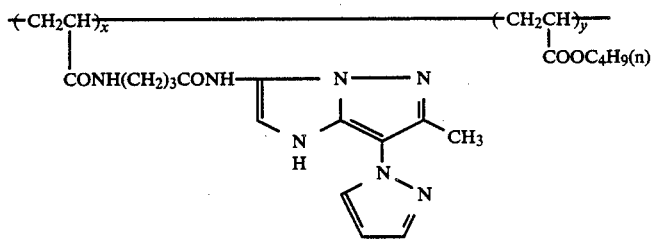

x/y = 50/50 (weight ratio)

(M-49)

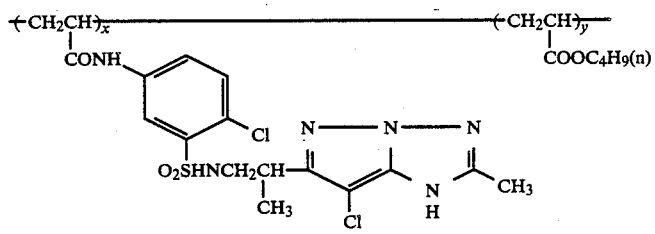

x/y = 50/50 (weight ratio)

(M-50)

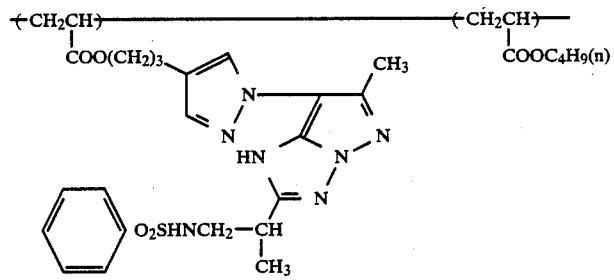

x/y = 45/55 (weight ratio)

As with the polymeric cyan couplers, in which the subscripts "x", "y", and "z" are present, the structural formulae of the above polymeric magenta couplers ((M-39) to (M-50)) do not necessarily represent the order in which the monomers may be present. The above polymeric magenta couplers may be random or block copolymers.

Preferred examples of the yellow couplers represented by formula (VII) are illustrated below.

(Y-1)
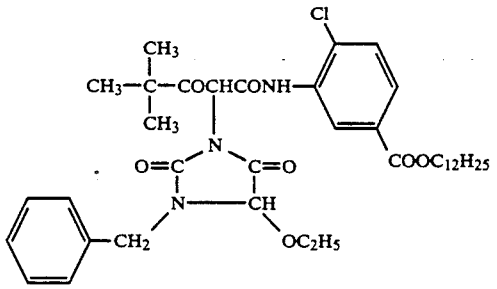
(Y-2)
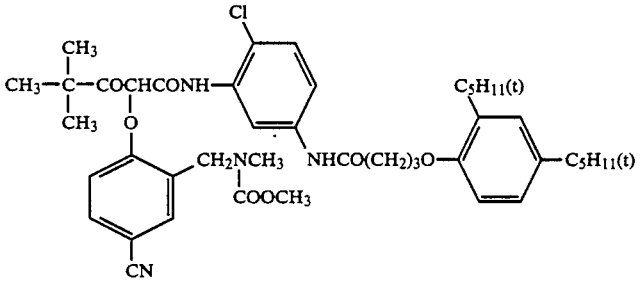
(Y-3)
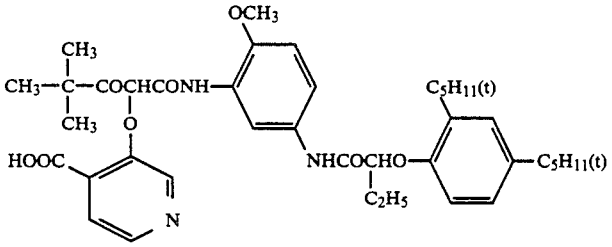
(Y-4)
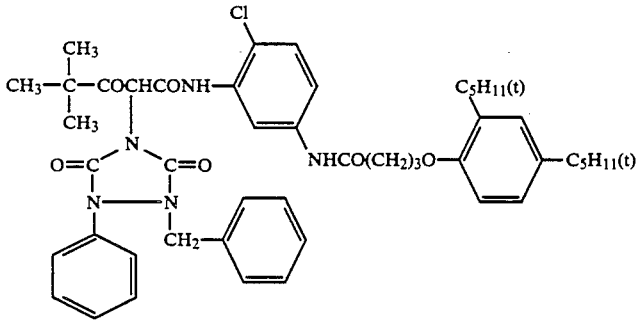
(Y-5)
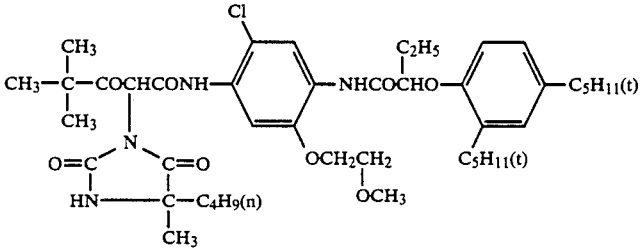
(Y-6)
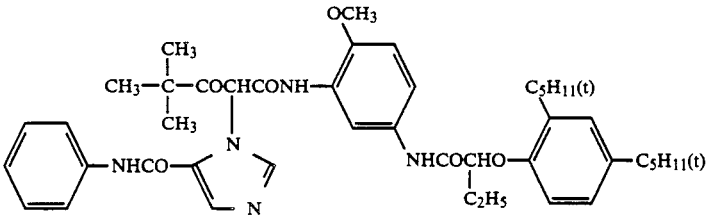

-continued
(Y-7)
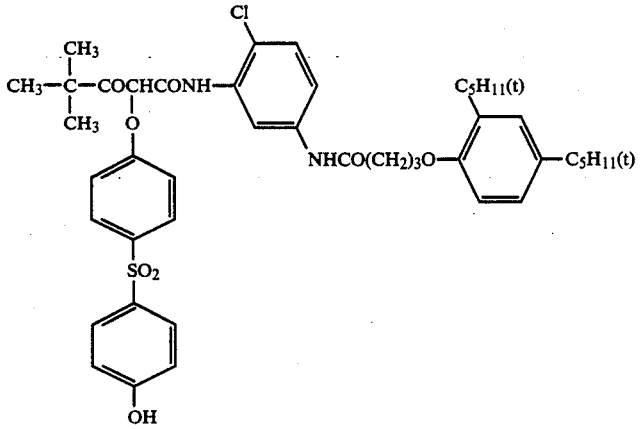
(Y-8)
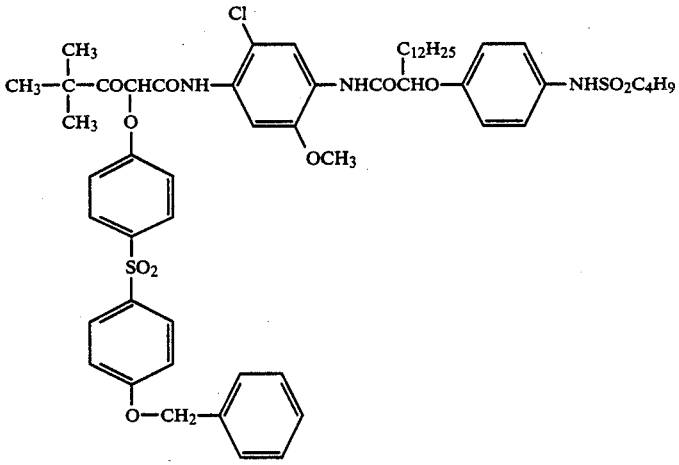
(Y-9)
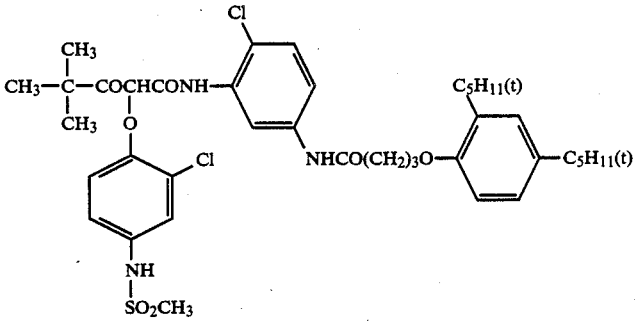
(Y-10)
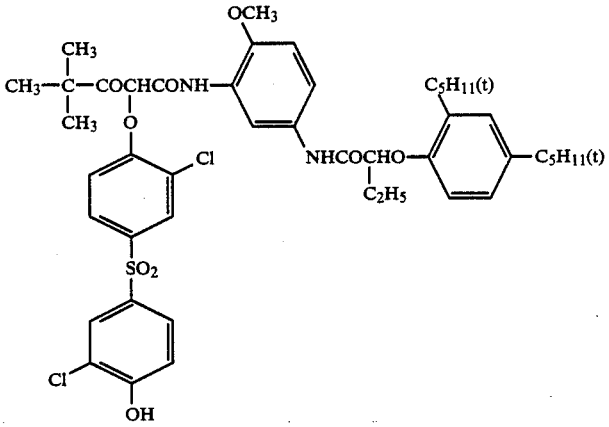

-continued
(Y-11)
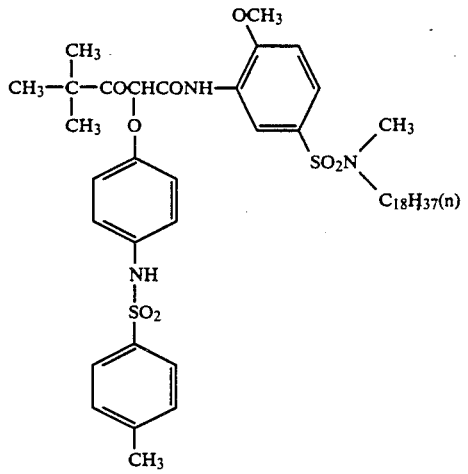
(Y-12)
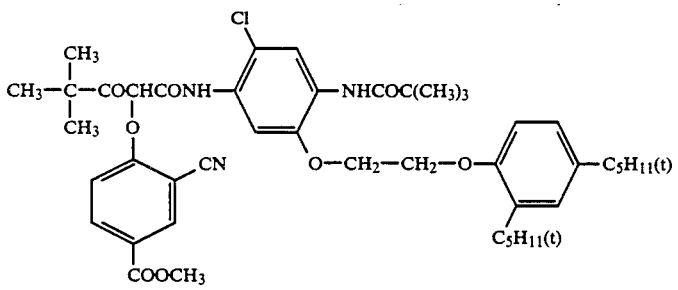
(Y-13)
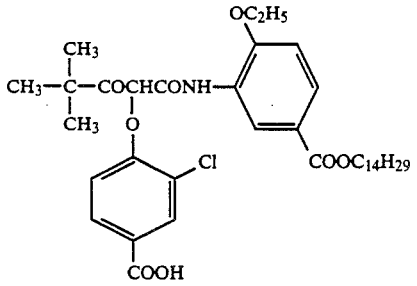
(Y-14)
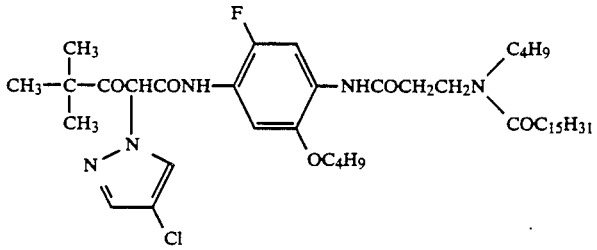
(Y-15)
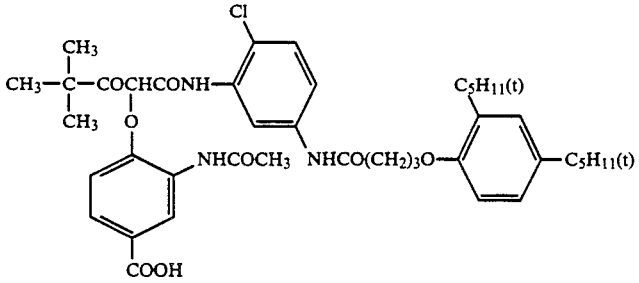

-continued
(Y-16)
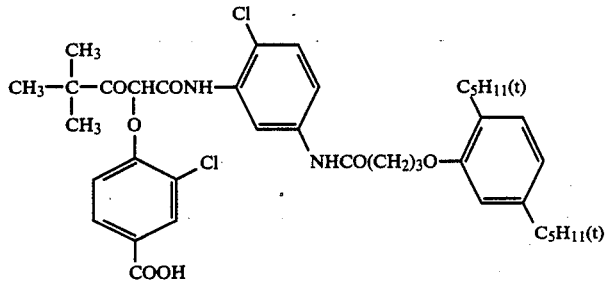
(Y-17)
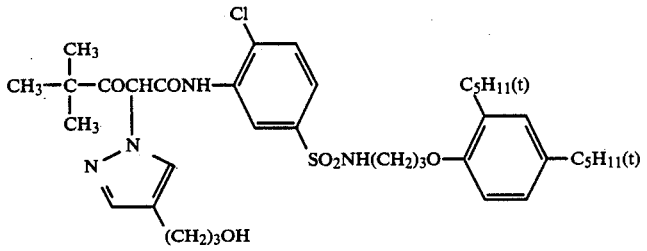
(Y-18)
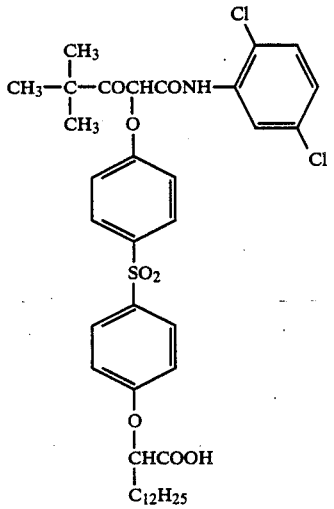
(Y-19)
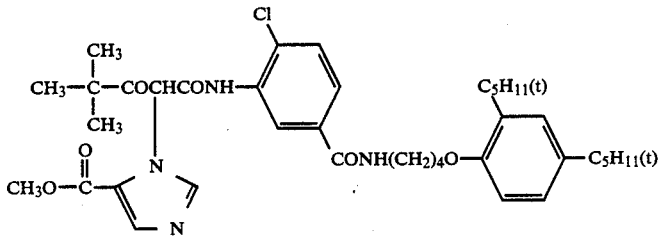
(Y-20)
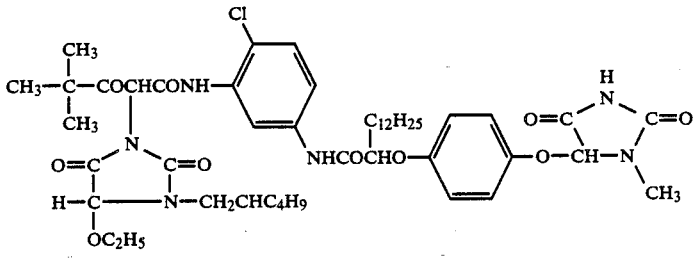

-continued
(Y-21)
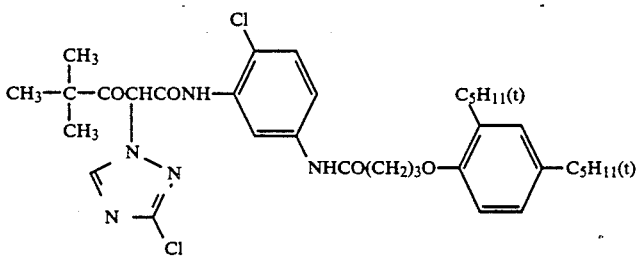
(Y-22)
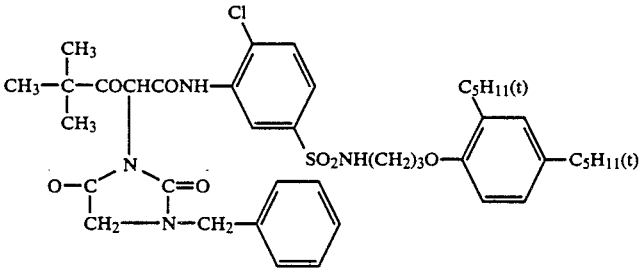
(Y-23)
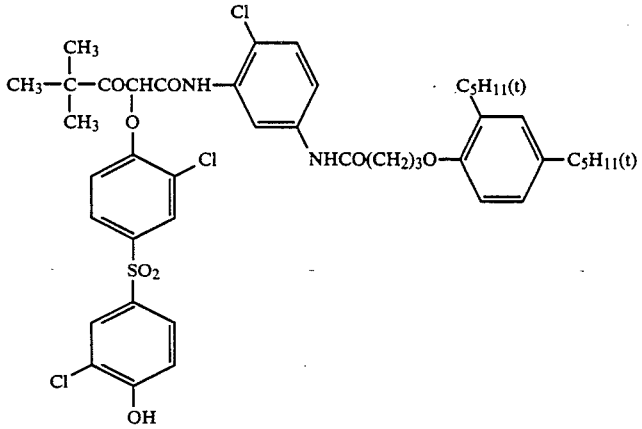
(Y-24)
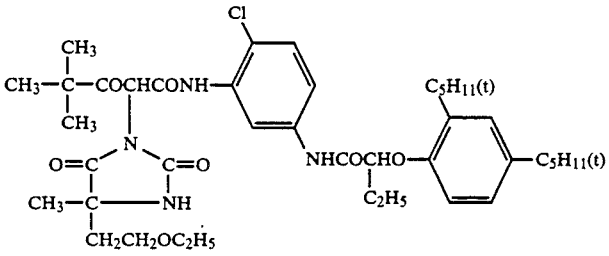
(Y-25)
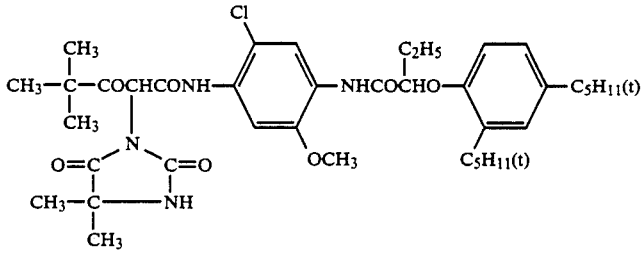

-continued
(Y-26)
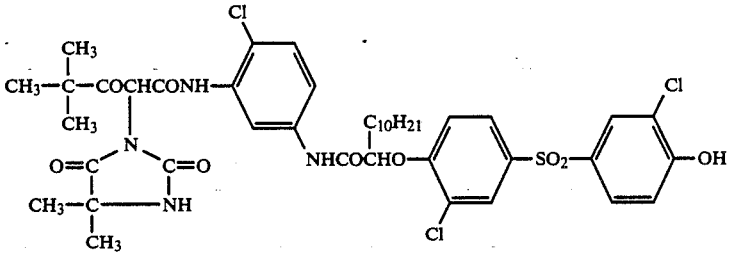
(Y-27)
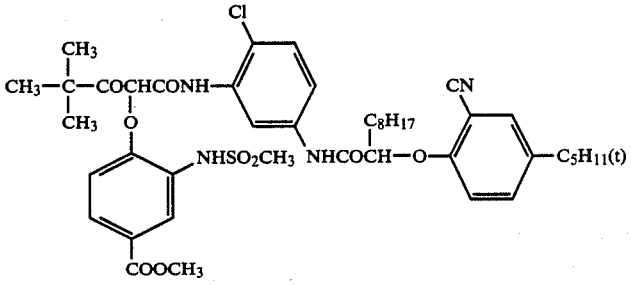
(Y-28)
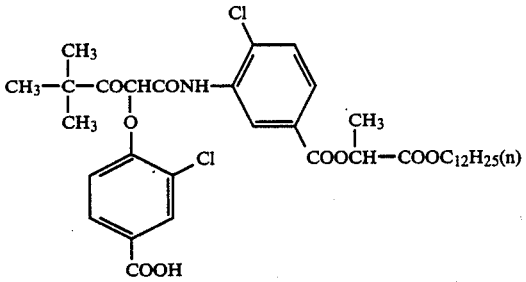
(Y-29)
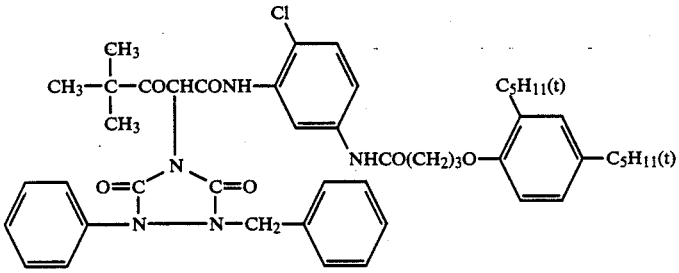
(Y-30)
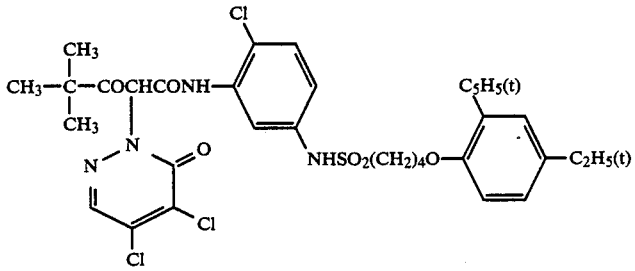
(Y-31)
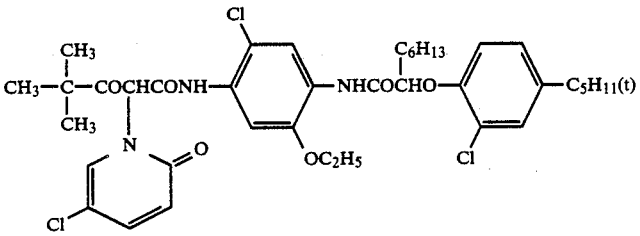

-continued
(Y-32)
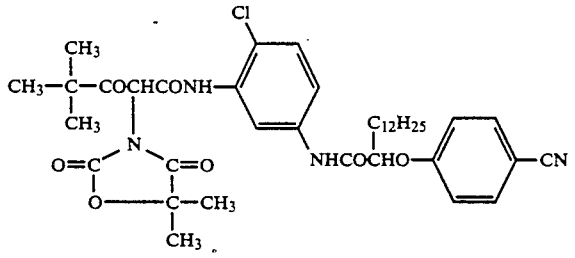
(Y-33)
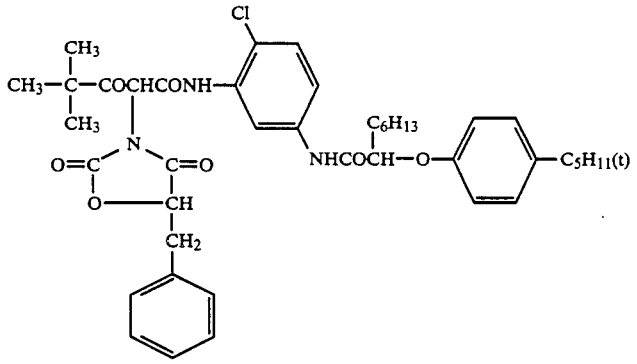
(Y-34)
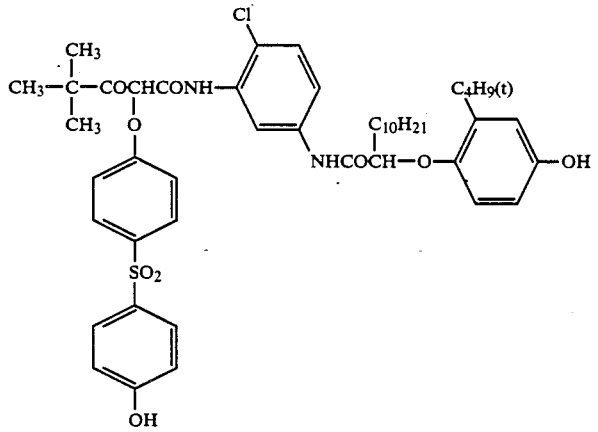
(Y-35)
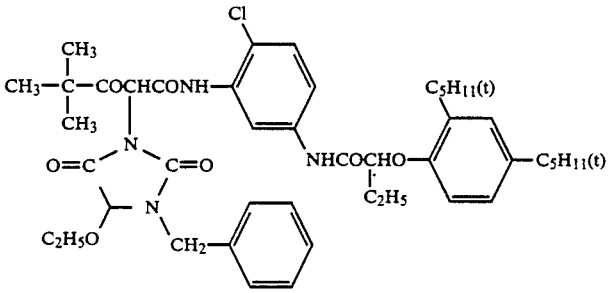
(Y-36)
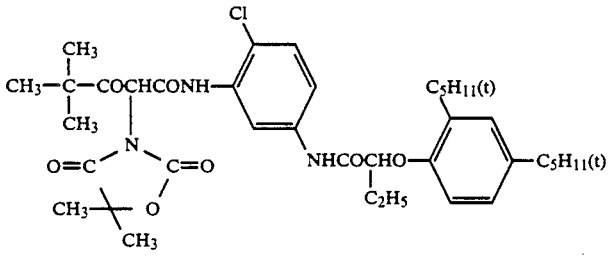

-continued
(Y-37)
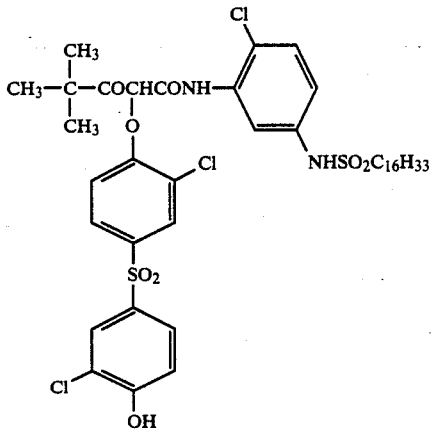
(Y-38)
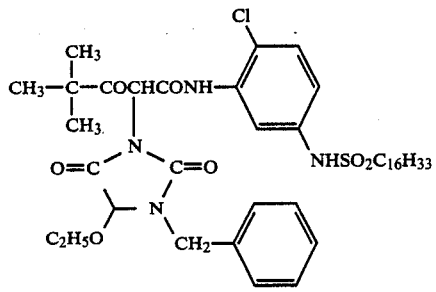
(Y-39)
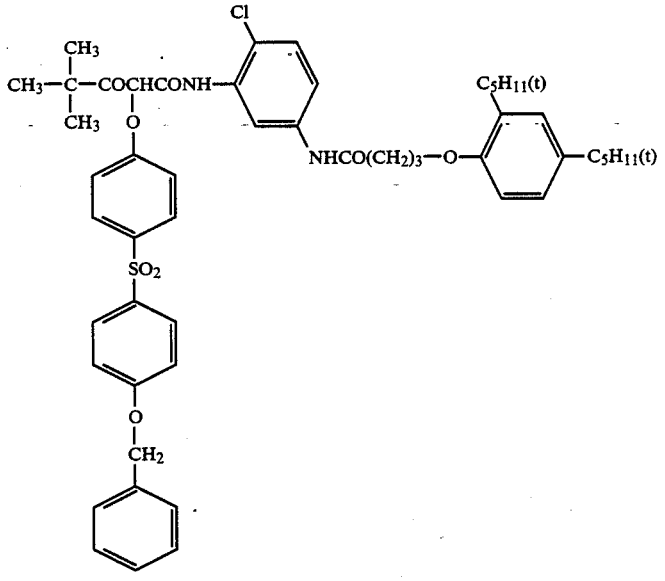
(Y-40)
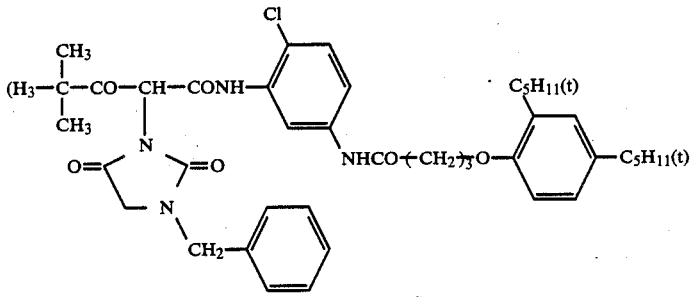

-continued
(Y-41)
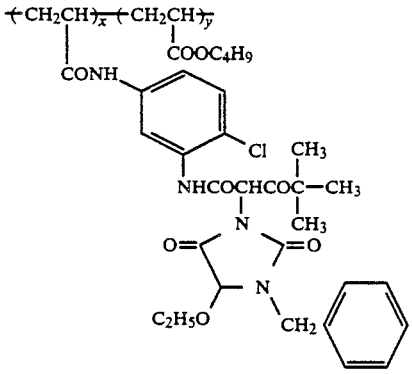
x/y = 50/50 (weight ratio)
(Y-42)
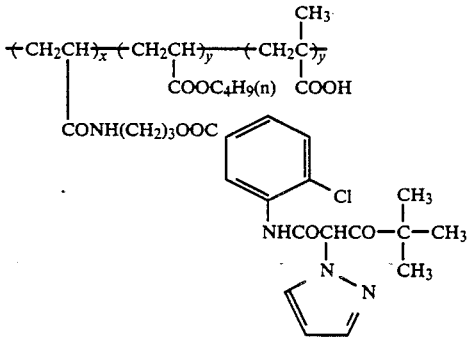
x/y/z = 50/45/5 (weight ratio)
(Y-43)
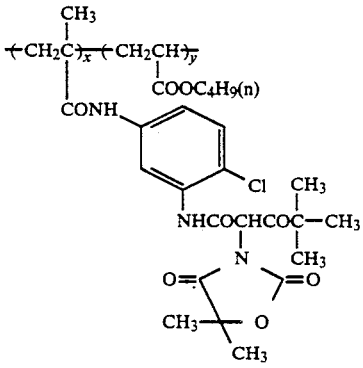
x/y = 50/50 (weight ratio)

-continued (Y-44)

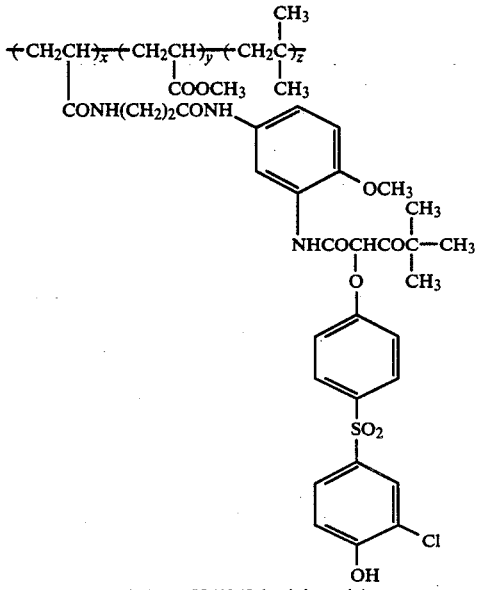

x/y/z = 55/40/5 (weight ratio)

(Y-45)

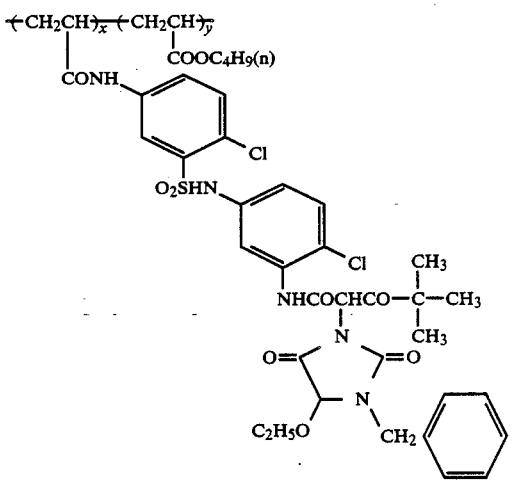

x/y = 60/40 (weight ratio)

As with the polymeric cyan couplers and polymeric magenta couplers in which "x", "y", and "z" are used as subscripts, the structural formulae of the above polymeric yellow couplers ((Y-41) to (Y-45)) do not necessarily represent the order in which the monomers may be present.

The couplers shown by formulae (III) to (VII) described above can be synthesized by the methods described in the literature shown below.

The cyan couplers shown by formulae (III) and (IV) can be synthesized by the following known methods. For example, the cyan couplers shown by formula (III) can be synthesized by the methods described in U.S. Pat. Nos. 2,423,730, 3,772,002, etc., and the cyan couplers shown by formula (IV) can be synthesized by the methods described in U.S. Pat. Nos. 2,895,826, 4,333,999, 4,327,173, etc.

The magenta coupler shown by formula (V) can be synthesized by the methods described in Japanese Patent Application (OPI) Nos. 74027/74, 74028/74, Japanese Patent Publication Nos. 27930/73, 33846/78, U.S. Pat. No. 3,519,429, etc. Also the magenta couplers shown by formula (VI) can be synthesized by the methods described in U.S. Pat. No. 3,725,067 and Japanese Patent Application (OPI) Nos. 162548/74, 171956/74, 33552/85, etc.

The yellow couplers shown by formula (VII) can be synthesized by the methods described in Japanese Patent Application (OPI) No. 48541/79, Japanese Patent Publication No. 10739/83, U.S. Pat. No. 4,326,024, *Research Disclosure,* RD No. 18053, etc.

Each of these couplers is generally incorporated in a silver halide emulsion layer in an amount of from $2\times10^{-3}$ to $5\times10^{-1}$ mol, and preferably from $1\times10^{-2}$ to $5\times10^{-1}$ mol per mol of silver in the layer.

The compound of formula (I) described above for use in this invention may be used together with a fading preventing agent and, as particularly preferred fading preventing agents, there are (i) aromatic compounds represented by formula (VIII) described below, (ii) amine compounds represented by formula (IX) described below, and (iii) metal complexes containing copper, cobalt, nickel, palladium, or platinum as the central metal and having at least one organic ligand having a bidentate or more conformation.

The above-mentioned formula (VIII) is represented by follows:

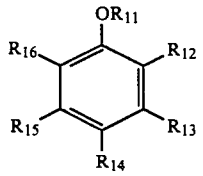

(VIII)

wherein $R_{11}$ represents a hydrogen atom, an alkyl group, an alkenyl group, an aryl group, a heterocyclic group, or

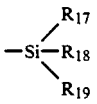

(wherein, $R_{17}$, $R_{18}$, and $R_{19}$, which may be the same or different, each represents an alkyl group, an alkenyl group, an aryl group, an alkoxy group, an alkenoxy group, or an aryloxy group); and $R_{12}$, $R_{13}$, $R_{14}$, $R_{15}$, and $R_{16}$, which may be the same or different, each represents a hydrogen atom, an alkyl group, an alkenyl group, an aryl group, an acrylamino group, an alkylamino group, an alkylthio group, an arylthio group, an alkoxycarbonyl group, an aryloxycarbonyl group, a halogen atom or —O—$R_{11}'$ (wherein, $R_{11}'$ has the same significance as $R_{11}$); said $R_{11}$ may combine with $R_{12}$, $R_{13}$, $R_{14}$, $R_{15}$, or $R_{16}$ to form a 5-membered ring, a 6-membered ring, or a spiro ring; and said $R_{12}$ and $R_{13}$ or said $R_{13}$ and $R_{14}$ may combine with each other to form a 5-membered ring, a 6-membered ring or a spiro ring.

The above-mentioned formula (IX) is represented as follows:

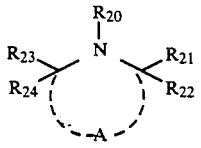

(IX)

wherein, $R_{20}$ represents a hydrogen atom, an alkyl group, an alkenyl group, an alkynyl group, an acyl group, a sulfonyl group, a sulfinyl group, an oxy radical group, or a hydroxy group; $R_{21}$, $R_{22}$, $R_{23}$, and $R_{24}$, which may be the same or different, each represents a hydrogen atom or an alkyl group; and A represents a non-metallic atomic group necessary for forming a 5-membered, 6-membered or 7-membered ring.

In the groups of formulae (VIII) and (IX) described above, the groups containing an aryl moiety or a hetero ring may be further substituted.

Specific examples of the compounds shown by formula (VIII) and (IX) described above are Compounds A-1 to A-60 described in the specification of Japanese Patent Application No. 233869/85 and the compounds described below.

A-61

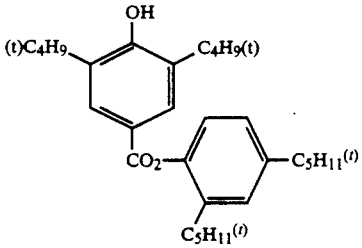

A-62

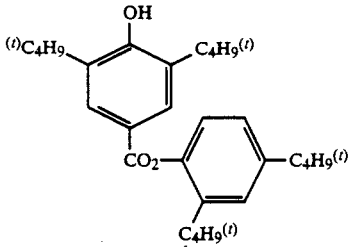

A-63

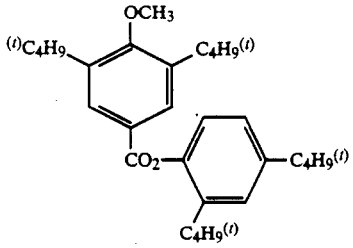

A-64

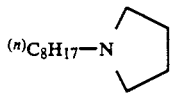

A-65

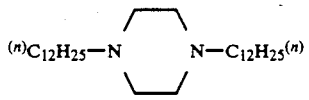

A-66

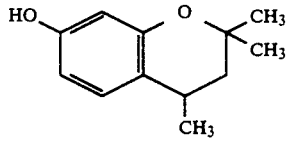

A-67

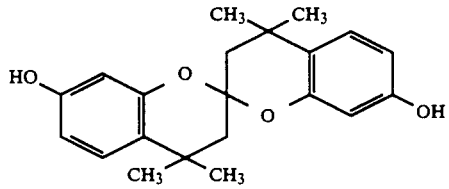

A-68

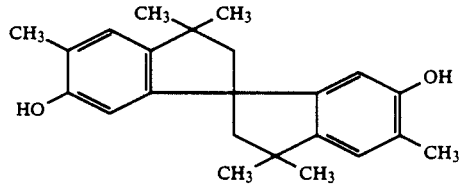

In addition to the above, a fading preventing agent (A-69) below is preferably used in the present invention.

A-69

$CH_2{=}CH_2OC_{14}H_{29}{}^{(n)}$

The compound shown by formula (VIII) or (IX) and the compound (A-69) described above is added to a photographic emulsion layer in an amount of from 10 mol% to 400 mol%, preferably from 30 mol% to 300 mol%, relative to the amount of coupler in the emulsion layer. On the other hand, the metal complex is added in an amount of from 1 mol% to 100 mol%, preferably from 3 mol% to 40 mol%, relative to the amount of coupler in the emulsion layer.

When the color photographic material which is processed by the process of this invention contains dye(s) and ultraviolet absorbent(s) in the hydrophilic colloid layer(s) thereof, these additives may be mordanted by a cationic polymer, etc.

The color photographic material may further contain a hydroquinone derivative, an aminophenol derivative, a gallic acid derivative, an ascorbic acid derivative, etc., as color fog preventing agents.

The color photographic material in this invention may contain ultraviolet absorbent(s) in the hydrophilic colloid layer as described above. Examples of the ultraviolet absorbent are aryl group-substituted benzotriazole compounds (e.g., those described in U.S. Pat. No. 3,533,794), 4-thiazolidone compounds (e.g., those described in U.S. Pat. No. 3,314,794, 3,352,681), benzophenone compounds (e.g., those described in Japanese Patent Application (OPI) No. 2784/71), cinnamic acid ester compounds (e.g., those described in U.S. Pat. Nos. 3,705,805, 3,707,375), butadiene compounds (e.g., those described in U.S. Pat. No. 4,045,229), and benzoxidole compounds (e.g., those described in U.S. Pat. No. 3,700,455). Furthermore, ultraviolet absorptive couplers (e.g., α-naphtholic cyan dye-forming couplers) or ultraviolet absorptive polymers may be used as ultraviolet absorbents. These ultraviolet absorbents may be mordanted and added to specific layers.

The color photographic materials for use in this invention may contain water-soluble dyes as filter dyes or for irradiation prevention or other various purposes in the hydrophilic colloid layers. Examples of such water-soluble dyes are oxonol dyes, hemioxonol dyes, styryl dyes, merocyanine dyes, cyanine dyes, and azo dyes. In these dyes, oxonol dyes, hemioxonol dyes, and merocyanine dyes are useful.

As the binder or protective colloids which can be used for the emulsion layers of the color photographic material for use in this invention, gelatin is advantageously used but other hydrophilic colloids can be used alone or together with gelatin.

As gelatin, limed gelatin or acid-treated gelatin can be used in this invention. Details of the production of gelatin are described in Arther Weiss, *The Macromolecular Chemistry of Gelatin,* published by Academic Press, 1964.

For the silver halide emulsion layers of the color photographic materials for use in this invention, silver bromide, silver iodobromide, silver iodochlorobromide, silver chlorobromide, or silver chloride is used as the silver halide.

There is no particular restriction on the mean grain size (represented by the diameter of the grains when the grain is spherical or similar to spherical, and represented by the mean value based on the projected area using, in the case of cubic grains, the long side length as the grain size) of the silver halide grains in the photographic emulsions but it is preferred that the grain size be smaller than about 2 μm.

The grain size distribution may be narrow or broad, but a monodispersed silver halide emulsion having a coefficient of variation less than 15% is preferred.

The silver halide grains in the photographic emulsion layers may have a regular crystal form such as cubic, octahedral, etc., or an irregular crystal form such as ring, tabular, etc., or may have a composite form of these crystal forms. In these emulsions, the use of a photographic emulsion of regular crystal form is preferred.

Also, a silver halide emulsion wherein tabular silver halide grains having an aspect ratio (length/thickness) of at least 5 accounts for at least 50% of the total projected area of the silver halide grains may be used in this invention.

The silver halide grains for use in this invention may have a composition of structure inside the grain which is different from that on the surface layer thereof. Also, the silver halide grains may be of the type that latent images are formed mainly on the surface thereof or of the type that latent images are formed mainly in the inside thereof.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

Silver halide emulsions are usually chemically sensitized.

The silver halide emulsions for use in this invention can further contain various kinds of compounds for preventing the occurrence of fog during the production, sotrage and/or processing of color photographic materials or for stabilizing photographic performance. Examples of such compounds include the compound known as antifoggants or stabilizers such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), mercaptopyrimidines, mercaptotriazines, etc.; thioketo compounds such as oxazolinethione, etc.; azaindenes (e.g., triazaindenes, tetraazaindenes, in particular, 4-hydroxy-substituted (1,3,3a,7)tetraazaindene), pentaazaindenes, etc.; benzenethiosulfonic acid, benzenesulfinic acid, benzenesulfonic acid amide, etc.

The present invention can be applied to a multilayer multicolor photographic materials having at least two photographic emulsion layers each having different spectral sensitivity on a support. A multilayer natural color photographic material usually has at least one red-sensitive emulsion layer, at least one green-sensitive emulsion layer and at least one blue-sensitive emulsion layer on a support. The disposition order of these photographic emulsion layers can be optionally selected according to the purpose for which the photographic material is used. Usually, a red-sensitive emulsion layer contain a cyan-forming coupler, a green-sensitive emulsion layer contains a magenta-forming coupler, and a blue-sensitive emulsion layer contains a yellow-forming coupler.

As the support for use in this invention, there are, for example, cellulose nitrate films, cellulose acetate films, cellulose acetate butyrate films, cellulose acetate propionate films, polystyrene films, polyethylene terephthalate films, polycarbonate films, laminates of these films, thin glass films, papers, etc. Paper coated with baryta or an α-olefin polymer, in particular, a polymer of an α-olefin having 2 to 10 carbon atoms, such as polyethylene, polypropylene, ethylene-butene copolymer, etc., and a support such as a plastic film, etc., having a roughened surface or improving the adhesion with other polymers as described in Japanese Patent Publication No. 19068/72 give good results. Also, a resin hardenable by the irradiation of ultraviolet rays can be used.

According to the purpose of the color photographic material, a transparent support or an opaque support may be used. Also, a colored transparent support containing dyes or pigments can also be used.

As an opaque support for use in this invention, there are papers which are opaque by themselves and transparent films which were opacified by the incorporation of dyes or pigments such as titanium oxide, etc. Also, a plastic film surface-treated by the method described in Japanese Patent Publication No. 19068/72 and further papers or plastic films rendered completely light shielding by the addition of carbon black, dyes, etc., can be used.

A subbing layer is usually formed on a support. Furthermore, for improving the adhesive property, a pretreatment such as corona discharging treatment, ultraviolet treatment, flame treatment, etc., may be applied to the surface of the support.

As a color photographic light-sensitive material which can be used for making the color photograph of this invention, an ordinary color photographic light-sensitive material, in particular, a color photographic light-sensitive material for color prints is preferred, and color photographic light-sensitive materials of color photographic systems (in particular, color diffusion transfer photographic systems) described in U.S. Pat. Nos. 3,227,550, 3,227,551, 3,227,552, and U.S. Temporary Published Patent B351,673, etc. may be used.

For obtaining dye images by a conventional photographic process, it is necessary to apply color photographic processing after imagewise exposure. Color photographic processing fundamentally includes the steps of color development, bleach and fix. In this case, two steps of bleach and fix may be performed by one step (bleach-fix or blix).

Furthermore, a combination of color development, first fix, and blix can be employed in this invention. The color photographic process may include, if necessary, various steps of pre-hardening, neutralization, first development (black and white development), image stabilization, wash, etc. The processing temperature is generally 18° C. or more, and preferably in the range from 20° C. to 60° C. In particular, recently the range of from 30° C. to 60° C. is used.

A color developer is an aqueous alkaline solution containing an aromatic primary amino color developing agent having a pH of at least 8, preferably from 9 to 12.

After the fix of blix step, the "wash process" is usually performed, but a simple so-called "stabilization process" may be substituted in place of the wash process substantially without employing a wash step.

Preferred examples of the aromatic primary amino color developing agent are p-phenylenediamine derivatives and specific examples thereof are shown below, although the invention is not limited to them.

D-1 N,N-Diethyl-p-phenylenediamine
D-2 2-Amino-5-diethylaminotoluene
D-3 2-Amino-5-(N-ethyl-N-laurylamino)toluene
D-4 4-(N-Ethyl-N-(β-hydroxyethyl)amino)aniline
D-5 2-Methyl-4-[4-N-ethyl-N-(β-hydroxyethyl-)amino]aniline
D-6 N-Ethyl-N-(β-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-β-ethoxyethylaniline
D-11 4-Amino-3-methyl-N-ethyl-N-β-butoxyethylaniline Also, these p-phenylenediamine derivatives may be in the form of salts thereof, such as sulfates, hydrochlorides, sulfites, p-toluenesulfonates, etc. The aforesaid compounds are described in U.S. Pat. Nos. 2,193,015, 2,552,241, 2,566,271, 2,592,364, 3,656,950, 3,698,525, etc. The amount of the aromatic primary amine color developing agent is from about 0.1 g to about 20 g, and preferably from about 0.5 g to about 10 g per liter of color developer.

The processing temperature of the color developer is preferably from 30° C. to 50° C., and more preferably from 33° C. to 42° C. Also, the amount of a replenisher for the color developer is from 30 ml to 2,000 ml, and preferably from 30 ml to 1,500 ml per square meter of color photographic material. The amount of the replenisher is, however, preferably as low as possible from the viewpoint of reducing the amount of waste liquid.

Also, when benzyl alcohol exists in the color developer, the amount thereof is preferably less than 2.0 ml/liter, and more preferably less than 0.5 ml/liter. A color developer containing no benzyl alcohol is most preferred. The time for color development is preferably within 2 minutes and 30 seconds, more preferably from 10 seconds to 2 minutes and 30 seconds, and most preferably from 45 seconds to 2 minutes.

The following examples are intended to illustrate the present invention but not to limit it in any way. Unless otherwise indicated herein, all parts, percents, ratios and the like are by weight.

EXAMPLE 1

After dissolving in 20 ml of tricresyl phosphate and 20 ml of ethyl acetate 5 g of a dye (hereinafter, is referred to dye (C-1) obtained by an oxidative coupling reaction of cyan coupler (C-1) and 4-amino-3-methyl-N-ethyl-N-β-(methanesulfonamido)ethylaniline, the solution was dispersed by emulsification in 80 g of an aqueous gelatin solution containing 8 ml of an aqueous solution of 1% sodium dodecylbenzenesulfonate.

Then, sodium dodecylbenzenesulfonate was added to the emulsified dispersion as a coating aid and the dispersion was coated on a paper support, both surfaces of which had been coated with polyethylene.

The coated amount of the dye was selected so that the density value of 1.0 was obtained by Macbeth densitometer RD-514 type (Status AA Filter).

Then, a gelatin protective layer (gelatin present in an amount of 1 g/m$^2$) was formed on the aforesaid layer to provide Sample A. In the same manner as above using the combinations shown in Table 1 below, Samples A-1 to A-13 were also prepared. Each sample thus prepared was stored in the dark at room temperature for 2 months. Then, for determining light fastness of the samples, each sample was subjected to a fading test for 500 hours by means of a xenon tester (100,000 lux) using an ultraviolet absorption filter to filter out light of wavelengths shorter than 400 nm (made by Fuji Photo Film Co., Ltd.) and then the dye residual percentage was measured. The results obtained are shown in Table 1.

TABLE 1

| Sample | Dye | Ethylaniline* Amount (mol % relative to dye) | Additive (amount, mol % relative to dye) | Dye residual percentage |
|---|---|---|---|---|
| A | C-1 | — | — | 56% |
| A-1 | " | 20 | — | 40% |
| A-2 | " | " | (I-1) 50 | 56% |
| A-3 | C-14 | — | — | 34% |
| A-4 | " | 20 | — | 23% |
| A-5 | " | " | (I-7) 50 | 36% |
| A-6 | " | " | Comparison Compound A 50 | 25% |
| A-7 | " | " | Compound B 50 | 26% |
| A-8 | " | " | Compound C 50 | 19% |
| A-9 | " | " | (I-23) 50 | 38% |
| A-10 | " | " | (I-24) 50 | 38% |
| A-11 | " | " | (I-25) 50 | 36% |
| A-12 | " | " | (I-38) 50 | 37% |
| A-13 | " | " | (I-44) 25 | 36% |

*4-Amino-3-methyl-N-ethyl-N-β-(methanesulfonamido)ethylaniline.$\frac{3}{2}H_2SO_4.H_2O$
Samples A, A-1, A-3, A-4, A-6, A-7, A-8: Comparison examples
Samples A-2, A-5 and A-9 to A-13: Samples of this invention Comparison Compound A

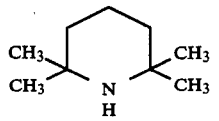

A compound described as a fading preventing agent in British Patent 1,326,889.

Comparison Compound B

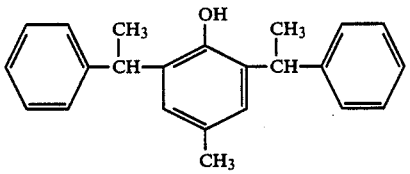

A compound described in Japanese Patent Publication No. 30462/76.

Comparison Compound C

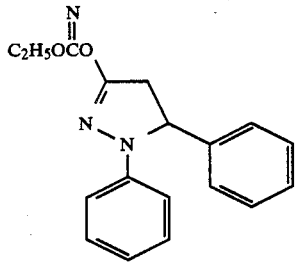

A compound described in Japanese Patent Application (OPI) No. 104641/84.

As shown in Table 1 above, it can be seen that the deterioration of the fastness of the color photographic material by a color developing agent remaining in the color photographic material is prevented by the incorporation of the compound of this invention in the color photographic material. Furthermore, this effect could not be obtained by using known fading preventing agents.

EXAMPLE 2

By following the same procedure as Example 1 except that the dye (C-1) in Sample A was replaced with a dye obtained by the oxidative coupling reaction of magenta coupler (M-1) and 4-amino-3-methyl-N-ethyl-N-β-(methanesulfonamido)ethylaniline, Sample B was prepared. Furthermore, by the same manner as above, Samples (B-1) to (B-22) were prepared using the combinations as shown in Table 2 below.

The samples were stored in the dark at room temperature for 2 months as in Example 1. Each sample was then subjected to a fading test by means of a xenon tester for 200 hours and the dye residual percentage was measured. The results thus obtained are shown in Table 2.

TABLE 2

| Sample | Dye | Ethylaniline* Amount (mol % relative to dye) | Additive (amount, mol % relative to dye) | Dye residual percentage |
|---|---|---|---|---|
| B | M-1 | — | — | 49% |
| B-1 | " | 20 | — | 21% |
| B-2 | " | " | (I-13) 50 | 49% |
| B-3 | " | " | (I-15) 50 | 48% |
| B-4 | " | " | Compound A 50 | 22% |
| B-5 | " | " | Compound B 50 | 27% |
| B-6 | M-6 | — | — | 47% |
| B-7 | " | 20 | — | 25% |
| B-8 | " | " | (I-8) 50 | 48% |
| B-9 | M-16 | — | — | 39% |
| B-10 | " | 20 | — | 22% |
| B-11 | " | " | (I-1) 50 | 38% |
| B-12 | M-31 | — | — | 45% |
| B-13 | " | 20 | — | 23% |
| B-14 | " | " | (I-10) 50 | 45% |
| B-15 | " | " | Compound D 50 | 24% |
| B-16 | " | " | Compound E 50 | 31% |
| B-17 | " | " | Compound F 50 | 33% |
| B-18 | " | " | (I-23) 50 | 43% |
| B-19 | " | " | (I-24) 50 | 46% |
| B-20 | " | " | (I-25) 50 | 44% |
| B-21 | " | " | (I-38) 50 | 47% |
| B-22 | " | " | (I-44) 25 | 43% |

Comparison Compound D

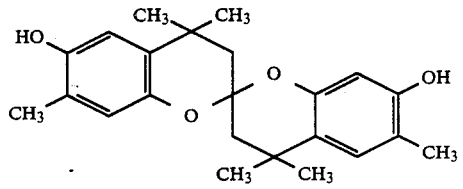

A compound described in U.S. Pat. No. 3,764,337.

Comparison Compound E

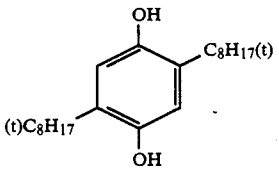

A compound described in U.S. Pat. No. 3,930,866.

Comparison Compound F

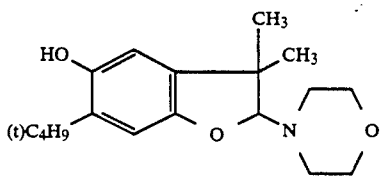

A compound described in U.S. Pat. No. 3,573,050.

As shown in Table 2 above, it can be seen that the fastness of the dye in the color photographic material is reduced by the oxidation product of a color developing agent remaining in the color photographic material but the compound of this invention has the remarkable effect of preventing the deterioration of images by the oxidation product of a color developing agent. This effect could not be obtained by using the known compounds.

EXAMPLE 3

By following the same procedure as in Example 1 except that the dye (C-1) of Sample A was replaced with a dye obtained by the coupling reaction of yellow coupler (Y-35) and 4-amino-3-methyl-N-ethyl-N-β-(methanesulfonamido)ethylaniline, Sample C was prepared. Also, in the same manner as above, Samples C-1 to C-13 were prepared using the combinations shown in Table 3 below.

These samples were stored in the dark at room temperature for 2 months as in Example 1. Then, for testing light fastness, each sample was subjected to a fading test by a xenon tester for 800 hours in the same manner as in Example 1. Also, for determining heat resistance, the sample was stored in the dark at 100° C. for 500 hours. The dye residual percentages are shown in Table 3 below.

TABLE 3

| Sample | Dye | Ethylaniline* Amount (mol % relative to dye | Additive (amount, mol % relative to dye | Dye residual percentage Xe Light (800 hrs.) | 100° C. (500 hrs.) |
|---|---|---|---|---|---|
| C | Y-35 | — | — | 65 | 89 |
| C-1 | " | 20 | — | 56 | 81 |
| C-2 | " | " | (I-4) 50 | 66 | 88 |
| C-3 | " | " | (I-11) 50 | 67 | 87 |
| C-4 | Y-38 | — | — | 63 | 88 |
| C-5 | " | 20 | — | 55 | 83 |
| C-6 | " | " | (I-13) 50 | 63 | 87 |
| C-7 | " | " | Compound A 50 | 54 | 85 |
| C-8 | " | " | Compound B 50 | 55 | 82 |
| C-9 | " | " | (I-23) 50 | 63 | 89 |
| C-10 | " | " | (I-24) 50 | 64 | 88 |
| C-11 | " | " | (I-25) 50 | 65 | 87 |
| C-12 | " | " | (I-38) 50 | 63 | 88 |
| C-13 | " | " | (I-44) 25 | 63 | 90 |

Comparison examples: C, C-1, C-4, C-5, C-7 and C-8
Present Invention: C-2, C-3, C-6 and C-9 to C-13

As shown in Table 3 above, it can be seen that by the addition of the compound of this invention, the fastness to light and heat is greatly improved and the occurrence of fading by the oxidation product of a color developing agent remaining in the color photographic material can be prevented.

EXAMPLE 4

A multilayer color photographic paper in which Layer 1 (lowermost layer) to Layer 7 (uppermost layer) have the layer composition shown below on a paper support in which both surfaces thereof were coated with polyethylene was prepared. In addition, the polyethylene coating on the emulsion layer-carrying side of the support contained a white pigment such as titanium dioxide and a bluish dye such as ultramarine blue.

| Layer Structure: | |
|---|---|
| Layer 1: Blue-Sensitive Emulsion Layer: | |
| Silver Chlorobromide Emulsion (silver bromide: 80 mol %) | 0.35 g/m² as silver |
| Gelatin | 1.35 g/m² |
| Yellow Coupler | 6.91 × 10⁻⁴ mol/m² |
| Color Image Stabilizer (A-43) | 0.13 g/m² |
| Solvent (a) | 0.02 g/m² |
| Layer 2: Color Mixing Preventing Layer: | |
| Gelatin | 0.90 g/m² |
| Color Mixing Preventing Agent (b) | 2.33 × 10⁻⁴ mol/m² |
| Layer 3: Green-Sensitive Emulsion Layer: | |
| Silver Chlorobromide Emulsion (silver bromide: 75 mol %) | 0.15 g/m² as silver |
| Gelatin | 1.56 g/m² |
| Magenta Coupler | 3.38 × 10⁻⁴ mol/m² |
| Color Image Stabilizer (A-18) | 0.19 g/m² |
| Solvent (c) | 0.59 g/m² |
| Layer 4: Ultraviolet Absorptive Layer: | |
| Gelatin | 1.60 g/m² |
| Ultraviolet Absorbent (d) | 1.70 × 10⁻⁴ mol/m² |
| Color Mixing Preventing Agent (A-30) | 1.60 × 10⁻⁴ mol/m² |
| Solvent (a) | 0.24 g/m² |
| Layer 5: Red-Sensitive Emulsion Layer: | |
| Silver Chlorobromide Emulsion (silver bromide: 70 mol %) | 0.22 g/m² as silver |
| Gelatin | 0.90 g/m² |
| Cyan Coupler | 7.05 × 10⁻⁴ mol/m² |
| Color Image Stabilizer (f) | 5.20 × 10⁻⁴ mol/m² |
| Solvent (e) | 0.6 g/m² |
| Layer 6: Ultraviolet Absorptive Layer: | |
| Gelatin | 0.54 g/m² |
| Ultraviolet Absorbent (d) | 5.10 × 10⁻⁴ mol/m² |
| Solvent (a) | 0.08 g/m² |
| Layer 7: Protective Layer: | |
| Gelatin | 1.33 g/m² |
| Acryl-modified copolymer of polyvinyl alcohol (modified degree of 17%) | 0.17 g/m² |

In addition, the following spectral sensitizing dyes were used for the aforesaid silver halide emulsion layers.

For the Blue-Sensitive Emulsion Layer:

-continued

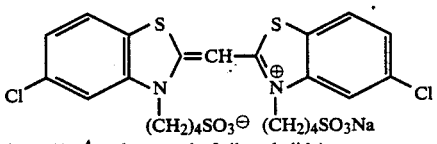

($2 \times 10^{-4}$ mol per mol of silver halide)

For the Green-Sensitive Emulsion Layer:

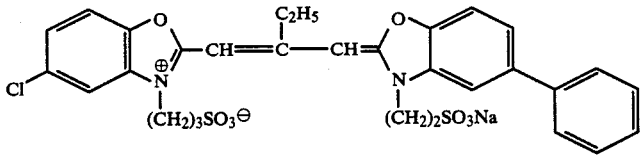

($2.5 \times 10^{-4}$ mol per mol of silver halide)

For the Red-Sensitive Emulsion Layer:

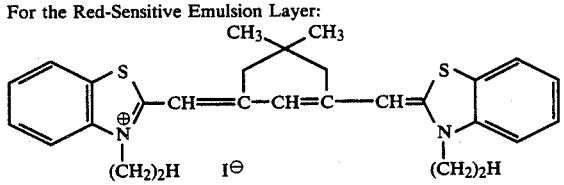

($2.5 \times 10^{-4}$ mol per mol of silver halide)

The compounds used for preparing the aforesaid color photographic material were as follows.

Solvent (a):

$((iso)\text{-}C_9H_{19}O)_3P{=}O$

Color Mixing Preventing Agent (b):

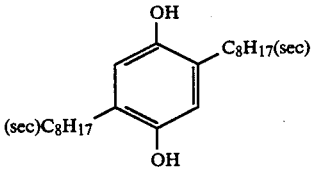

Solvent (c):

$(C_8H_{17}O)_3P{=}O$ and

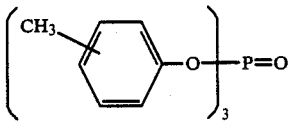

in a 2:1 mixture (weight ratio).

Ultraviolet Solvent (d):

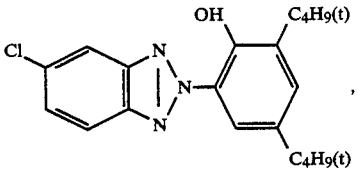

,

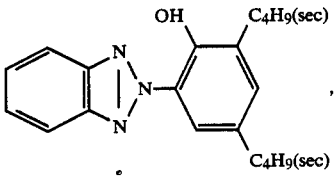

, and

-continued

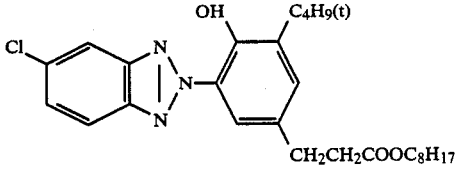

in a 1:5:3 mixture (molar ratio).

Solvent (e):

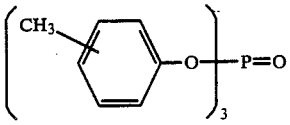

Color Image Stabilizer (f):

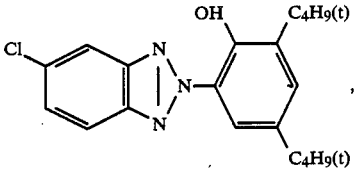

,

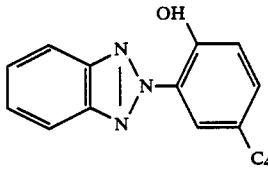

, and

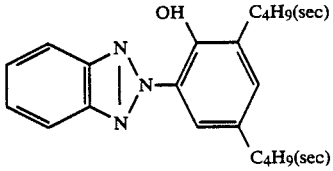

in a 1:3:3 mixture (molar ratio).

-continued

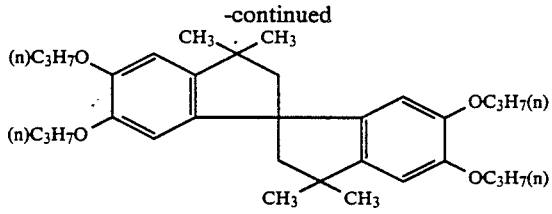

A-30

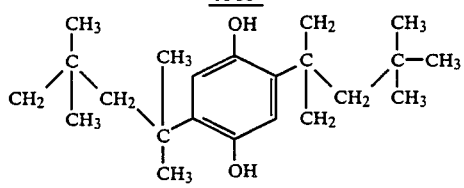

A-43

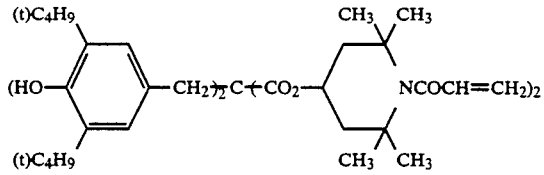

Furthermore, the following dyes were used for the emulsion layers as irradiation preventing dyes.

For the Green-Sensitive Emulsion Layer:

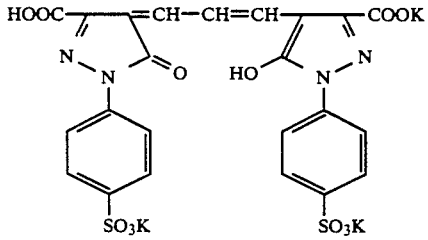

For the Red-Sensitive Emulsion Layer:

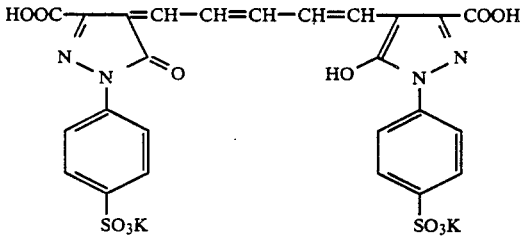

The aforesaid sample wherein the magenta coupler was omitted from Layer 3, the cyan coupler was omitted from Layer 5, and also yellow coupler (Y-35) was used as the yellow coupler for Layer 1 was denoted as Sample D. Also, in the same manner as above, except that the yellow coupler for Layer 1 was changed as shown in Table 4 below and the additive for Layer 1 was changed as shown in Table 4, Samples D-1 to D-11 were prepared. In these samples, Samples D-1, D-7, and D-9 were samples of this invention and other samples were comparison samples.

The samples thus prepared were exposed through an optical wedge and processed by the following steps to provide color images.

Process A

By using a Fuji Color Roll Processor FMPP100 (partially improved) (made by Fusji Photo Film Co., Ltd.), running processing was performed under the following conditions.

| Step | Time | Temp. | Tank Volume | Replenisher Amount (ml/m$^2$) |
|---|---|---|---|---|
| Color Development | 45 sec. | 35° C. | 88 liter | 150 |
| Blix | 45 sec. | 35° C. | 35 liter | 50 |
| Rinse (1) | 20 sec. | 35° C. | 17 liter | — |
| Rinse (2) | 20 sec. | 35° C. | 17 liter | — |
| Rinse (3) | 20 sec. | 35° C. | 17 liter | 250 |

In the rinse step, the replenisher was supplied to rinse tank (3), the overflow liquid from tank (3) was introduced into the lower portion of rinse tank (2), the overflow liquid from rinse tank (2) was introduced into the lower portion of rinse tank (1), and the overflown liquid from rinse tank (1) was wasted (3-tank countercurrent system).

In addition, the amount of the processing liquid carried by color photographic paper from the pre-bath was 25 ml per square meter of paper.

The compositions of each tank liquid and replenisher used were as follows.

| | Tank Liquid | Replenisher |
|---|---|---|
| Color Developer | | |
| Water | 800 ml | 800 ml |
| Diethylenetriaminepentaacetic Acid | 3.0 g | 3.0 g |
| Benzyl Alcohol | 15 ml | 17 ml |
| Diethylene Glycol | 10 ml | 10 ml |
| Sodium Sulfite | 2.0 g | 2.5 g |
| Potassium Bromide | 0.5 g | — |
| Sodium Carbonate | 30 g | 35 g |
| N-Ethyl-N-(β-methanesulfonamidoethyl)-3-methyl-4-aminoaniline sulfate | 5.0 g | 7.0 g |
| Hydroxylamine Sulfate | 4.0 g | 4.5 g |
| Fluorescent Whitening Agent | 1.0 g | 1.5 g |
| Water to make | 1,000 ml | 1,000 ml |
| pH | 10.10 | 10.50 |
| Blix Liquid | | |
| Water | 400 ml | 400 ml |
| Ammonium Thiosulfate (70% soln.) | 150 ml | 300 ml |
| Sodium Sulfite | 12 g | 25 g |
| Iron (III) Ammonium Ethylenediaminetetraacetate | 55 g | 110 g |
| Disodium Ethylenediaminetetraacetate | 5 g | 10 g |
| Water to make | 1,000 ml | 1,000 ml |
| pH (25° C.) | 6.70 | 6.50 |
| Linse Liquid | | |
| The tank solution and the replenisher had the same composition. | | |
| Ethylenediamine-N,N,N',N'-tetramethylenephosphonic Acid | 0.3 g | |
| Benzotriazole | 1.0 g | |
| Water to make | 1,000 ml | |
| pH adjusted with sodium hydroxide | 7.5 | |

Process B

| Step | Time | Tank Volume | Replenisher Amount (ml/m$^2$) |
|---|---|---|---|
| Color Development | 45 sec. | 88 liter | 150 |
| Blix | 2 min. | 35 liter | 350 |
| Rinse (1) | 1 min. | 17 liter | — |
| Rinse (2) | 1 min. | 17 liter | — |

-continued

| | | | |
|---|---|---|---|
| Rinse (3) | 1 min. | 17 liter | 1300 |

The compositions of the processing liquids and the replenishers were same as those in Process A described above.

Then, for each of the color photographic papers processed by each of the aforesaid processes, the yellow reflective density of the non-imaged portion (background portion) was measured one hour after processing, and, furthermore, the color photographic materials thus processed were allowed to stand for 7 days at 80° C. (10 to 15% RH) and then for 8 days at 80° C., 70% (RH), and the yellow reflective density of the non-imaged portion was then measured again. The results obtained are shown in Table 4 below.

TABLE 4

| Sample | Yellow Coupler | Additive | Amount of Additive (mol %/coupler) | Processing Step | Increase in Yellow Stain 80° C., 7 days | 80° C./70%, 8 days |
|---|---|---|---|---|---|---|
| D | Y-35 | — | — | A | 0.04 | 0.11 |
| D | " | — | — | B | 0.01 | 0.01 |
| D-1 | " | I-1 | 50 | A | 0.01 | 0.03 |
| D-2 | " | Compound G | " | A | 0.04 | 0.10 |
| D-3 | " | Compound H | " | A | 0.05 | 0.11 |
| D-4 | " | Compound I | " | A | 0.04 | 0.11 |
| D-5 | " | Compound J | " | A | 0.04 | 0.12 |
| D-6 | Y-10 | — | — | A | 0.06 | 0.15 |
| D-6 | " | — | — | B | 0.01 | 0.09 |
| D-7 | " | I-3 | 50 | A | 0.01 | 0.02 |
| D-8 | Y-36 | — | — | A | 0.05 | 0.10 |
| D-8 | " | — | — | B | 0.01 | 0.01 |
| D-9 | " | I-7 | 50 | A | 0.01 | 0.02 |
| D-10 | " | Compound D | " | A | 0.05 | 0.12 |
| D-11 | " | Compound E | " | A | 0.05 | 0.09 |

Comparison: D, D-2 to D-6, D-8, D-10 and D-11
Present Invention: D-1, D-7 and D-9

As shown in Table 4 above, it can be seen that in process B wherein the processing times for wash and blix are long and the amounts of the replenishers were sufficient, there is no yellow stain problem after processing but in Process A wherein the amounts of replenishers are samll, yellow stain occurs. However, by the addition of the compound of this invention, the occurrence of yellow stain can be prevented. On the other hand, in the case of using the comparison compounds known as conventional stain preventing agents, the occurrence yellow stain cannot be prevented.

EXAMPLE 5

By forming Layer 1 to Layer 7 as described in Example 4 on a paper support, both surfaces of which had been coated with polyethylene, a color photographic paper was prepared.

The sample wherein the yellow coupler was omitted from Layer 1, the cyan coupler was omitted from Layer 5, and magenta coupler (M-23) was used as the magenta coupler for Layer 3 was defined as Sample E. Also, in the same manner as above except that the magenta coupler and the additive were changed as shown in Table 5 below, Samples E-1 to E-15 were prepared. In this case, Samples E-1 to E-3, E-9, E-11, and E-13 were the samples of this invention and other samples were comparison samples.

These samples were exposed through an optical wegde and processed by the following steps. In addition, in the process shown below, the developing agent and other components for processing liquid were used specifically because they were liable to remain in color photographic papers and stain was liable to occur in order to clearly demonstrate the effect of this invention.

| Processing Step | Temperature | Time |
|---|---|---|
| Color Development | 33° C. | 3 min. 30 sec. |
| Blix | 33° C. | 1 min. 30 sec. |
| Wash | 20–25° C. (non-stirring) | 1 min. |
| Drying | 50–80° C. | 2 min. |

The compositions of the processing liquids were as follows.

| Color Developer | |
|---|---|
| Trisodium Nitrilotriacetate | 2.0 g |
| Benzyl Alcohol | 15 ml |
| Diethylene Glycol | 10 ml |
| Sodium Sulfite | 0.2 g |
| Potassium Bromide | 0.5 g |
| Hydroxylamine Sulfate | 3.0 g |
| 4-Amino-3-methyl-N-ethyl-N-[(β-(methanesulfonamido)ethyl]-p-phenylenediamine Sulfate | 6.5 g |
| Sodium Carbonate monohydrate | 30 g |
| Water to make | 1,000 ml |
| | pH 10.1 |
| **Blix Liquid** | |
| Color Developer shown above | 400 ml |
| Ammonium thiosulfate (70 wt %) | 150 ml |
| Sodium Sulfite | 12 g |
| Iron Sodium Ethylenediamine-tetraacetate | 36 g |
| Disodium Ethylenediaminetetra-acetate | 4 g |
| Water to make | 1,000 ml |
| pH adjusted with 1N sulfuric acid | 7.0 |

The liquids having the aforesaid compositions were used after aerating them for one hour.

In addition, the aforesaid blix liquid composition was prepared specifically to create a bad situation of attaching the color developer onto color photographic papers in running state and carrying them over in a blix liquid in a large amount.

Then, for each sample thus processed, a magenta reflection density (stain) at the non-imaged portion was measured using green light and using a self-recording type densitometer made by Fuji Photo Film Co., Ltd.

one hour after processing, and also the magenta reflection density (stain) was measured again after allowing each sample to stand for 3 days at 80° C., 70% RH, and after allowing each sample to stand for 50 days at room temperature. The results, (i.e., the increase of stain after one hour since processing) are shown in Table 5 below.

TABLE 5

| Sample | Magenta Coupler | Additive | Amount of Additive (mol %/coupler) | Increase in Magenta Stain: 80° C./70%, 3 days | Increase in Magenta Stain: Room Temperature, 50 days |
|---|---|---|---|---|---|
| E | M-23 | — | — | 0.36 | 0.28 |
| E-1 | " | I-1 | 50 | 0.11 | 0.01 |
| E-2 | " | I-3 | " | 0.10 | 0.01 |
| E-3 | " | I-11 | " | 0.12 | 0.02 |
| E-4 | " | Compound G | " | 0.32 | 0.26 |
| E-5 | " | Compound H | " | 0.33 | 0.26 |
| E-6 | " | Compound I | " | 0.34 | 0.27 |
| E-7 | " | Compound J | " | 0.34 | 0.25 |
| E-8 | M-19 | — | — | 0.35 | 0.25 |
| E-9 | " | I-3 | " | 0.11 | 0.01 |
| E-10 | M-33 | — | — | 0.27 | 0.21 |
| E-11 | " | I-1 | 50 | 0.08 | 0.01 |
| E-12 | M-13 | — | — | 0.16 | 0.10 |
| E-13 | " | I-7 | 50 | 0.09 | 0.01 |
| E-14 | " | Compound E | " | 0.15 | 0.10 |
| E-15 | " | Compound F | " | 0.17 | 0.11 |

Comparison: E, E-2 to E-8, E-10, E-12, E-14 and E-15
Present Invention: E-1 to E-3, E-9, E-11 and E-13

The comparison compounds used in this example were as follows.

Comparison Compound (G)

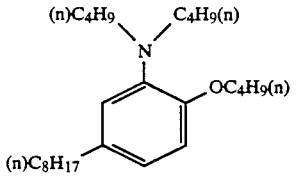

A compound described in U.S. Pat. No. 4,483,918.

Comparison Compound (H)

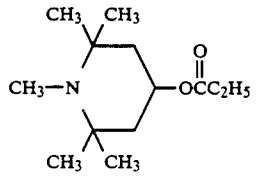

A compound described in U.S. Pat. No. 4,463,085.

Comparison Compound (I)

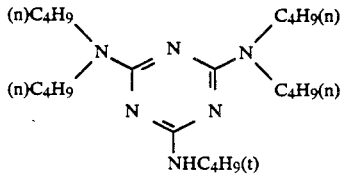

A compound described in Japanese Patent Application (OPI) No. 218445/84.

Comparison Compound (J)

$C_{12}H_{25}N(CH_2CH_2OH)_2$

A compound described in Japanese Patent Application (OPI) No. 229557/84.

As shown in Table 5 above, it can be seen that in the case of using the compound of this invention, the stain preventing effect with the passage of time is remarkable as compared to the known comparison compounds.

EXAMPLE 6

A compound photographic paper having Layer 1 to Layer 7 of the layer structure as shown in Example 4 on a paper support, both surfaces of which had been coated with polyethylene, was prepared.

The sample wherein the yellow coupler was omitted from Layer 1, the magenta coupler was omitted from Layer 3, and cyan coupler (C-2) was used as the cyan coupler for Layer 5 was defined as Sample F. In the same manner as above, except that the cyan coupler and the additive were changed as shown in Table 6 below, Samples F-1 to F-16 were prepared. In this case, Samples F-1, F-2, F-8, and F-10 were the samples of this invention and other samples were comparison samples.

Each of the samples was exposed and processed as in Example 5. For each sample thus processed, a cyan reflection density at the non-images portion was measured after processing by using a red light and using a self-recording type densitometer made by Fuji Photo Film Co., Ltd. and also the cyan reflection density at the non-imaged portion was measured again after allowing the sample to sand for 3 days at 80° C., 70% RH and after allowing the sample to stand for 5 days at 80° C. and dry state (10 to 15% RH). The results obtained are shown in Table 6 below.

TABLE 6

| Sample | Cyan Coupler | Additive | Amount of Additive (mol %/coupler) | Increase in Cyan Stain 80° C., 5 days | 80° C./70%, 3 days |
|---|---|---|---|---|---|
| F | C-2 | — | — | 0.07 | 0.23 |
| F-1 | " | I-3 | 50 | 0.03 | 0.07 |
| F-2 | " | I-12 | " | 0.03 | 0.07 |
| F-3 | " | Compound A | " | 0.08 | 0.24 |
| F-4 | " | Compound B | " | 0.07 | 0.23 |
| F-5 | " | Compound G | " | 0.07 | 0.24 |
| F-6 | " | Compound H | " | 0.08 | 0.24 |
| F-7 | C-25 | — | — | 0.06 | 0.22 |
| F-8 | " | I-1 | 50 | 0.03 | 0.06 |
| F-9 | C-35 | — | — | 0.10 | 0.30 |
| F-10 | " | I-6 | 50 | 0.03 | 0.05 |

Comparison Example: F, F-3 to F-7 and F-9
Present Invention: F-1, F-2, F-8 and F-10

As shown in Table 6 above, it can be seen that the compound shows a remarkable ability to prevent the occurrence of stain with the passage of time, which cannot be attained using the conventional techniques shown above.

EXAMPLE 7

A color photographic paper having Layer 1 to Layer 7 of the layer structure as in Example 4 on a paper support, both surfaces of which had been coated with polyethylene, was prepared.

The sample wherein yellow coupler (Y-35) was used as the yellow coupler for Layer 1, magenta coupler (M-23) was used as the magenta couupler for Layer 3, and cyan couplers (C-2) and (C-14) at a 1:1 mol ratio were used as the cyan coupler for Layer 5 was defined as Sample G.

By following the same test procedure as above, except that the magenta coupler for Layer 3 and the additive for the layer were changed as shown in Table 7 below, Sample G-1 to G-3 were prepared. In this case, Samples G-1 and G-3 were the samples of this invention and Samples G and G-2 were comparison samples.

Each of the samples was exposed through an optical wedge and processed using the following steps.

| Processing Step (at 33° C.) | Time |
|---|---|
| Color Development | 3 min. 30 sec. |
| Blix | 1 min. 30 sec. |
| Wash | 3 min. |
| Drying (50° C.-80° C.) | 2 min. |

The compositions for the processing liquids were as follows.

| | |
|---|---|
| Color Developer | |
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| Fluorescent Whitening Agent | 1 g |
| N-Ethyl-N-β-methanesulfonamido-ethyl-3-methyl-4-aminoaniline Sulfate | 4 g |
| Water to make | 1 liter |
| pH adjusted with sodium hydroxide | 10.2 |
| Blix Liquid | |
| Ammonium thiosulfate | 124.5 g |
| Sodium metabisulfite | 13.3 g |
| Anhydrous Sodium Sulfite | 2.7 g |

-continued

| | |
|---|---|
| EDTA Ferric Ammonium Salt | 65 g |
| Color Developer | 100 ml |
| pH adjusted to the range of | from 6.7 to 6.8 |
| Water to make | 1 liter |

The compositions of the processing liquids used were almost in equilibrium state since the processing was performed while performing normal replenishing using an ordinary roller transport type processor.

Then, for each sample thus processed, a magenta reflection density (stain) at the non-imaged portion was measured one hour after processing and the magenta reflection density (stain) at the non-imaged portion was measured again after allowing the samples to stand for 3 days at 70° C. and 70% RH and after allowing the samples to stand for 50 days at room temperature. The increase of magenta stain from the time after one hour since processing is shown in Table 7 below.

TABLE 7

| Sample | Magenta Coupler | Additive | Amount of Additive (mol %/coupler) | Increase in Magenta Stain 80° C./70%, 3 days | Room Temperature, 50 days |
|---|---|---|---|---|---|
| G | M-23 | — | — | 0.18 | 0.15 |
| G-1 | " | I-1 | 50 | 0.06 | 0.02 |
| G-2 | M-13 | — | — | 0.08 | 0.06 |
| G-3 | " | I-8 | 50 | 0.05 | 0.03 |

Comparison: G and G-2
Present Invention: G-1 and G-3

As shown in Table 7, it can be seen that the compounds of this invention show a remarkable ability to prevent the occurrence of stain with the passage of time and, in particular, when the compositions for the processing liquids are not changed, the compound shows sufficient stain prevention.

EXAMPLE 8

A color photographic paper (Sample H) was prepared as follows.

A multilayer color photographic paper in which Layer 1 to Layer 11 have the following layer structure on a paper support, both surfaces of the paper support having been coated with polyethylene. In this case, the polyethylene coating on the emulsion layer-carrying side of the support contained titanium dioxide as a white pigment and a small amount of ultramarine blue as a bluish dye.

| Composition of Layers: | |
|---|---|
| Layer 1: Antihalation Layer: | |
| Black Colloidal Silver | 0.01 g/m$^2$ |
| Gelatin | 0.2 g/m$^2$ |
| Layer 2: Low-Speed Red-Sensitive Layer: | |
| Silver Iodobromide Emulsion (silver iodide: 3.5 mol %, mean grain size 0.7 μm) spectrally sensitized by red-sensitizing dyes (*5 and *4) | 0.15 g/m$^2$ as silver |
| Gelatin | 1.0 g/m$^2$ |
| Cyan Coupler (*3) | 0.30 g/m$^2$ |
| Fading Preventing Agent (*2) | 0.15 g/m$^2$ |
| Coupler Solvent (*7 and *1) | 0.06 g/m$^2$ |
| Layer 3: High-Seed Red-Sensitive Layer: | |
| Silver Iodobromide Emulsion (silver iodide: 8.0 mol %, mean grain size 0.7 μm) spectrally sensitized by red-sensitizing dyes (*5 and *4) | 0.10 g/m$^2$ as silver |
| Gelatin | 0.50 g/m$^2$ |
| Cyan Coupler (*3) | 0.10 g/m$^2$ |
| Fading Preventing Agent (*2) | 0.05 g/m$^2$ |
| Coupler Solvent (*15 and *1) | 0.02 g/m$^2$ |
| Layer 4: Interlayer: | |
| Yellow Colloidal Silver | 0.02 g/m$^2$ |
| Gelatin | 1.00 g/m$^2$ |
| Color Mixing Preventing Agent (*14) | 0.08 g/m$^2$ |
| Color Mixing Preventing Agent Solvent (*13) | 0.16 g/m$^2$ |
| Polymer Latex (*6) | 0.40 g/m$^2$ |
| Layer 5: Low-Speed Green-Sensitive Layer: | |
| Silver Iodobromide Emulsion (silver iodide: 2.5 mol %, mean grain size 0.4 μm) spectrally sensitized by green-sensitizing dyes (*12) | 0.20 g/m$^2$ as silver |
| Gelatin | 0.70 g/m$^2$ |
| Magenta Coupler (*11) | 0.40 g/m$^2$ |
| Fading Preventing Agent A (*10) | 0.05 g/m$^2$ |
| Fading Preventing Agent B (*9) | 0.05 g/m$^2$ |
| Fading Preventing Agent C (*8) | 0.02 g/m$^2$ |
| Coupler Solvent (*18) | 0.60 g/m$^2$ |
| Layer 6: High-Speed Green-Sensitive Layer: | |
| Silver Iodobromide Emulsion (silver iodide: 3.5 mol %, mean grain size 0.9 μm) spectrally sensitized by green-sensitizing dyes (*12) | 0.20 g/m$^2$ as silver |
| Gelatin | 0.70 g/m$^2$ |
| Magenta Coupler (*11) | 0.40 g/m$^2$ |
| Fading Preventing Agent A (*10) | 0.05 g/m$^2$ |
| Fading Preventing Agent B (*9) | 0.05 g/m$^2$ |
| Fading Preventing Agent C (*8) | 0.02 g/m$^2$ |
| Coupler Solvent (*18) | 0.60 g/m$^2$ |
| Layer 7: Yellow Filter Layer: | |
| Yellow Colloidal Silver | 0.20 g/m$^2$ |
| Gelatin | 1.00 g/m$^2$ |
| Color Mixing Preventing Agent (*14) | 0.06 g/m$^2$ |
| Color Mixing Preventing Agent Solvent (*13) | 0.24 g/m$^2$ |
| Layer 8: Low-Speed Blue-Sensitive layer: | |
| Silver Iodobromide Emulsion (silver iodide: 2.5 mol %, mean grain size: 0.5 μm) spectrally sensitized by blue-sensitizing dyes (*16) | 0.15 g/m$^2$ as silver |
| Gelatin | 0.50 g/m$^2$ |
| Yellow Coupler (*15) | 0.20 g/m$^2$ |
| Coupler Solvent (*18) | 0.05 g/m$^2$ |
| Layer 9: High-Speed Blue-Sensitive Layer: | |

-continued

| Composition of Layers: | |
|---|---|
| Silver Iodobromide Emulsion (silver iodide: 2.5 mol %, mean grain size 1.4 μm) spectrally sensitized by blue-sensitizing dyes (*16) | 0.20 g/m$^2$ as silver |
| Gelatin | 1.00 g/m$^2$ |
| Yellow Coupler (*15) | 0.40 g/m$^2$ |
| Coupler Solvent (*18) | 0.10 g/m$^2$ |
| Layer 10: Ultraviolet Absorptive Layer: | |
| Gelatin | 1.50 g/m$^2$ |
| Ultraviolet Absorbent (*19) | 1.0 g/m$^2$ |
| Ultraviolet Absorbent Solvent (*18) | 0.30 g/m$^2$ |
| Fading Preventing Agent (*17) | 0.08 g/m$^2$ |
| Layer 11: Protective Layer: | |
| Gelatin | 1.0 g/m$^2$ |

The compounds used for the color photographic paper were as follows.

(*1): Dioctyl phthalate (*2): 2-(2-Hydroxy-3-sec-butyl-5-t-butylphenyl)benzotriazole (*3): 2-[α-(2,4-Di-t-amylphenoxy)butanamido]-4,6-dichloro-5-ethylphenol (*4): 5,5'-Dichloro-3,3'-di(3-sulfobutyl)-9-ethylthiacarbocyanine Sodium Salt (*5): Triethylammonium-3-[2-{2-[3-(3-sulfopropyl)-naphtho(1,2-d)thiazolin-2-ylidenemethyl]-1-butenyl}-3-naphtho(1,3-d)thiazolino]propane Sulfonate (*6): Polyethyl Acrylate (*7): Phosphoric Acid Trioctyl Ester (*8): 2,4-Di-t-hexylhydroquinone (*9): Di-(2-hydroxy-3-t-butyl-5-methylphenyl)methane (*10): 3,3,3',3'-Tetramethyl-5,6,5',6'-tetrapropoxy-1,1'-bisspiroindane (*11): 3-(2-Chloro-5-tetradecanamidoanilino)-1-(2,4,6-trichlorophenyl)-2-pyrazolin-5-one (*12): 5,5'-Diphenyl-9-ethyl-3,3'-disulfopropyloxacarbocyanine Sodium Salt (*13): Phosphoric Acid o-Cresyl Ester (*14): 2,4-Di-t-octylhydroquinone (*15): α-Pivaloyl-α-[(2,4-dioxo-1-benzyl-5-ethoxyhydantoin-3-yl)-2-chloro-5-(α-2,4-dioxo-t-amylphenoxy)butanamido]acetanilide (*16): Triethylammonium 3-[2-(3-benzylrhodanine-5-ylidene)-3-benzoxazolinyl]propanesulfonate (*17): 2,4-Di-sec-octylhydroquinone (*18): Phosphoric Acid Trinonyl Ester (*19): 5-Chloro-2-(2-hydroxy-3-t-butyl-5-t-octyl)-phenylbenzotriazole By following the same test procedure as above except that the magenta coupler for Layer 5 and Layer 6 and the additive were changed as shown in Table 8, Samples H-1 to H-4 were prepared. In this case, Samples H-1, H-3, and H-4 were samples of this invention and Samples H and H-2 were comparison samples.

The sample thus prepared were exposed through an optical wedge and processed by the following processing steps.

| Processing Step | | |
|---|---|---|
| First Development (Black and White) | 38° C. | 1 min. 15 sec. |
| Wash | 38° C. | 1 min. 30 sec. |
| Reversal Exposure | >100 lux | >1 min. |
| Color Development | 38° C. | 2 min. 15 sec. |

-continued

| Processing Step | | |
|---|---|---|
| Wash | 38° C. | 45 sec. |
| Blix | 38° C. | 2 min. 00 sec. |
| Wash | 38° C. | 2 min. 15 sec. |

The compositions for the processing liquids used were as follows.

| | |
|---|---|
| First Developer | |
| Pentasodium Nitrilo-N,N,N-trimethylene-phosphonate | 0.6 g |
| Pentasodium Diethylenetriaminepenta-acetate | 4.0 g |
| Potassium Sulfite | 30.0 g |
| Potassium Thiocyanate | 1.2 g |
| Potassium Carbonate | 35.0 g |
| Potassium Hydroquinone Monosulfonate | 25.0 g |
| Diethylene glycol | 15.0 ml |
| 1-Phenyl-4-hydroxymethyl-4-methyl-3-pyrazolidone | 2.0 g |
| Potassium Bromide | 0.5 g |
| Potassium Iodide | 5.0 mg |
| Water to make | 1 liter |
| | pH 9.70 |
| Color Developer | |
| Benzyl Alcohol | 15.0 ml |
| Diethylene Glycol | 12.0 ml |
| 3,6-Dithia-1,8-octandiol | 0.2 g |
| Pentasodium Nitrilo-N,N,N-tri-methylenephosphonate | 0.5 g |
| Pentasodium Diethylenetriaminepenta-acetate | 2.0 g |
| Sodium Sulfite | 2.0 g |
| Potassium Carbonate | 25.0 g |
| Hydroxylamine sulfate | 3.0 g |
| N-Ethyl-N-(β-methanesulfonamidoethyl)-3-methyl-4-aminoaniline Sulfate | 5.0 g |
| Potassium Bromide | 0.5 g |
| Potassium Iodide | 1.0 mg |
| Water to make | 1 liter |
| | pH 10.40 |
| Blix Liquid | |
| 2-Mercapto-1,3,4-triazole | 1.0 g |
| Disodium Ethylenediaminetetraacetate | 5.0 g |
| Ammonium Iron (III) Ethylene-diaminetetraacetate Monohydrate | 80.0 g |
| Sodium Sulfite | 15.0 g |
| Sodium thiosulfate (700 g/l) | 160.0 ml |
| Glacial Acetic Acid | 5.0 ml |
| Water to make | 1 liter |
| | pH 6.50 |

The magenta reflection density (stain) at the non-imaged portion of each sample thus processed was measured and then the magenta reflection density (stain) at the non-imaged portion thereof was measured again after allowing the sample to stand for 3 days at 80° C. and 70% RH and after allowing the sample to stand for 80 days at room tesmperature. The increase in stain from one hour after processing is shown in Table 8.

TABLE 8

| Sample | Magenta Coupler | Additive | Amount of Additive (mol %/coupler) | Increase in Magenta Stain: 80° C./70%, 3 days | Increase in Magenta Stain: Room Temperature, 80 days |
|---|---|---|---|---|---|
| H | M-13 | — | — | 0.06 | 0.04 |
| H-1 | " | I-3 | 50 | 0.03 | 0.02 |
| H-2 | M-23 | — | — | 0.14 | 0.12 |
| H-3 | " | I-1 | 50 | 0.03 | 0.01 |

TABLE 8-continued

| Sample | Magenta Coupler | Additive | Amount of Additive (mol %/coupler) | Increase in Magenta Stain: 80° C./70%, 3 days | Increase in Magenta Stain: Room Temperature, 80 days |
|---|---|---|---|---|---|
| H-4 | " | I-4 | 50 | 0.03 | 0.01 |

Comparison: H and H-2
Present Invention: H-1, H-3 and H-4

As shown in Table 8 above, it can be seen that the occurrence of stain with the passage of time is greatly prevented by the compound of this invention and the effect is not reduced when the layer structures of the color photographic materials and the cmpositions for processing liquids are changed.

EXAMPLE 9

The following First layer to Fourteenth layer were coated consecutively on a paper support in which both side thereof were laminated with polyethylene to prepare color photographic light-sensitive material Samples I and I-1 to I-14. The polyethylene laminated on the First layer side of the support contained titan white as a white pigment and a small amount of ultramarine as a bluish pigment.

Construction of Layers

The amount of the component is indicated in terms of g/m$^2$, provided that the amount of the silver halide emulsion is indicated in terms of g silver/m$^2$.

| | |
|---|---|
| First Layer: Antihalation Layer | |
| Black colloidal silver | 0.10 |
| Gelatin | 1.30 |
| Second Layer: Intermediate Layer | |
| Gelatin | 0.70 |
| Third Layer: Low Sensitive Red-sensitive Layer | |
| Silver bromide emulsion spectrally sensitized with Red-sensitizing dyes (ExS-1, 2, 3) (average grain size: 0.3 μm, size distribution: 8%, octa-hedral) | 0.06 |
| Silver bromide emulsion spectrally sensitized with Red-sensitizing dyes (ExS-1, 2, 3) (average grain size: 0.45 μm, size distribution: 10%, octa-hedral) | 0.10 |
| Gelatin | 1.00 |
| Cyan coupler (ExC-1) | 0.14 |
| Cyan coupler (ExC-2) | 0.07 |
| Fading preventing agent (Cpd-2, 4, 5, 9, mixing ratio: 1/1/1/1) | 0.12 |
| Coupler dispersing medium (Cpd-5) | 0.03 |
| Coupler solvent (Solv-1, 2, 3, mixing ratio: 1/1/1) | 0.06 |
| Fourth Layer: High Sensitive Red-sensitive Layer | |
| Silver bromide emulsion spectrally sensitized with Red-sensitizing dyes (ExS-1, 2, 3) (average grain size: 0.75 μm, size distribution: 10%, octa-hedral) | 0.15 |
| Gelatin | 1.00 |
| Cyan coupler (ExC-1) | 0.20 |
| Cyan coupler (ExC-2) | 0.10 |
| Fading preventing agent (Cpd-2, 3, 4, 9, mixing ratio: 1/1/1/1) | 0.15 |
| Coupler dispersing medium (Cpd-5) | 0.03 |
| Coupler solvent (Solv-1, 2, 3, mixing ratio: 1/1/1) | 0.10 |
| Fifth Layer: Intermediate Layer | |
| Gelatin | 1.00 |
| Color mixing preventing agent (Cpd-7) | 0.08 |

-continued

| | |
|---|---|
| Color mixing preventing agent solvent (Solv-4, 5) | 0.16 |
| Polymer latex (Cpd-8) | 0.10 |
| Sixth layer: Low Sensitive Green-sensitive Layer | |
| Silver bromide emulsion spectrally sensitized with Green-sensitizing dyes (ExS-3, 4) (average grain size: 0.28 μm, size distribution: 8%, octahedral) | 0.04 |
| Silver bromide emulsion spectrally sensitized with Green-sensitizing dyes (ExS-3, 4) (average grain size: 0.45 μm, size distribution: 10%, octahedral) | 0.06 |
| Gelatin | 0.80 |
| Magenta coupler (ExM-1) | 0.10 |
| Color mixing preventing agent (Cpd-9) | 0.10 |
| Stain preventing agent (Cpd-10) | 0.01 |
| Stain preventing agent (Cpd-11) | 0.001 |
| Stain preventing agent (Cpd-12) | 0.01 |
| Coupler dispersing medium (Cpd-5) | 0.05 |
| Coupler solvent (Solv-4, 6, mixing ratio: 1/1) | 0.15 |
| Seventh Layer: High Sensitive Green-sensitive Layer | |
| Silver bromide emulsion spectrally sensitized with Green-sensitizing dye (ExS-3) (average grain size: 0.9 μm, size distribution: 8%, octahedral) | 0.10 |
| Gelatin | 0.80 |
| Magenta coupler (ExM-1) | 0.10 |
| Fading preventing agent (Cpd-9) | 0.10 |
| Stain preventing agent (Cpd-10) | 0.01 |
| Stain preventing agent (Cpd-11) | 0.001 |
| Stain preventing agent (Cpd-12) | 0.01 |
| Coupler dispersing medium (Cpd-5) | 0.05 |
| Coupler solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow colloidal silver | 0.20 |
| Gelatin | 1.00 |
| Color mixing preventing agent (Cpd-7) | 0.06 |
| Color mixing preventing agent solvent (Solv-4, 5, mixing ratio: 1/1) | 0.15 |
| Polymer latex (Cpd-8) | 0.10 |
| Tenth Layer: Intermediate Layer | |
| Same as Fifth Layer | |
| Eleventh Layer: Low Sensitive Blue-sensitive Layer | |
| Silver bromide emulsion spectrally sensitized with Blue-sensitizing dye (ExS-5) (average grain size: 0.35 μm, size distribution: 8%, tetradecahedral) | 0.07 |
| Silver bromide emulsion spectrally sensitized with Blue-sensitizing dye (ExS-5) (average grain size: 0.45 μm, size distribution: 10%, tetradecahedral) | 0.10 |
| Gelatin | 0.50 |
| Yellow coupler (ExY-1) | 0.20 |
| Stain preventing agent (Cpd-11) | 0.001 |
| Fading preventing agent (Cpd-6) | 0.10 |
| Coupler dispersing medium (Cpd-5) | 0.05 |
| Coupler solvent (Solv-2) | 0.05 |
| Twelfth Layer: High Sensitive Blue-sensitive Layer | |
| Silver bromide emulsion spectrally sensitized with Blue-sensitizing dyes (ExS-5, 6) (average grain size: 1.2 μm, size distribution: 10%, tetradecahedral) | 0.25 |
| Gelatin | 1.00 |
| Yellow coupler (ExY-1) | 0.40 |
| Stain preventing agent (Cpd-11) | 0.002 |
| Fading preventing agent (Cpd-6) | 0.10 |
| Coupler dispersing medium (Cpd-5) | 0.05 |
| Coupler solvent (Solv-2) | 0.10 |
| Thirteenth Layer: Ultraviolet Absorbing Layer | |
| Gelatin | 1.50 |
| Ultraviolet absorbing agent (Cpd-1, 3, 13, mixing ratio: 1/1/1) | 1.00 |
| Color mixing preventing agent (Cpd-6, 14, mixing ratio: 1/1) | 0.06 |
| Dispersing medium (Cpd-5) | 0.08 |
| Ultraviolet absorbing agent solvent (Solv-1, 2, mixing ratio: 1/1) | 0.15 |
| Irradiation preventing dye (Cpd-15, 16, mixing ratio: 1/1) | 0.02 |
| Irradiation preventing dye (Cpd-17, 18, mixing ratio: 1/1) | 0.02 |
| Fourteenth Layer: Protective Layer | |
| Silver bromochloride fine particles (silver chloride: 97 mol %, average grain size: 0.2μ) | 0.15 |
| Modified polyvinylalcohol | 0.02 |
| Gelatin | 1.50 |
| Gelatin hardener (H-1) | 0.17 |

The emulsions used herein except that used in Fourteenth layer were prepared as follows.

An aqueous solution of potassium bromide and an aqueous solution of silver nitrate were added simultaneously to a gelatin aqueous solution containing 0.3 g/molAg of 3,4-dimethyl-1,3-thiazoline-2-thion over about 20 minutes at 75° C. while vigorously stirring, to obtain a monodispersed octahedral silver bromide emsulsion having an average grain size of 0.40 μm. 6 mg/molAg of sodium thiosulfate and 7 mg/molAg of chloroauric acid tetrahydrate were added thereto and the emulsion was heated to 75° C. for 80 minutes to accomplish chemical sensitization. While thus-obtained silver bromide emulsion was used as core particles, the particles were further grown under the same precipitation condition as above to obtain a monodispersed octahedral core/shell type silver bromdie having an average grain size of 0.7 μm. The coefficient of variation of the grain size was about 10%.

1.5 mg/molAg of sodium thiosulfate and 1.5 mg/molAg of chloroauric acid were added to the emulsion, and the emulsion was heated to 60° C. for 60 minutes to accomplish chemical sensitization, thus an inner latent image type silver halide emulsion was obtained.

To each light-sensitive layer, Nucleating agent (N-I-9) and Nucleating accelerator (ExZS-1) were added in amounts of $1\times10^{-3}$ wt% and $1\times10^{-2}$ wt%, respectively, based on the amount of silver halide.

To each layer, emulsifying assistant agents (Alkanol XC (Du pont) and sodium alkylbenzenesulfonate) and coating assistant agents (succinic acid ester and Magefacx F-120 (Dai Nippon Ink and Chemical Co., Ltd.)) were added. Furthermore, to the layers containing silver halide or colloidal silver, Stabilizers (Cdp-19, 20, 21) were added. Thus-obtained light-sensitive material was designated Sample I.

The compounds used in Example 9 are indicated below.

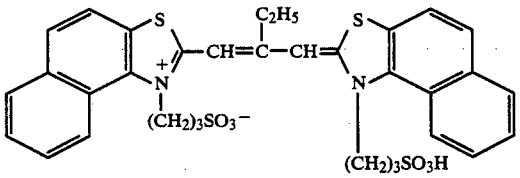
(ExS-1)
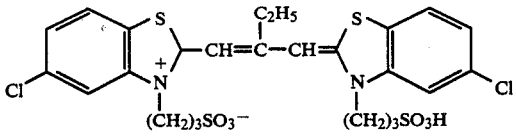
(ExS-2)
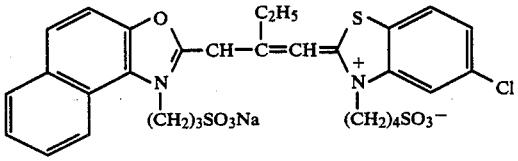
(ExS-3)
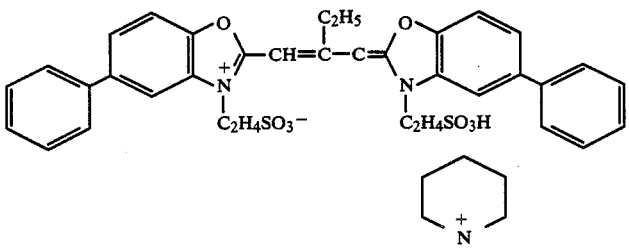
(ExS-4)
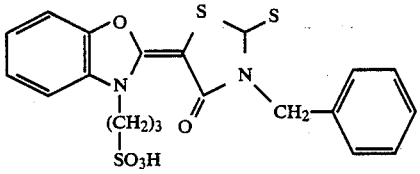
(ExS-5)
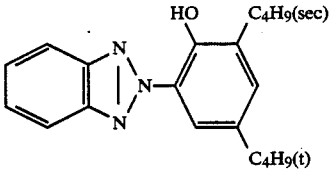
(Cpd-1)
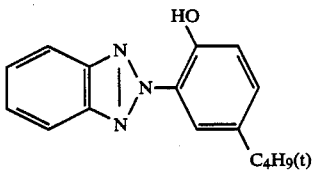
(Cpd-2)
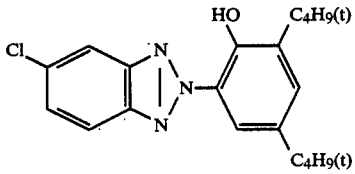
(Cpd-3)

-continued
(Cpd-4)
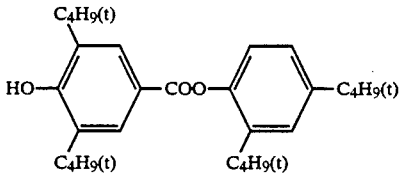
(Cpd-5)
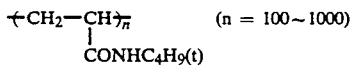
(Cpd-6)
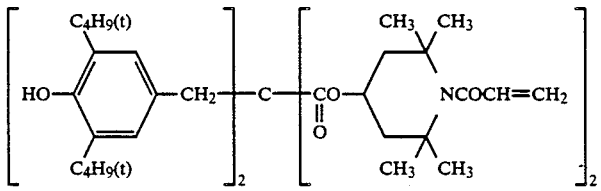
(Cpd-7)
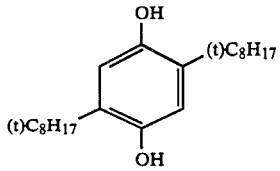
Polyethylacrylate (Cpd-8)
(Cpd-9)
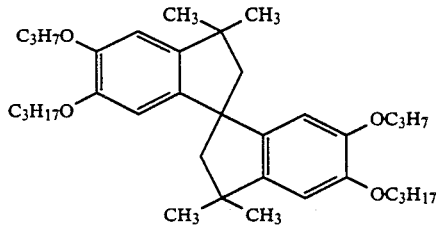
(Cpd-10)
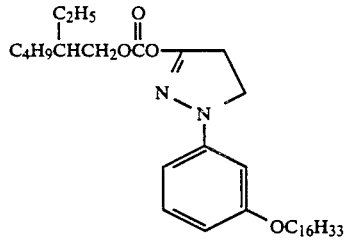
(Cpd-11)
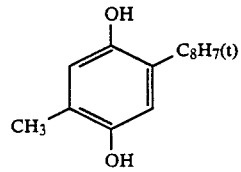
(Cpd-12)
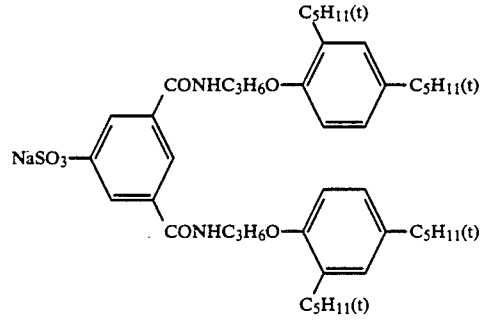

-continued
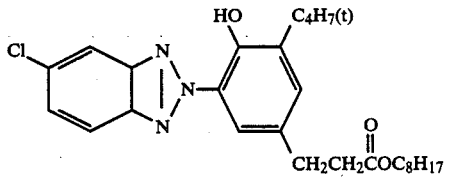
(Cpd-13)
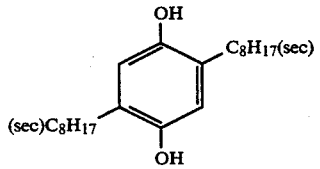
(Cpd-14)
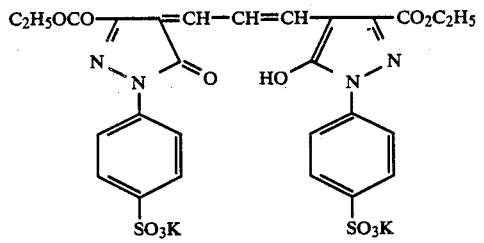
(Cpd-15)
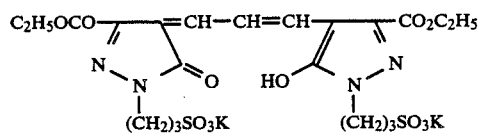
(Cpd-16)
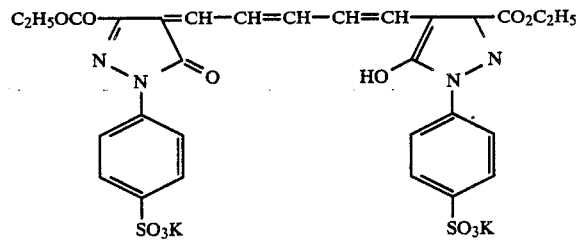
(Cpd-17)
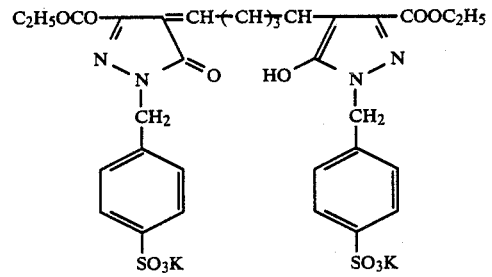
(Cpd-18)
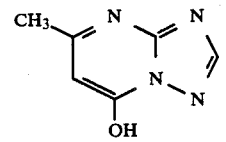
(Cpd-19)
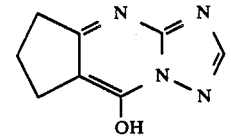
(Cpd-20)

-continued (Cpd-21)

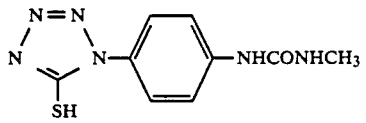

(ExC-1)

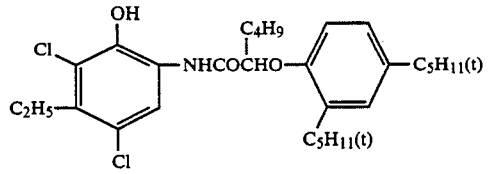

(ExC-2)

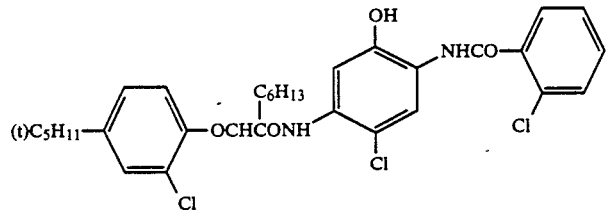

(ExM-1)

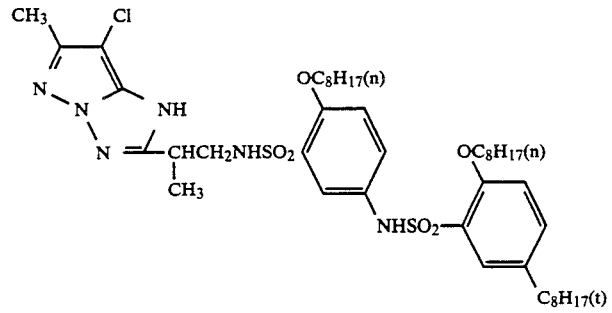

(ExY-1)

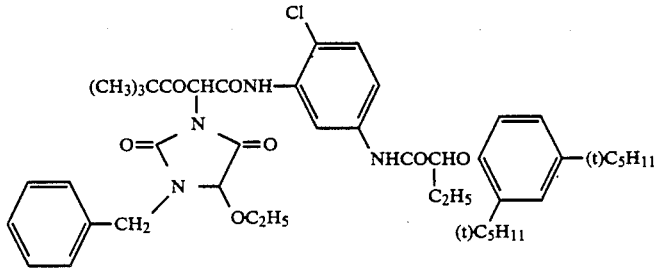

(Solv-1) di(2-ethylhexyl)phthalate
(Solv-2) trinonylphosphate
(Solv-3) di(3-methylhexyl)phthalate
(Solv-4) tricresylphosphate
(Solv-5) dibutylphthalate
(Solv-6) trioctylphosphate
(H-1) 1,2-bis(vinylsulfonylacetamide)ethane (N-I-9)

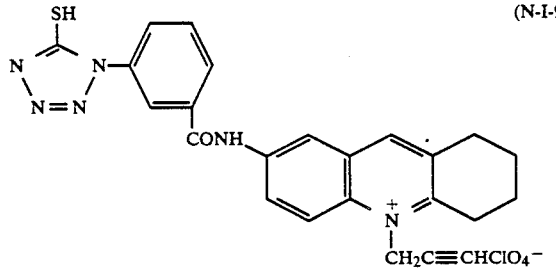

-continued (ExZS-1)

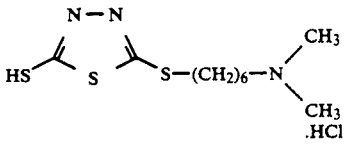

Samples I-1 to I-14 were prepared in the same manner as in the preparation of Sample I except that the magenta coupler and (Cdp-12) in Sixth and Seventh layers were changed in the manner as in Table 9.

Samples I and I-1 to I-14 thus-obtained above were exposed to light through an optical wedge, and then processed by the following Process C.

| | Process C | |
|---|---|---|
| | Time (sec) | Temperature (°C.) |
| Color development | 90 | 38 |

-continued

| | Process C | |
|---|---|---|
| | Time (sec) | Temperature (°C.) |
| Blix | 45 | 38 |
| Washing (1) | 45 | 38 |
| Washing (2) | 45 | 38 |

In the washing steps, the replenisher was supplied to the washing tank (2) and the overflow was introduced to the washing tank (1) (the countercurrent system).

The compositions of each processing solution were as follows.

| | |
|---|---|
| Color Developer | |
| Diethylenetriaminepentaacetic acid | 0.5 g |
| 1-Hydroxyethylidene-1,1-disulfonic acid | 0.5 g |
| Diethylene glycol | 8.0 g |
| Benzyl alcohol | 12.0 g |
| Sodium bromide | 0.7 g |
| Sodium sulfite | 2.0 g |
| N,N-Diethylhydroxylamine | 3.5 g |
| Triethylenediamine(1,4-diazabicyclo-(2,2,2)octane) | 3.5 g |
| 3-Methyl-4-amino-N-ethyl-N-(β-ethane-sulfoneamidoethyl)aniline | 6.0 g |
| Potassium carbonate | 30.0 g |
| Fluorescent whitening agent (stilbene type) | 1.0 g |
| Pure water to make | 1,000 ml |
| pH | 10.50 |
| (pH was adjusted with potassium hydroxide or hydrochloric acid.) | |
| Blix Solution | |
| Ammonium thiosulfate | 110 g |
| Sodium hydrogensulfite | 14.0 g |
| Ammonium iron (III) ethylenediamine-tetraacetate dihydride | 40.0 g |
| Disodium ethylenediaminetetraacetate dihydride | 4.0 g |
| Pure water to make | 1,000 ml |
| pH | 7.0 |
| (pH was adjusted with aqueous ammonia or hydrochloric acid.) | |
| Washing Water | |
| Pure water was used. | |

The term "pure water" used herein means the water produced by processing with the ion exchanging process whereby the cation concentration and the anion concentration (except hydrogen ion and hydroxide ion) were reduced to 1 ppm or less.

The magenta reflective density in the part where an image was not formed (stain) of the above exposed and processed samples was measured. Then, the samples were stored at 80° C., 70%RH for 3 days, and another samples were stored at room temperature for 80 days, then the stain of these samples was measured. The increase in magenta density based on the density 1 hour after processing was evaluated, and the results obtained are indicated in Table 9 below.

TABLE 9

| Sample | Magenta Coupler | Additive | Amount of Additive (mol %/coupler) | Increase in Magenta Stain: 80° C./70%, 3 days | Increase in Magenta Stain: Room Temperature, 80 days |
|---|---|---|---|---|---|
| I | M-23* | I-1** | 10% | 0.02 | 0.01 |
| I-1 | " | — | — | 0.11 | 0.10 |
| I-2 | " | I-23 | 10% | 0.02 | 0.01 |
| I-3 | " | I-24 | " | 0.03 | 0.01 |
| I-4 | " | I-25 | " | 0.02 | 0.02 |
| I-5 | " | I-38 | " | 0.02 | 0.02 |
| I-6 | " | I-44 | " | 0.03 | 0.01 |
| I-7 | M-27 | — | — | 0.06 | 0.05 |
| I-8 | " | I-1 | 10% | 0.02 | 0.01 |
| I-9 | " | I-17 | " | 0.01 | 0.01 |
| I-10 | " | I-20 | " | 0.01 | 0.01 |
| I-11 | " | I-30 | " | 0.01 | 0.01 |
| I-12 | " | I-34 | " | 0.01 | 0.01 |
| I-13 | " | I-40 | " | 0.01 | 0.01 |
| I-14 | " | I-44 | " | 0.01 | 0.01 |

Samples I-1 and I-7 are comparative samples and the others are the present invention.

*Magenta coupler (M-23) is the same as (ExM-1).

**(II-1) is the same as (Cdp-12).

In addition to the above, the samples in which the emulsions used (silver bromide) were changed to silver chlorobromide emulsions (chloride content: 0.5 to 99.5 mol%) were examined and evaluated in the same manner as above, and it was found that the superior effects similar to in Table 9 were obtained.

From the above results (including those indicated in Table 9), in the samples of the present invention, the magenta stain due to the lapse of time was markedly prevented, and the antifading property against light was improved.

EXAMPLE 10

A multilayer photographic printing paper Samdsple J was prepared. A coating solutions were prepared as follows.

Preparation of the coating solution for the First Layer 10.2 g of Yellow coupler (ExY-1), 9.1 of Yellow coupler (ExY-2), and 4.4 g of Dye image stabilizer (Cdp-12) were dissolved in 27.2 cc of ethyl acetate and 7.7 cc (8.0 g) of High boiling point solvent (Solv-5). This solution was emulsified in 185 cc of 10% gelatin aqueous solution containing 8 cc of 10% aqueous solution of sodium dodecylbenzenesulfonate. Emulsions (EM1) and (EM2) described hereinafter were mixed with thus-obtained emulsion, and the gelatin concentration was adjusted whereby the composition became the following to obtain the coating solution for the First Layer.

The coating solutions for the Second to Seventh Layers were prepared in the same manner as in the above.

In all the coating solutions, 1-oxy-3,5-dichloro-s-triazine sodium salt was used as a gelatin hardener.

The following the First to Seventh Layers were provided consecutively on a polyethylene laminated paper support in which the polyethylene on the First Layer side contained a white pigment ($TiO_2$) and a blueish pigment.

Construction of Layers

The coated amounts are indicated in terms of g/m$^2$ provided that the coated amounts of the silver halide emulsions are indicated in terms of g Ag/m$^2$.

| Support | |
|---|---|
| First Layer: Blue-sensitive Layer | |
| Monodispersed silver chlorobromide emulsion (EM1) spectrally sensitized with Sensitizing dye (ExS-1) | 0.13 |
| Monodispersed silver chlorobromide emulsion (EM2) spectrally sensitized with Sensitizing dye (ExS-1) | 0.13 |
| Gelatin | 1.86 |
| Yellow coupler (ExY-1) | 0.44 |
| Yellow coupler (ExY-2) | 0.39 |
| Dye image stabilizer (Cdp-12) | 0.19 |
| Solvent (Solv-5) | 0.35 |
| Second Layer: Color-mixing Preventing Layer | |
| Gelatin | 0.99 |
| Color mixing preventing agent (Cdp-7) | 0.08 |
| Third Layer: Green-sensitive Layer | |
| Monodispersed silver chlorobromide emulsion (EM3) spectrally sensitized with Sensitizing dyes (ExS-2, 3) | 0.05 |
| Monodispersed silver chlorobromide emulsion (EM4) spectrally sensitized with Sensitizing dyes (ExS-2, 3) | 0.11 |
| Gelatin | 1.80 |
| Magenta coupler (ExM-1) | 0.38 |
| Dye image stabilizer (Cdp-11) | 0.20 |
| Solvent (Solv-4) | 0.12 |
| Solvent (Solv-6) | 0.25 |
| Fourth Layer: Ultraviolet Absorbing Layer | |
| Gelatin | 1.60 |
| Ultraviolet absorbing agents (Cdp-1, 2, 3, mixing ratio: 3/2/6 by weight) | 0.70 |
| Color mixing preventing agent (Cdp-6) | 0.05 |
| Solvent (Solv-2) | 0.27 |
| Fifth Layer: Red-sensitive Layer | |
| Monodispersed silver chlorobromide emulsion (EM5) spectrally sensitized with Sensitizing dyes (ExS-8, 12) | 0.07 |
| Monodispersed silver chlorobromide emulsion (EM6) spectrally sensitized with Sensitizing dyes (ExS-8, 12) | 0.16 |
| Gelatin | 0.92 |
| Cyan coupler (ExC-6) | 0.32 |
| Dye image stabilizer (Cdp-2, 3, 4, mixing ratio: 3/4/2 by weight) | 0.17 |
| Polymer dispersant (Cdp-9) | 0.28 |
| Solvent (Solv-4) | 0.20 |
| Sixth Layer: Ultraviolet Absorbing Layer | |
| Gelatin | 0.54 |
| Ultraviolet absorbing agent (Cdp-1, 3, 4, mixing ratio: 1/5/3 by weight) | 0.21 |
| Solvent (Solv-4) | 0.08 |
| Seventh Layer: Protective Layer | |
| Gelatin | 1.33 |
| Acryl-modified polyvinyl alcohol copolymer (modification degree: 17%) | 0.17 |
| Liquid paraffin | 0.03 |

For preventing irradiation, Irradiation Preventing Dyes (Cdp-15, 22) were used.

To all the layers, Alkanol XC (Du pont), sodium alkylbenzenesulfonate, succinic acid ester, and Mage-facx F-120 (Dai Nippon Ink and Chemical Co., Ltd.) were used as an emulsifying dispersant and a coating assistant agent.

For stabilizing silver halides, Silver halide stabilizers (Cdp-19, 21) were used.

Silver halide emulsions EM1 to EM6 are indicated below.

| Emulsion | Crystal form | Grain size (μm) | Bromide content (mol %) | Coefficient of variation |
|---|---|---|---|---|
| EM1 | cubic | 1.0 | 80 | 0.08 |
| EM2 | cubic | 0.75 | 80 | 0.07 |

-continued

| Emulsion | Crystal form | Grain size (μm) | Bromide content (mol %) | Coefficient of variation |
|---|---|---|---|---|
| EM3 | cubic | 0.5 | 83 | 0.09 |
| EM4 | cubic | 0.4 | 83 | 0.10 |
| EM5 | cubic | 0.5 | 73 | 0.09 |
| EM6 | cubic | 0.4 | 73 | 0.10 |

Samples J-1 to J-18 were prepared in the same manner as in the preparation of Sample J except that the magenta coupler in the Third Layer was changed to the same molar amount of those indicated in Table 10, and that the compound of the present invention was added as in Table 10.

The thus-obtained samples were exposed to light through an optical wedge, and processed by the following Process I to obtain color images.

Process I

By using Fuji Color Paper Processor FPRP 115, the running development process was carried out under the following condition.

| Step | Temperature (°C.) | Time (min) | Replenishing amount* (ml) | Tank volume (l) |
|---|---|---|---|---|
| Color development | 37 | 3.5 | 200 | 60 |
| Blix | 33 | 1.5 | 55 | 40 |
| Washing (1)** | 24–34 | 1 | — | 20 |
| Washing (2)** | 24–34 | 1 | — | 20 |
| Washing (3)** | 24–34 | 1 | 10 | 20 |
| Drying | 70–80 | 1 | | |

*Amount per 1 $m^2$ of the light-sensitive material

**Countercurrent system from Washing (3) to Washing (1)

The compositions of the processing solutions used in Process I were as follows.

| | Tank Solution | Replenisher |
|---|---|---|
| Color Developer | | |
| Water | 800 ml | 800 ml |
| Diethylenetriaminepentaacetic Acid | 1.0 g | 1.0 g |
| Nitrilotriacetic Acid | 2.0 g | 2.0 g |
| Benzyl Alcohol | 15 ml | 23 ml |
| Diethylene Glycol | 10 ml | 10 ml |
| Sodium Sulfite | 2.0 g | 3.0 g |
| Potassium Bromide | 1.2 g | — |
| Potassium Carbonate | 30 g | 25 g |
| N-Ethyl-N-(β-methanesulfonamidoethyl)-3-methyl-4-aminoaniline Sulfate | 5.0 g | 9.0 g |
| Hydroxylamine Sulfate | 3.0 g | 4.5 g |
| Fluorescent Whitening Agent (WHITEX 4B, Sumitomo Chemical Company, Limited) | 1.0 g | 2.0 g |
| Water to make | 1,000 ml | 1,000 ml |
| pH at 25° C. | 10.20 | 10.80 |
| Blix Solution | | |
| Water | 400 ml | 400 ml |
| Ammonium Thiosulfate (70% soln.) | 150 ml | 300 ml |
| Sodium Sulfite | 13 g | 26 g |
| Ammonium Iron (III) Ethylenediaminetetraacetate | 55 g | 110 g |
| Disodium Ethylenediaminetetraacetate | 5 g | 10 g |
| Water to make | 1,000 ml | 1,000 ml |
| pH at 25° C. | 6.70 | 6.30 |

The magenta reflective density in the part where an image was not formed (stain) of the abvoe exposed and processed samples was measured. The samples were stored at 80° C., 70% RH for 3 days, and another samples were stored at room temperature for 50 days, then the stain of these samples was measured. The increase in magenta density based on the density 1 hour after processing was evaluated, and the results obtained are indicated in Table 10.

TABLE 10

| Sample | Magenta Coupler | Additive | Amount of Additive (mol %/coupler) | Increase in Magenta Stain: 80° C./70%, 3 days | Increase in Magenta Stain: Room Temperature 50 days |
|---|---|---|---|---|---|
| J | ExM-1 | — | — | 0.09 | 0.07 |
| J-1 | " | (I-1) | 20 | 0.02 | 0.01 |
| J-2 | " | (I-23) | " | 0.01 | 0.01 |
| J-3 | " | (I-24) | " | 0.02 | 0.01 |
| J-4 | " | (I-25) | " | 0.02 | 0.01 |
| J-5 | ExM-2 | — | — | 0.09 | 0.06 |
| J-6 | " | (I-1) | 20 | 0.01 | 0.02 |
| J-7 | " | (I-25) | " | 0.02 | 0.01 |
| J-8 | " | (I-38) | " | 0.01 | 0.01 |
| J-9 | " | (I-44) | " | 0.02 | 0.02 |
| J-10 | " | (I-49) | " | 0.02 | 0.01 |
| J-11 | ExM-3 | — | — | 0.06 | 0.03 |
| J-12 | " | (I-17) | 20 | 0.01 | 0.01 |
| J-13 | " | (I-19) | " | 0.01 | 0.01 |
| J-14 | " | (I-21) | " | 0.01 | 0.01 |
| J-15 | ExM-4 | — | — | 0.08 | 0.07 |
| J-16 | " | (I-23) | 20 | 0.01 | 0.02 |
| J-17 | " | (I-38) | " | 0.02 | 0.01 |
| J-18 | " | (I-50) | " | 0.01 | 0.02 |

Samples J, J-5, J-11, and J-15 are comparative samples, and the other are the present invention.

From the results shown in Table 10, the present invention has a marked effect in prevention of magenta stain using Process I.

EXAMPLE 11

The samples prepared in Example 10 were exposed to light through an optical wedge, and processed by using Process II to Process V below. The samples thus-processed were evaluated for magenta stain in the same manner as in Example 10. In the comparative samples, increase in magenta stain was observed, but in the samples of the present invention, substantially no stain was observed.

Process II

| Step | Temperature (°C.) | Time |
|---|---|---|
| Color Development | 38 | 1'40" |
| Blix1 | 30–34 | 1'00" |
| Rinse (1) | 30–34 | 20" |
| Rinse (2) | 30–34 | 20" |
| Rinse (3) | 30–34 | 20" |
| Drying | 70–80 | 50" |

Rinse steps are the countercurrent system from Rinse (3) to Rinse (1).

The compositions of the processing solutions used in Process II were as follows.

| Color Developer | |
|---|---|
| Water | 800 ml |
| Diethylenetriaminepentaacetic Acid | 1.0 g |
| 1-Hydroxyethylidene-1,1-disulfonic Acid (60%) | 2.0 g |
| Nitrilotriacetic Acid | 2.0 g |
| 1,3-Diamino-2-propanol | 4.0 g |
| 1,4-Diazabicyclo (2,2,2) octane | 6.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| N,N-Diethylhydroxylamine sulfate | 4.0 g |
| Fluorescent Whitening Agent (UVITEX-CK, Chiba Geigy) | 1.5 g |
| Water to make | 1,000 ml |
| pH at 25° C. | 10.25 |
| **Blix Solution** | |
| Water | 400 ml |
| Ammonium Thiosulfate (70% soln.) | 200 ml |
| Sodium Sulfite | 20 g |
| Ammonium Iron (III) Ethylenediaminetetraacetate | 60 g |
| Disodium Ethylenediaminetetraacetate | 10 g |
| Water to make | 1,000 ml |
| pH at 25° C. | 7.00 |
| **Rinse Solution** | |
| Ion exchanged water (The concentrations of Ca and Mg are 3 ppm or less.) | |

Process III

| Step | Temperature (°C.) | Time (sec) | Replenishing amount* (ml) | Tank volume (l) |
|---|---|---|---|---|
| Color development | 35 | 45 | 161 | 17 |
| Blix | 30–36 | 45 | 215 | 17 |
| Stabilization (1)** | 30–37 | 20 | — | 10 |
| Stabilization (2)** | 30–37 | 20 | — | 10 |
| Stabilization (3)** | 30–37 | 20 | — | 10 |
| Stabilization (4)** | 30–37 | 30 | 428 | 10 |
| Drying | 70–85 | 60 | | |

*Amount per 1 $m^2$ of the light-sensitive material
**Countercurrent system from Stabilization (4) to Stabilization (1)

The compositions of the processing solutions used in Process III were as follows.

| Color Developer | Tank Solution | Replenisher |
|---|---|---|
| Water | 800 ml | 800 ml |
| Ethylenediaminetetraacetic Acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Potassium Bromide | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| Diethylhydroxylamine | 4.2 g | 6.0 g |
| Fluorescent Whitening Agent (4,4-diaminostilbene type) | 2.0 g | 2.5 g |
| Water to make | 1,000 ml | 1,000 ml |
| pH at 25° C. | 10.05 | 10.45 |

Blix Solution

The tank solution and the replenisher had the same composition.

| | |
|---|---|
| Water | 400 ml |
| Ammonium Thiosulfate (70% soln.) | 100 ml |
| Sodium Sulfite | 17 g |
| Ammonium Iron (III) Ethylenediaminetetraacetate | 55 g |
| Disodium Ethylenediaminetetraacetate | 5 g |
| Glacial acetic acid | 9 g |
| Water to make | 1,000 ml |
| pH at 25° C. | 5.40 |

Stabilizing Solution

The tank solution and the replenisher had the same composition.

| | |
|---|---|
| Formaline (37%) | 0.1 g |
| Formaline-sulfinic acid addact | 0.7 g |
| 5-Chloro-2-methyl-4-isothiazoline-3-one | 0.02 g |
| 2-Methyl-4-isothiazoline-3-one | 0.01 g |
| Copper sulfate | 0.005 g |
| Water to make | 1,000 ml |
| pH at 25° C. | 4.0 |

Process IV

By using Fuji Color Roll Processor FMPP 1000 (partially modified) (made by Fuji Photo Film Co., Ltd.), the running development process was carried out under the following condition.

| Step | Time (sec) | Temperature (°C.) | Tank volume (l) | Replenishing amount (ml/m²) |
|---|---|---|---|---|
| Color development | 45 | 35 | 88 | 150 |
| Blix | 45 | 35 | 35 | 50 |
| Rinse (1) | 20 | 35 | 17 | — |
| Rinse (2) | 20 | 35 | 17 | — |
| Rinse (3) | 20 | 35 | 17 | 250 |

In the rinse step, the replenisher was supplied to the rinse tank (3) and the overflow was introduced into the rinse tank (2). The overflow from the rinse tank (2) was introduced into the rinse tank (1) and the overflow from the rinse tank (1) was wasted (3 tank countercurrent system). The amount of the processing solution carried from the previous bath by the photographic papaer is 25 ml per 1 m² of the paper.

The compositions of the processing solutions (tank solutions and replenishers) are shown below.

| | Tank solution | Replenisher |
|---|---|---|
| Color Developer | | |
| Water | 800 ml | 800 ml |
| Diethylenetriaminepentaacetic Acid | 3.0 g | 3.0 g |
| Benzyl Alcohol | 15 ml | 17 ml |
| Diethylene Glycol | 10 ml | 10 ml |
| Sodium Sulfite | 2.0 g | 2.5 g |
| Potassium Bromide | 0.5 g | — |
| Sodium Carbonate | 30 g | 35 g |
| N-Ethyl-N-(β-methanesulfonamidoethyl)-3-methyl-4-aminoaniline Sulfate | 5.0 g | 7.0 g |
| Hydroxylamine Sulfate | 4.0 g | 4.5 g |
| Fluorescent Whitening Agent | 1.0 g | 1.5 g |
| Water to make | 1,000 ml | 1,000 ml |
| pH | 10.10 | 10.50 |
| Blix Solution | | |
| Water | 400 ml | 400 ml |
| Ammonium Thiosulfate (70% soln.) | 150 ml | 300 ml |
| Sodium Sulfite | 12 g | 25 g |
| Ammonium Iron (III) Ethylenediaminetetraacetate | 55 g | 110 g |
| Disodium Ethylenediaminetetraacetate | 5 g | 10 g |
| Water to make | 1,000 ml | 1,000 ml |
| pH at 25° C. | 6.70 | 6.50 |

Rinse Solution

The tank solution and the replenisher had the same composition.

| | |
|---|---|
| Ethylenediamine-,N,N',N'-tetramethylene phosphonic acid | 0.3 g |
| Benzotriazole | 1.0 g |
| Water to make | 1,000 ml |
| pH (adjusted with sodium hydroxide) | 7.5 |

Process V

| Step | Time | Tank volume (l) | Replenisher (ml/m²) |
|---|---|---|---|
| Color development | 45" | 88 | 150 |
| Blix | 2'00" | 35 | 350 |
| Rinse (1) | 1'00" | 17 | — |
| Rinse (2) | 1'00" | 17 | — |
| Rinse (3) | 1'00" | 17 | 1,300 |

The processing solutions (tank solutions and replenishers) used had the same compositions as those used in Process IV.

EXAMPLE 12

The same experiments as in Example 10 except that the silver halide emulsions (EM1 to EM6) and/or the cyan couplers were changed to the silver halide emulsions (EM7 to EM12) shown below and/or ExC-1 to ExC-6, respectively, and the same superior results as in Example 10 were obtained. Therefore, the compounds of the present invention had the superior magenta stain preventing property irrespective of the kind of the silver halide emulsions and the couplers added to the other layers.

| Emulsion | Crystal form | Grain size (μm) | Chloride content (mol %) | Coefficient of variation | Sensitizing dye |
|---|---|---|---|---|---|
| EM7 | cubic | 1.1 | 99.0 | 0.1 | (ExS-4) |
| EM8 | cubic | 0.8 | 99.0 | 0.1 | (ExS-4) |
| EM9 | cubic | 0.45 | 98.5 | 0.09 | (ExS-3, 5) |
| EM10 | cubic | 0.34 | 98.5 | 0.09 | (ExS-3, 5) |
| EM11 | cubic | 0.45 | 98.5 | 0.09 | (ExS-8, 12) |

-continued

| Emulsion | Crystal form | Grain size (μm) | Chloride content (mol %) | Coefficient of variation | Sensitizing dye |
|---|---|---|---|---|---|
| EM12 | cubic | 0.34 | 98.4 | 0.01 | (ExS-8, 12) |

The compounds used in Examples 10 to 12 are indicated below.

(ExS-1)

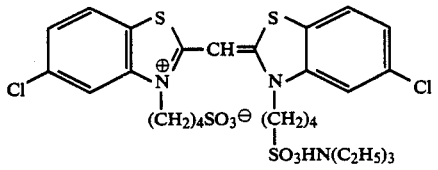

(ExS-2)

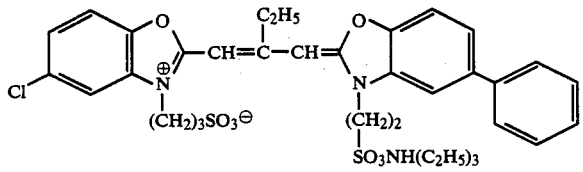

(ExS-3)

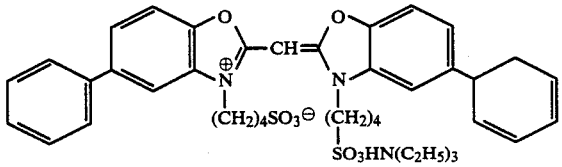

(ExS-4)

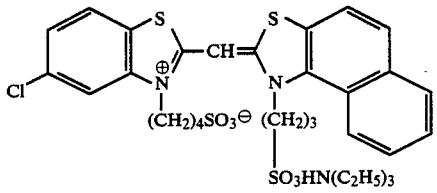

(ExS-5)

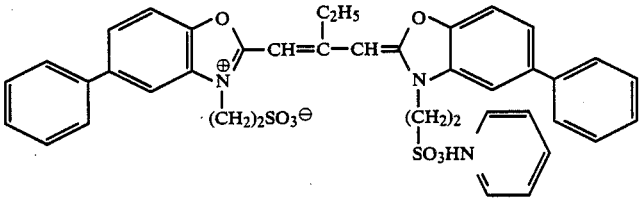

(ExS-6)

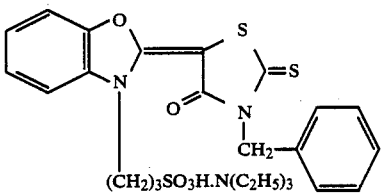

(ExS-7)

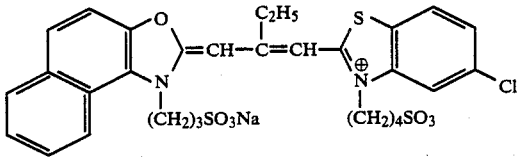

-continued
(ExS-8)
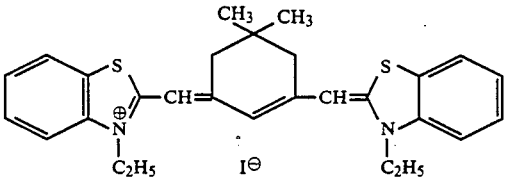
(ExS-9)
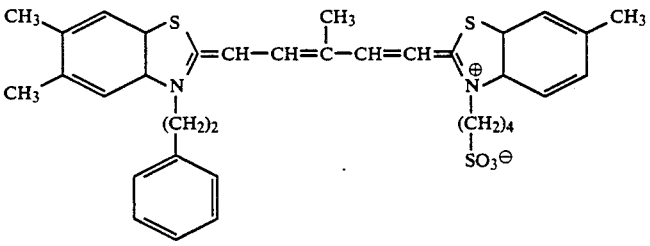
(ExS-10)
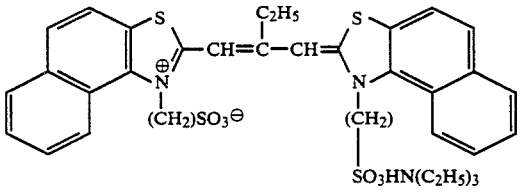
(ExS-11)
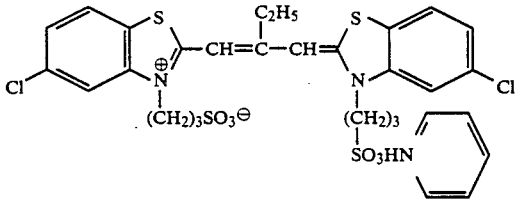
(ExS-12)
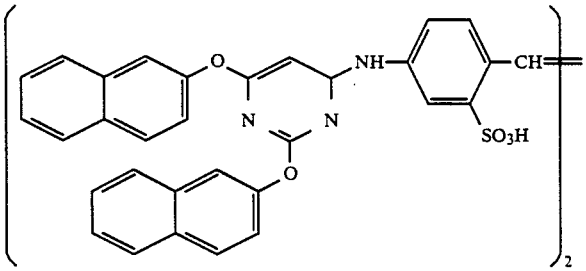
(ExY-1)
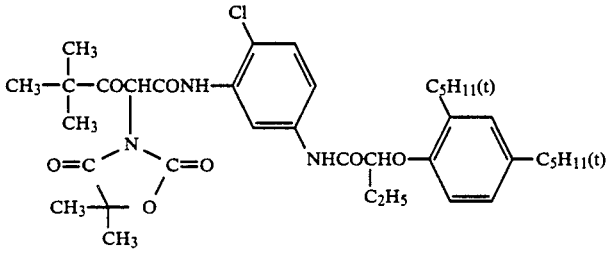

-continued
(ExY-2)
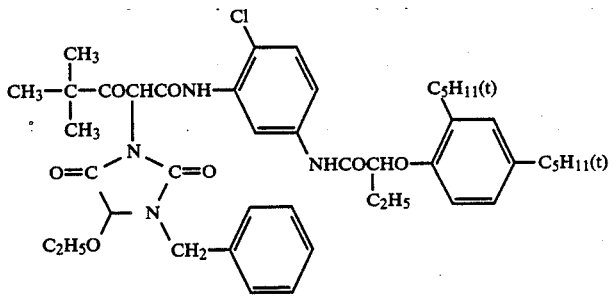
(ExM-1)
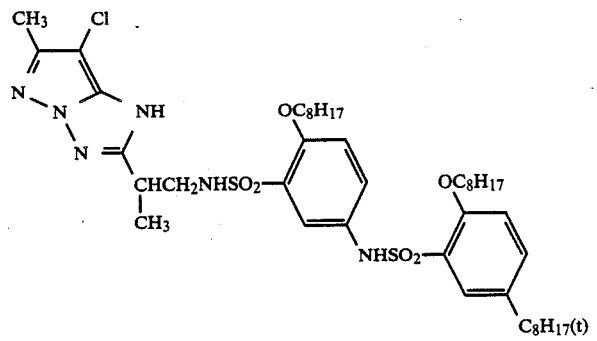
(ExM-2)
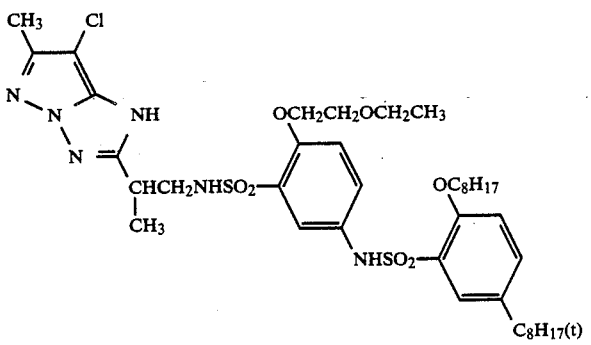
(ExM-3)
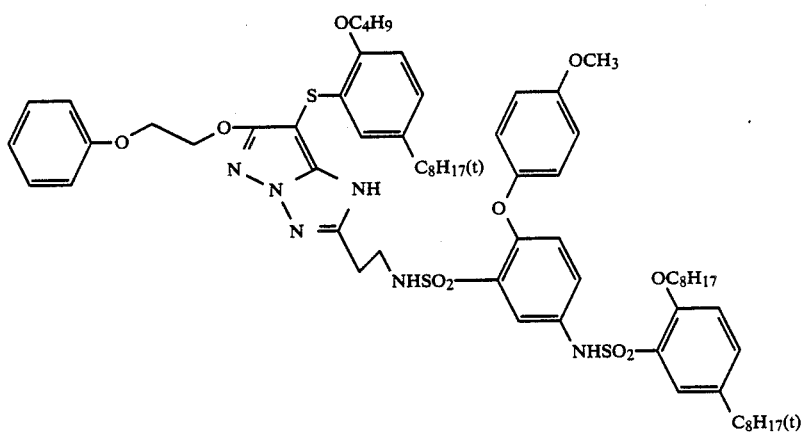

-continued
(ExM-4)
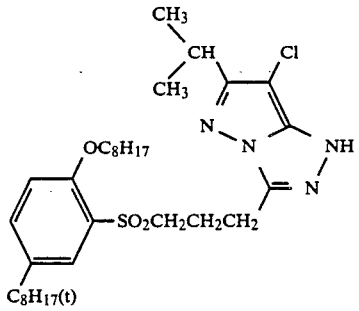
(ExC-1)
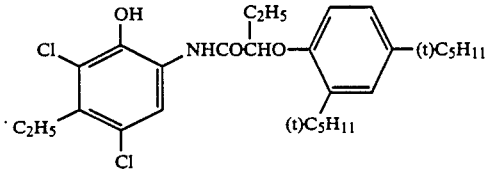
(ExC-2)
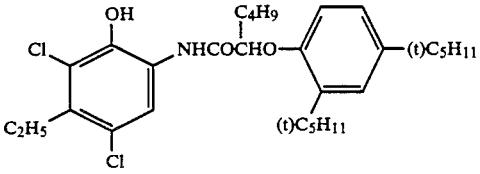
(ExC-3)
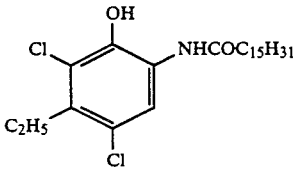
(ExC-4)
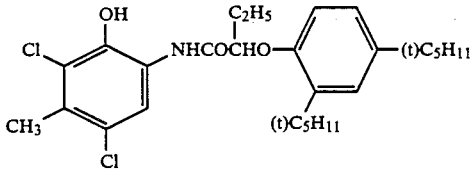
(ExC-5)
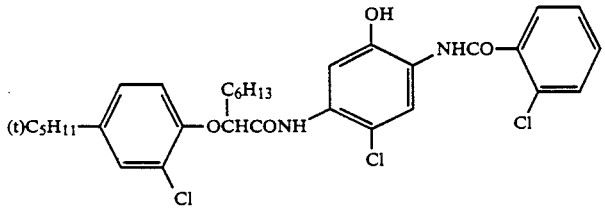
(ExC-6)
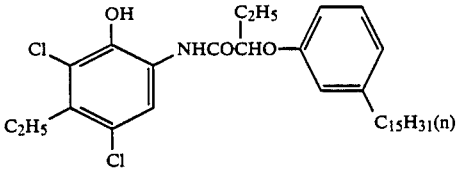
(Cpd-1)
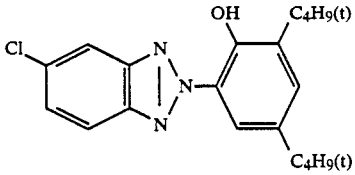

-continued
(Cpd-2)
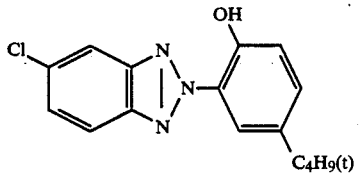
(Cpd-3)
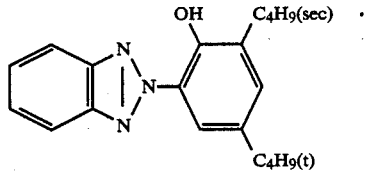
(Cpd-4)
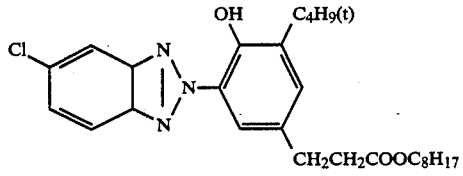
(Cpd-5)
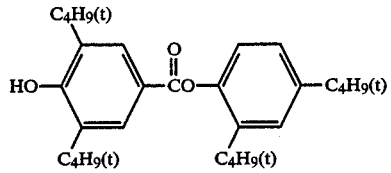
(Cpd-6)
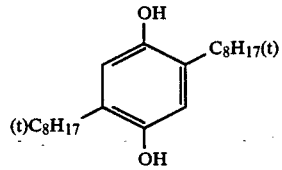
(Cpd-7)
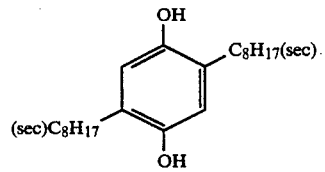
(Cpd-8)
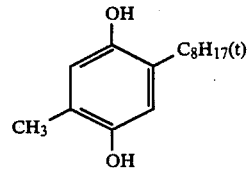
(Cpd-9)
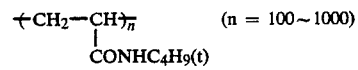
(Cpd-10)
Polyethylacrylate latex
(Cpd-11)
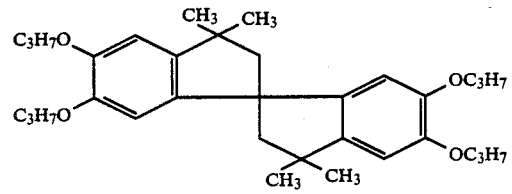

-continued
(Cpd-12)
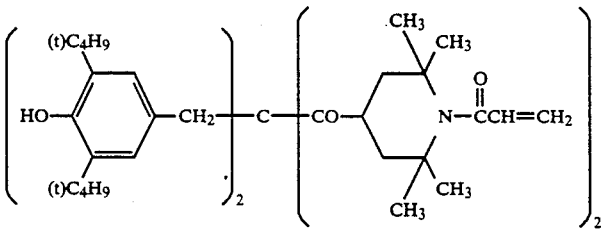
(Cpd-13)
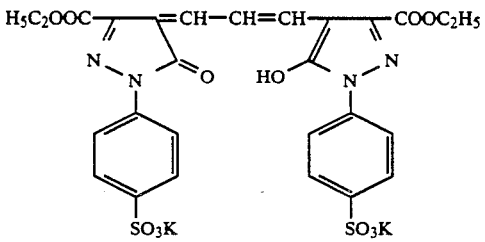
(Cpd-14)
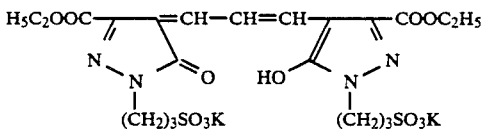
(Cpd-15)
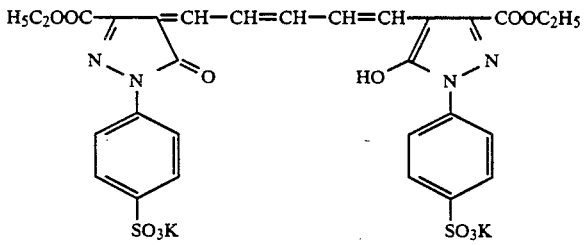
(Cpd-16)
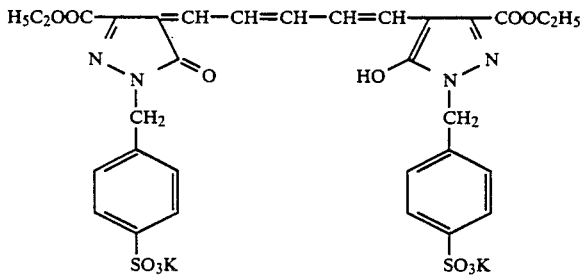
(Cpd-17)
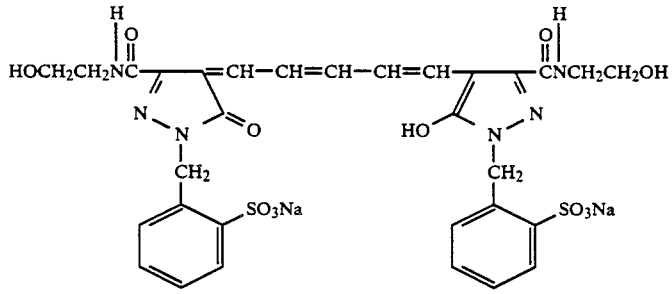

-continued (Cpd-18)

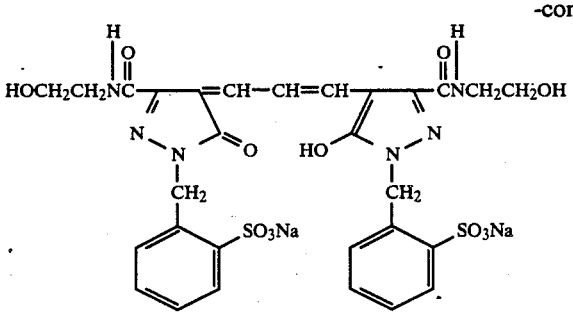

(Cpd-19)

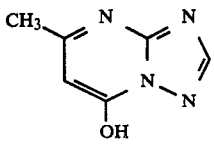

(Cpd-20)

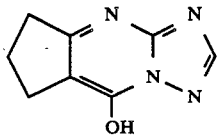

(Cpd-21)

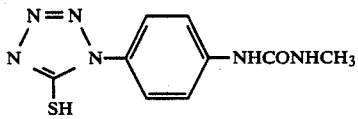

(Cpd-22)

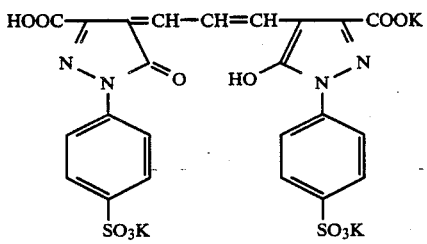

(Solv-1)
Di(2-ethylhexyl)phthalate
(Soilv-2)
Trinonylphosphate
(Solv-3)
Di-(3-ethylhexyl)phthalate
(Solv-4)
Tricresylphosphate
(Solv-5)
Dibutylphthalate
(Solv-6)
Trioctylphosphate
(Solv-7)
Dioctylsebacate
(Solv-8)
Dioctylazelate As described above, by using the compounds of the present invention to form chemically inert and substantially colorless compounds by combining with the oxidation product of an aromatic amino color developing agent remaining in the color photographic material after processing, the deterioration of color photograhic quality and the occurrence of stain with the passage of time can be effectively prevented. The effect can be attained even in the case of processing with processing liquids in a running state, processing liquids with a reduced amount of wash water or without using washing, a color developer containing substantially no benzyl alcohol, etc., which cause a large amount of components to be carried over in the color photographic materials during processing, or with other processing liqids creating a load on color development.

While the invention has been described in detail and with reference to specific embodiments thereof, it will be apparent to one skilled in the art that various changes and modifications can be made therein without departing from the spirit and scope thereof.

What is claimed is:

1. A process for making a color photograph, which comprises subjecting, after imagewise exposure, a color photographic light-sensitive material having on a support at least one silver halide emulsion layer containing a color image-forming coupler forming a dye by the oxidative coupling reaction with an aromatic amine color developing agent to color development, bleach, and fix or color development and blix in the presence of a storage stability improving compound forming a chemically inert and substantially colorless compound by causing chemical combination at a pH of 8 or less with the oxidation product of the aromatic amine color developing agent remaining therein after processing, said storage stability improving compound not being a polymer and being represented by formula (II):

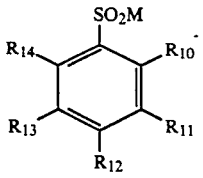

(II)

wherein M represents

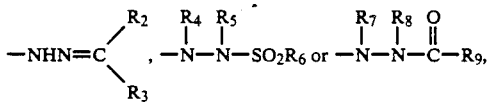

wherein $R_2$ and $R_3$ may be the same or different, and each represents a hydrogen atom, an aliphatic group, an aromatic group or a heterocyclic group, provided that $R_2$ and $R_3$ may be linked to form a 5- to 7-membered ring; $R_4$, $R_5$, $R_7$ and $R_8$ may be the same or different, and each represents a hydrogen atom, an aliphatic group, an aromatic group, a heterocyclic group, an acyl group, an alkoxycarbonyl group, a sulfonyl group, a ureido group or urethane group, provided that at least one of $R_4$ and $R_5$ and at least one of $R_7$ and $R_8$ each represents a hydrogen atom; $R_6$ and $R_9$ each represents a hydrogen atom, an aliphatic group, an aromatic group, or a heterocyclic group; or $R_9$ may represent an alkylamino group, an alkoxy group, an aryloxy group, an acyl group, an alkoxycarbonyl group, or an aryloxycarbonyl group, provided that at least two of $R_4$, $R_5$ and $R_6$ may be linked to form a 5- to 7-membered ring, and at least two of $R_7$, $R_8$ and $R_9$ may be linked to form a 5- to 7-membered ring; and $R_{10}$, $R_{11}$, $R_{12}$, $R_{13}$ and $R_{14}$, which may be the same or different, each represents a hydrogen atom, an aliphatic group, an aromatic group, a heterocyclic group, a halogen atom, $-SR_{15}$, $-OR_{15}$ or $-NR_{15}R_{16}$ in which $R_{15}$ and $R_{16}$, which may be the same or different in the case of $-NR_{15}R_{16}$, each represents a hydrogen atom, an aliphatic group, an alkoxy group, an aromatic group, an acyl group, an alkoxycarbonyl group, an aryloxycarbonyl group, a sulfonyl group, a sulfonamido group, a sulfamoyl group, a ureido group, a urethane group, a carbamoyl group, a sulfo group, a carboxy group, a nitro group, a cyano group, an alkoxyallyl group, an aryloxyallyl group, a sulfonyloxy group,

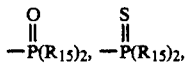

$-P(R_{15})_3$, $-P(OR_{15})_3$ in which $R_{15}$ is defined the same as $R_{15}$ above, or a formyl group.

2. A process for making a color photograph as claimed in claim 1, wherein the sum of Hammet's $\sigma$ value for the $-SO_2M$ group is at least 0.5.

3. A process for making a color photograph as claimed in claim 1, wherein the content of the storage stability improving compound in the photographic layer is from $1\times10^{-2}$ mol to 10 mols per mol of the color image-forming coupler in the photographic layer.

4. A process for making a color photograph as claimed in claim 1, wherein said storage stability improving compound is dissolved in a high-boiling solvent; the solution obtained is dispersed by emulsification in an aqueous solution of a hydrophilic colloid; and the dispersion obtained is incorporated in said color photographic light-sensitive material.

5. A process for making a color photograph as claimed in claim 4, wherein said storage stability improving compound is co-emulsified with said coupler.

* * * * *